US006334670B1

(12) United States Patent
Yoshihira et al.

(10) Patent No.: US 6,334,670 B1
(45) Date of Patent: Jan. 1, 2002

(54) METHOD FOR MANUFACTURING LIQUID JET HEAD, LIQUID JET HEAD, HEAD CARTRIDGE, AND LIQUID JET RECORDING APPARATUS

(75) Inventors: Aya Yoshihira, Yokohama; Masahiko Kubota, Tokyo; Kiyomitsu Kudo, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,102

(22) Filed: Dec. 2, 1999

(30) Foreign Application Priority Data

Dec. 3, 1998 (JP) ..... 10-344751
Nov. 10, 1999 (JP) ..... 11-319547

(51) Int. Cl.[7] ..... B41J 2/05
(52) U.S. Cl. ..... 347/65; 29/890.1
(58) Field of Search ..... 347/63, 65, 54, 347/67; 29/890.1

(56) References Cited

U.S. PATENT DOCUMENTS

| | | | | |
|---|---|---|---|---|
| 3,379,803 A | | 4/1968 | Tittmann | 264/81 |
| 4,723,129 A | | 2/1988 | Endo et al. | 347/66 |
| 5,684,519 A | * | 11/1997 | Matoba et al. | 347/54 |
| 5,821,962 A | * | 10/1998 | Kudo et al. | 347/65 |

FOREIGN PATENT DOCUMENTS

| | | | | |
|---|---|---|---|---|
| EP | 0811492 A2 | | 12/1997 | B41J/2/05 |
| EP | 0816083 A2 | | 1/1998 | B41J/2/05 |
| EP | 0920997 A | | 6/1999 | B41J/2/05 |
| EP | 920997 | * | 9/1999 | B41J/2/05 |
| EP | 956953 A2 | * | 11/1999 | B41J/2/16 |
| EP | 0956953 A2 | | 11/1999 | B41J/2/16 |
| JP | 44-21353 | | 9/1969 | |
| JP | 52-037479 | | 3/1977 | G01R/19/16 |
| JP | 55-81172 | | 6/1980 | B41J/3/04 |
| JP | 59-026270 | | 2/1984 | B41J/3/04 |
| JP | 61-59911 | | 3/1986 | H03K/17/687 |
| JP | 61-59914 | | 3/1986 | H03M/1/50 |
| JP | 04-329148 | | 11/1992 | B41J/3/05 |
| JP | 05-229122 | | 9/1993 | B41J/2/05 |

OTHER PUBLICATIONS

Patent Abstracts of Japan, vol. 017, No. 679 (M–1527), Publication No. JP 05229122, publication date Sep. 1993.
Patent Abstracts of Japan, vol. 013, No. 588 (M–912), Publication No. JP 012247168, Publication Date Oct. 1989.

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A method for manufacturing a liquid jet head, which is provided with first liquid flow paths communicated with discharge ports for discharging discharge liquid; second liquid flow paths having heat generating elements for creating bubbles in bubbling liquid which are arranged corresponding to the first liquid flow paths; and a movable separation film for essentially separating the first liquid flow paths and the corresponding second liquid flow paths from each other at all the time, comprises a first step of forming organic film becoming the movable separation film, and a second step of providing permanent distortion for the organic film formed in the first step. Here, in the second step, stress beyond yielding point is provided for the movable separation film, and the movable separation film should preferably contain polyparaxylene. With the method thus arranged, it becomes possible to manufacture a liquid jet head capable of changing the discharging droplet into a larger one with the application of the same bubbling power applied to the smaller one, thus leading to making the life of the head significantly longer.

14 Claims, 29 Drawing Sheets

METHOD FOR MANUFACTURING LIQUID JET HEAD, LIQUID JET HEAD, HEAD CARTRIDGE, AND LIQUID JET RECORDING APPARATUS

BACKGROUND OF THE INVENTION

1. Field of the Invention

The present invention relates to a method for manufacturing a liquid jet head that discharges a desired liquid by means of bubbles created by causing thermal energy to act upon liquid. The invention also relates to a liquid jet head, a head cartridge that uses the liquid jet head, and a liquid jet recording apparatus as well.

The present invention is applicable to a printer that records on a recording medium, such as papers, threads, textiles, cloths, leathers, metals, plastics, glass, wood, ceramics, and also, applicable to a copying machine, a facsimile equipment provided with communication system, and a word processor provided with the printing unit, among some others. Further, the invention is applicable to recording systems for industrial use which are structured by the complex combination of various kinds of processing apparatuses.

Here, the term "recording" referred to in the specification hereof means not only the provision of meaningful images, such as characters, graphics, but also, it means the provision of such meaningless images as patterns recorded on a recording medium.

2. Related Background Art

There has been known conventionally the so-called bubble jet recording method, that is, an ink jet recording method, in which by the application of thermal energy or the like to ink, the change of its states is made with the abrupt voluminal changes (creation of bubbles) to follow, and then, by the acting force brought about by this change of states, ink is discharged from each of the discharge ports, and allowed to adhere to a recording medium for the formation of images. A recording apparatus that uses this bubble jet recording method is generally provided with the discharge ports for discharging ink; the ink flow paths communicated with the discharges ports; and heat generating elements (electrothermal transducing devices) that serve as energy generating means for discharging ink which has been distributed into each of the ink flow paths as disclosed in the specifications of Japanese Patent Publication 61-59911 and Japanese Patent Publication 61-59914.

With the recording method described above, it is possible to record high quality images at higher speed with a lesser amount of noises, and at the same time, it becomes possible to arrange the discharge ports for discharging ink in high density for the head that implements this recording method. Therefore, this method has such excellent advantages as to enable images to be recorded in higher resolutions with a smaller apparatus, and also, images to be recorded in colors easily, among many other advantages. With these advantages, the bubble jet recording method has been widely adopted in recent years for a printer, a copying machine, a facsimile equipment, and many other office equipment. This method is even utilized for a textile printing system and some other industrial systems.

On the other hand, the conventional bubble jet recording method may sometimes bring about the creation of accumulated substance due to burning of ink on the surface of the heat generating elements, because heating is repeated while the heat generating elements are in contact with ink. Also, in such a case where the liquid for discharge use tends to be easily deteriorated by the application of heat or the liquid has a property that it does not provide a sufficient bubbling easily, the bubble formation by the direct heating for discharges by use of the heat generating elements described above does not present good condition in some cases.

In this respect, the applicant hereof has proposed a method in which the discharge liquid is discharged by bubbling the bubbling liquid by the application of thermal energy through the flexible film that separates the bubbling liquid and discharging liquid as disclosed in Japanese Patent Laid-Open Application 55-81172. The structure of this method formed by use of the flexible film and the bubbling liquid is such that the flexible film is provided for a part of each nozzle. In the same respect, there has been disclosed a structure in the specification of Japanese Patent Laid-Open Application 59-26270 that uses a large film for the separation of the entire head into the upper and lower parts. This large film is provided for the purpose to prevent liquid in each of the two liquid paths from being mixed by being pinched by the two plate members that form the liquid paths.

On the other hand, there has been a disclosure such as in the specification of Japanese Patent Laid-Open Application 05-229122 wherein the bubbling liquid itself has a specific property in consideration of the bubbling characteristics such as to present a lower boiling point than that of the discharging liquid or such as in the specification of Japanese Patent Laid-Open Application 04-329148 wherein a liquid having electric conductivity is used as bubbling liquid.

Here, the present inventors have proposed a liquid jet head which is capable of maintaining liquid discharges at a higher level, at the same time, producing the effect of separating function provided by the separation film to be used.

Such liquid jet head comprises a first liquid flow path for use of discharging liquid, which is communicated with each of the discharge ports; a second flow path that includes each of the bubble generating areas, while being arranged to supply bubbling liquid or to make it movable; and each of movable separation films to separate the first and second flow paths, having a recessed portion that faces the bubble generating area, respectively.

For the liquid jet head described above, it is effective for the stabilized discharges thereof to adopt a highly polymerized material that has a good response to bubbling as the movable separation film.

However, when a highly polymerized material is used, the balance between the sagging amount of the film and the bubbling power may exert influence on the discharge stability. In other words, if the bubbling power is stronger than the sagging amount of the film, power of the bubbling power is transformed into the energy that acts upon the expansion of the film, thus making the adjustment of such balance extremely sensitive.

Now, therefore, the inventors hereof have studied to develop a liquid jet head which is capable of maintaining the liquid discharges at a higher level, but not spoiling the effectiveness of the liquid jet head described above, as well as a method for manufacturing such liquid jet head.

SUMMARY OF THE INVENTION

During the studies of the inventions hereof, the present invention is designed, which is aimed at the provision of an epoch-making liquid jet head capable of enhancing the discharge efficiency of liquid droplet discharges, at the same time stabilizing and improving the volume of each discharged liquid droplet or the discharge speed thereof, and the method for manufacturing such liquid jet head as well.

It is an object of the invention to provide a liquid jet head which comprises at least first liquid flow paths communicated with discharge ports for discharging discharge liquid; second liquid flow paths having bubble generating areas for creating bubbles in bubbling liquid; and a movable separation film for essentially separating the first liquid flow paths and the corresponding second liquid flow paths from each other at all times, and for this liquid jet head, the stabilization of the discharges is attempted by making the displacement of such movable separation film constant all the time. The object of the invention is to provide the method for manufacturing such liquid jet head.

It is another object of the invention to provide a liquid jet head capable of essentially separating discharge liquid and bubbling liquid from each other at all the time by use of a movable separation film, and also capable of performing the stabilized discharges at all the time by displacing the movable separation film by the application of force exerted by the bubbling pressure, and to provide the method for manufacturing such liquid jet head as well.

In order to achiever these objects, the method of the present invention for manufacturing a liquid jet head which is provided with first liquid flow paths communicated with discharge ports for discharging discharge liquid, second liquid flow paths having heat generating elements for creating bubbles in bubbling liquid, corresponding to the first liquid flow paths, and a movable separation film for essentially separating the first liquid flow paths and the corresponding second liquid flow paths from each other at all times, comprising a first step of forming organic film becoming the movable separation film, and a second step of providing permanent distortion for the organic film formed in the first step.

In the aforesaid second step, stress beyond yielding point is provided for the movable separation film. It is preferable to contain polyparaxylene in the movable separation film.

With the structure as described above, permanent distortion is provided for a desired movable separation film after the movable separation film is formed to essentially separate the first liquid flow paths and the second liquid flow paths. Then, most of the elasticity of the movable separation film is eliminated (that is, the movable separation film is plastically deformed) so that part of the bubbling power is not allowed to be transformed into the energy that causes the film to stretch. As a result, for the desired movable separation film in the plastic region, the displacement of the film becomes greater to the extent that part of the bubbling power is not allowed to be transformed into the energy that causes the film to stretch as compared with the case where the same power is applied to the other movable separation film in the elastic region. Therefore, the discharge liquid droplets are made larger dots. In other words, with respect to the desired movable separation film, it is possible to change the discharging droplet into a larger one with the application of the same bubbling power applied to the smaller one in accordance with the present invention. Here, with the additional process of the distortion of the present invention, there is no need for adjusting the bubbling power when it is desired to shoot larger dots and smaller dots locally from the multiple nozzle head or it is desired to adjust the amount of discharging liquid droplets largely in order to discharge them in a specific amount without fluctuation. Since a head of the kind can discharge larger dots without increasing the bubbling power, the dissipation power can be reduced, hence leading to making the life of the head significantly longer.

Also, the present invention includes the inventions based upon the new recognition of the subjects as to the organic film used as the material for the aforesaid separation film, which will be readily understandable from the description of the embodiments to follow.

In this respect, the terms "upstream" and "downstream" referred to in the description of the invention hereof are related to the flow direction of the liquid toward the discharge ports from the supply source of the liquid through the bubble generating areas (or movable members) or meant to indicate the directions related to the structure thereof.

DETAILED DESCRIPTION OF THE PREFERRED EMBODIMENTS

Now, with reference to the accompanying drawings, the description will be made of the embodiments in accordance with the present invention.

(First Embodiment)

Figure 1:
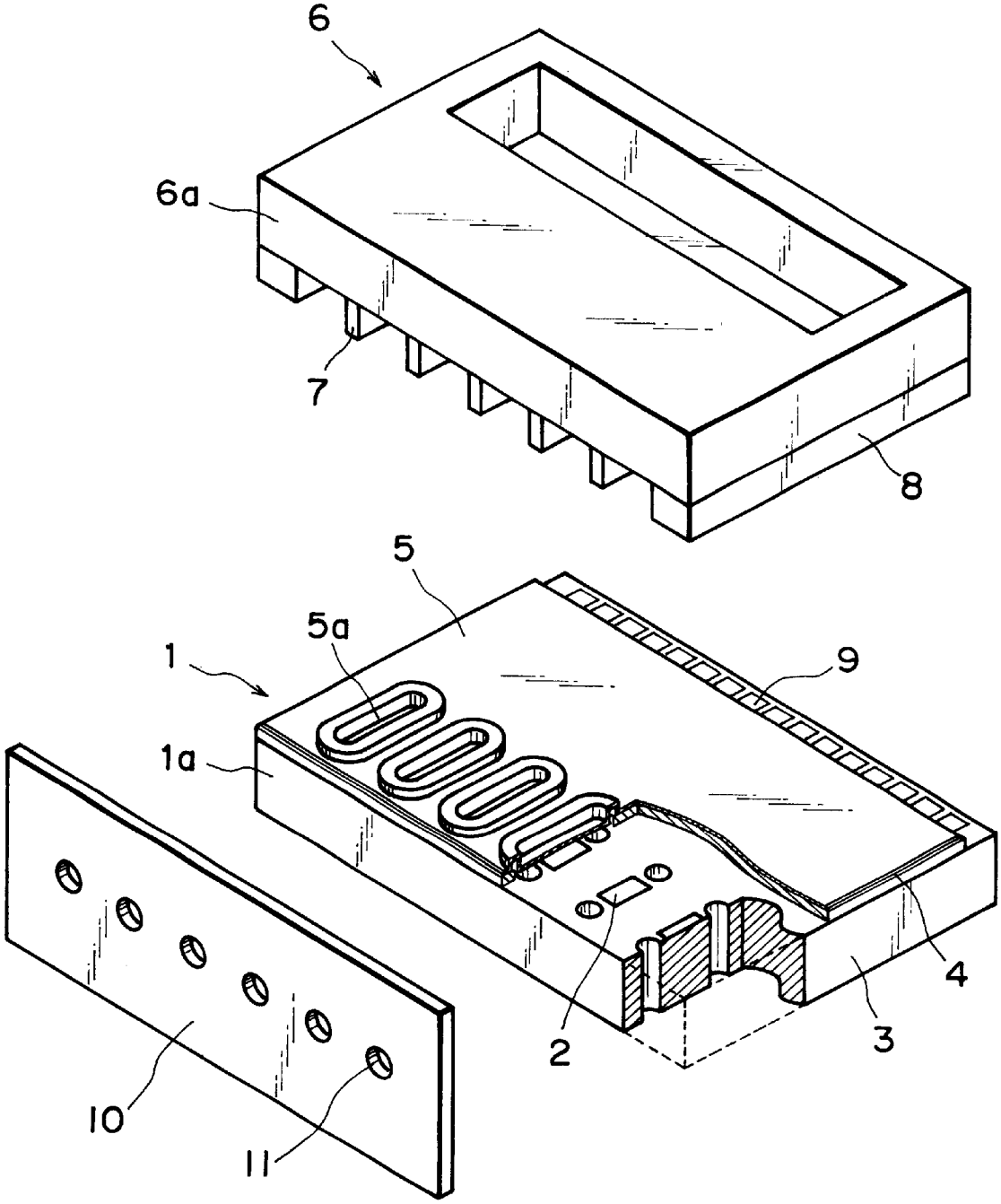
FIG. 1 is an exploded perspective view which shows the liquid jet head in accordance with a first embodiment of the present invention.

FIG. 1 is an exploded perspective view which shows the liquid jet head in accordance with a first embodiment of the present invention. Also, FIG. 2 is a cross-sectional view which shows the liquid jet head represented in FIG. 1, taken in the direction of the liquid flow path thereof, and FIG. 3 is a cross-sectional view which shows the liquid jet head represented in FIG. 1, taken in the arrangement direction of the heat generating elements.

Figure 2:
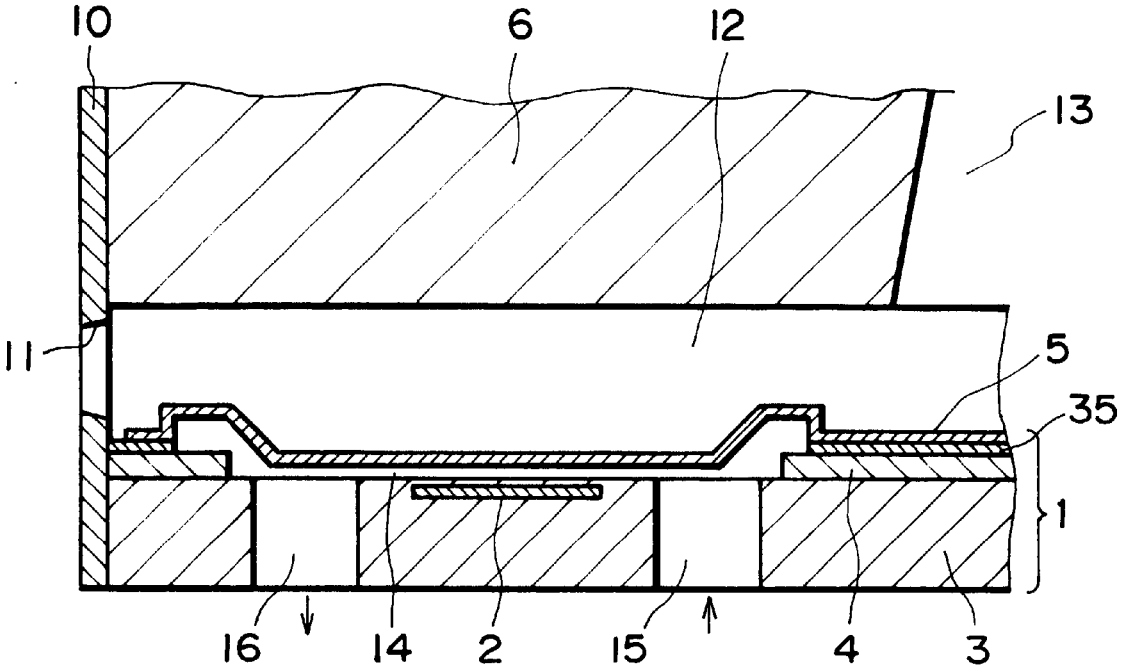
FIG. 2 is a cross-sectional view which shows the liquid jet head represented in FIG. 1, taken in the direction the liquid flow path thereof.
Figure 3:
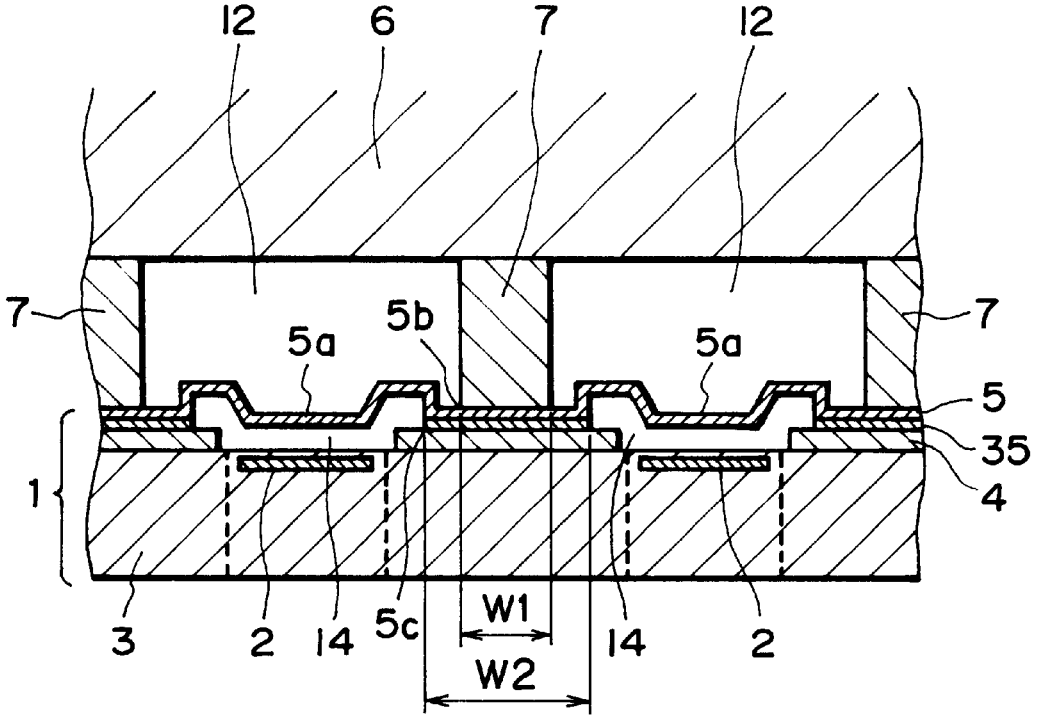
FIG. 3 is a cross-sectional view which shows the liquid jet head represented in FIG. 1, taken in the arrangement direction of the heat generating elements.

As shown in FIG. 1 to FIG. 3, the liquid jet head of the present embodiment comprises the substrate 1 for use of a liquid jet head having a plurality of heat generating elements 2 arranged in parallel, each giving energy to create bubbles in liquid, respectively; the ceiling plate 6 which is integrally formed with liquid flow paths and bonded to the substrate 1 for use of a liquid jet head; and the orifice plate 10 which is bonded to cover the front end la of the substrate 1 for use of a liquid jet head and the front end 6a of the ceiling plate 6.

The substrate 1 for use of a liquid jet head is provided with the elastically movable separation film 5 which is bonded with bonding agent 35 to the pedestal 4 on the elemental substrate 3 having the heat generating elements 2 formed thereon. The portion of the movable separation film 5 which faces each of the heat generating elements 2 is arranged to a movable section 5*a* which is supported with a gap to the elemental substrate 3 without contacting the pedestal 4. Then, a plurality of second liquid flow paths 14 are structured with the elemental substrate 3, the pedestal 4, and the movable separation film 5 corresponding to each of the heat generating elements 2 to which bubbling liquid is supplied, respectively. For the elemental substrate 3, the supply port 15 to supply bubbling liquid to the second liquid flow paths 14, and the exhaust port 16 to exhaust from the second liquid flow paths 14 the bubbling liquid which has been supplied to the second liquid flow paths 14.

Also, for the elemental substrate 3, the wiring (not shown) which is connected with each of the heat generating elements 2 is formed together with the external contact pads 9 which become the input terminals of the electric signals from the outside. By the application of voltage to each of the desired heat generating elements 2 through the external contact pads 9, each of the heat generating elements 2 can be driven individually.

The ceiling plate 6 is provided to form a plurality of first liquid flow paths 12 corresponding to each of the heat generating elements 2 to which discharge liquid is supplied, respectively, and a common liquid chamber 13. Then, the ceiling plate is integrally formed with the flow path walls 7 that partition each of the first liquid flow paths 12, and also, with the liquid chamber frame 8 that constitutes the common liquid chamber 13 that provisionally retains the discharge liquid to be supplied to each of the first liquid flow paths 12.

For the orifice plate 10, a plurality of discharge ports 11 are formed to be communicated with each of the first liquid flow paths 12.

The first liquid flow paths 12 and the second liquid flow paths 14 are completely separated by means of the movable separation film 5. Then, the discharge liquid in each of the first liquid flow paths 12 and the bubbling liquid in each of the second flow paths 14 are supplied, respectively, by way of different supply paths.

The discharge liquid is supplied to the common liquid chamber 13 from the ink tank or the like which will be described later, and discharged from the discharge ports 11 through each of the first liquid flow paths 12. The bubbling liquid is supplied to the second liquid flow paths 14 through the supply port 15 to fill each second liquid flow path 14 with it, and exhausted from the exhaust port 16 following the creation of each bubble when each of the heat generating elements 2 is driven. For the present embodiment, the supply port 15 is arranged on the upstream side of the heat generating element 2 in the flow direction of the discharge liquid in the first liquid flow path 12 described above. The exhaust port 16 is arranged on the downstream side of the heat generating element 2. Therefore, as indicated by arrows in FIG. 2, the bubbling liquid flows in the same direction as the flow direction of the discharge liquid in the first liquid flow path 12. Thus, the bubbling liquid is allowed to move or circulate by the liquid moving passage (not shown).

Here, with reference to FIG. 2 and FIG. 3, the detailed description will be made of the configuration of the movable separation film 5.

The movable separation film 5 is bonded to the upper surface of the pedestal 4. The pedestal 4 is configured with a scooped area that becomes each of the second liquid flow paths 14. Then, the movable separation film 5 is formed to be convex on such area toward each of the heat generating elements 2. This convex portion becomes each of the movable portions 5*a*. More precisely, the movable separation film 5 rises once from the upper surface of the pedestal 4 toward the first liquid flow path 12 side, and then, it is bent to be inverted toward the elemental substrate 3 side. In this manner, the convex movable portion 5a is formed toward each of the heat generating elements 2. In other words, the circumference of the movable portion 5*a* of the movable separation film 5 is made convex toward the first liquid flow path 12 side. The movable portion 5*a* faces the heat generating element 2, and the area between the movable portion 5*a* and the heat generating element 2 in the second liquid flow path 14 is called a "bubble generating area".

The movable separation film 5 is bonded to the upper surface of the pedestal 4. The pedestal 4 is configured with a scooped area that becomes each of the second liquid flow paths 14. Then, the portion that covers this area becomes the movable portion 5*a*. More precisely, the configuration of the movable portion 5*a* is such that the movable separation film 5 rises once from the edge of the fixed portion to the pedestal 4 toward the first liquid flow path 12 side, and then, it is bent to be inverted toward the elemental substrate 3 side. In this manner, the area that faces the heat generating element 2 becomes convex toward the heat generating element 2. Then, the circumference thereof, that is, the area between the fixed portion to the pedestal 4 and the portion that faces the heat generating element 2 becomes convex to the first liquid flow path 12 side. The area of the second liquid flow path 14 between the heat generating element 2 and the portion of the movable separation film 5 that faces the heat generating element 2 is called the "bubble generating area".

Now, a method for manufacturing a liquid jet head will be described in accordance with the present embodiment.

At first, in conjunction with FIGS. 4*a* to 4*c*, the description will be made of the method for manufacturing the ceiling plate 6.

Figure 4A:
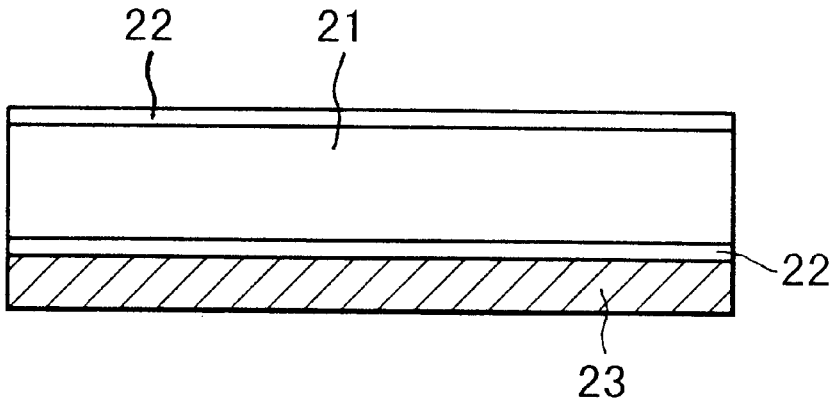
FIGS. 4*a*, 4*b* and 4*c* are views which illustrate the manufacturing process of the ceiling plate that constitutes the liquid jet head in accordance with the first embodiment of the present invention.

As shown in FIG. 4*a*, the $SiO_2$ film 22 is formed by thermal oxidation on both faces of the silicon wafer (Si substrate) 21, at first, in a thickness of approximately 1 $\mu$m. Then, the portion that becomes the common liquid chamber described earlier is patterned by use of the known method, such as photolithography. After that, on such portion, the SiN film 23 that becomes the flow path walls is formed by the microwave CVD method (hereinafter referred to as the "$\mu$W-CVD method) in a thickness of approximately 30 $\mu$m. Here, the gas used for the $\mu$W-CVD method to form the SiN film 23 is the mixed gas of monosilane ($SiH_4$), nitrogen ($N_2$), and argon (Ar). In this respect, it may be possible to combine disilane ($Si_2H_6$), ammonia ($NH_3$), or the like as the gas component besides the one mentioned above.

In accordance with the present embodiment, the SiN film 23 is formed by the microwave (2.45 GHz) powered at 1.5 [Kw] with the supply of gas at the flow rate of $SiH_4/N_2/Ar$=100/100/40[sccm] under the high vacuum of 5[mTorr]. Here, it may be possible to form the SiN film 23 at the component ratio other than the one mentioned above or by the CVD method that uses RF supply-source or the like.

Figure 4B:
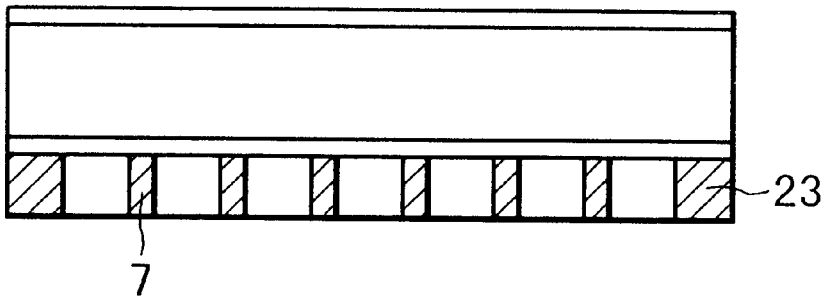

Then, as shown in FIG. 4*b*, the portion of the SiN film 23 that becomes the flow path walls 7 and the portion thereof that becomes the common liquid chamber are patterned by use of the known method, such as lithography, and etched into the trench structure using the etching apparatus that uses the dielectric coupling plasma.

Figure 4C:
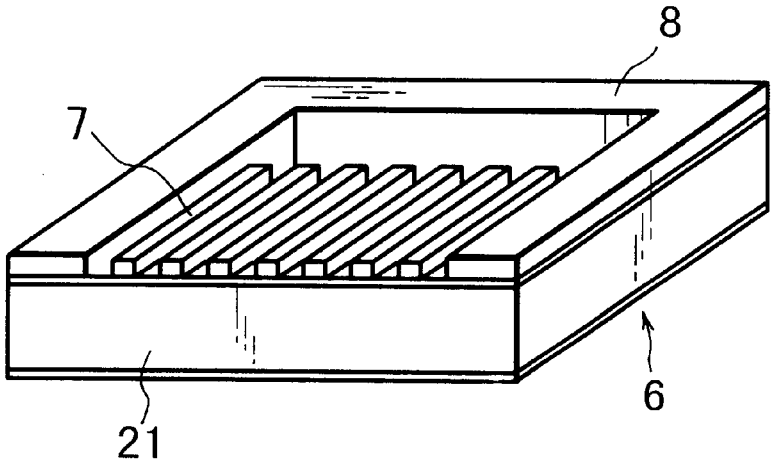
Figure 5A:
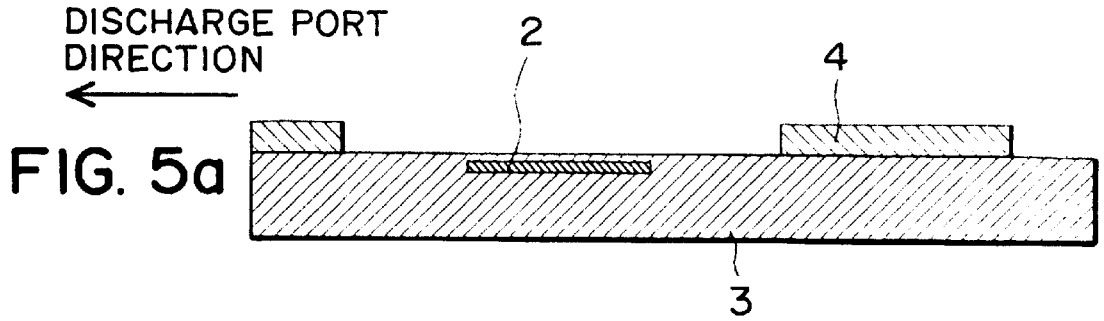
FIGS. 5*a*, 5*b*, 5*c*, 5*d* and 5*e* are cross-sectional views which illustrate the manufacturing process of the substrate for use of the liquid jet head that constitutes the liquid jet head in accordance with the first embodiment of the present invention, taken in the direction of the liquid flow paths.
Figure 5B:
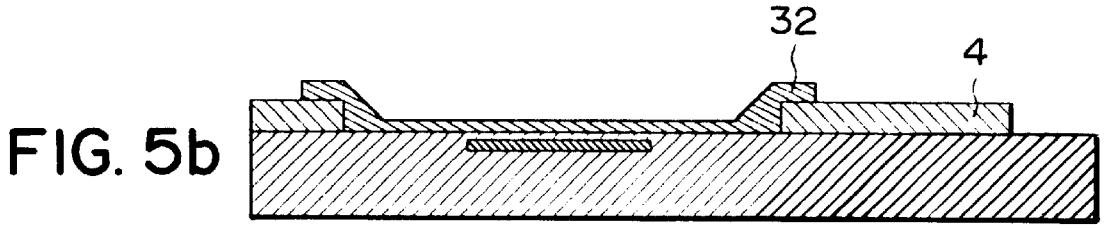
Figure 5C:
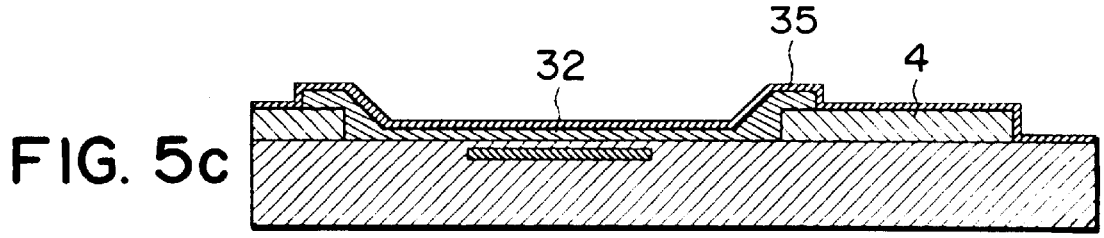
Figure 5D:
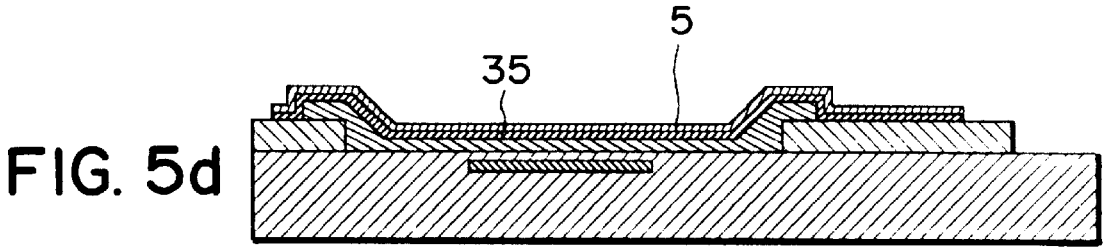
Figure 5E:
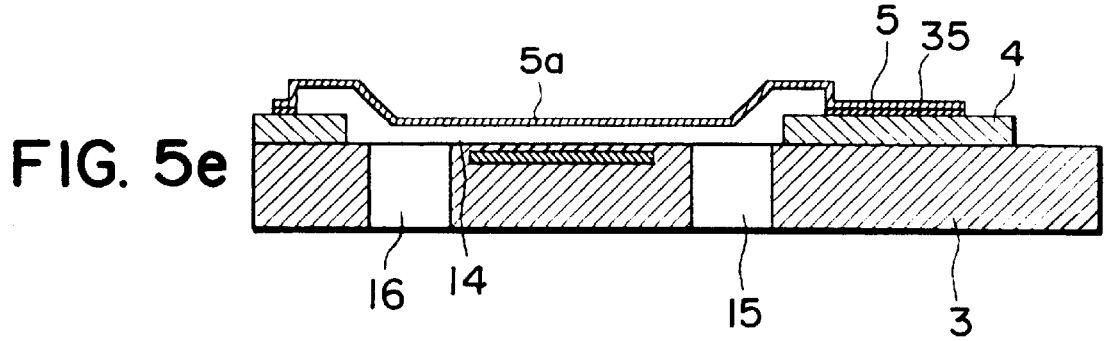
Figure 6A:
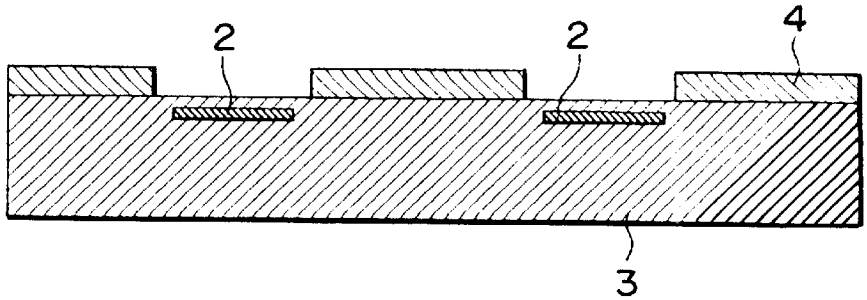
FIGS. 6*a*, 6*b*, 6*c*, 6*d* and 6*e* are cross-sectional views which illustrate the manufacturing process of the substrate for use of the liquid jet head that constitutes the liquid jet head in accordance with the first embodiment of the present invention, taken in the arrangement direction of the heat generating elements.
Figure 6B:
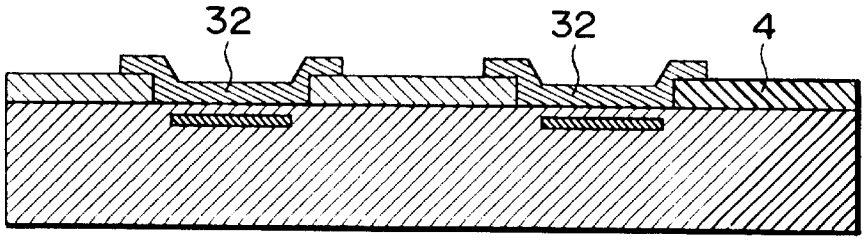
Figure 6C:
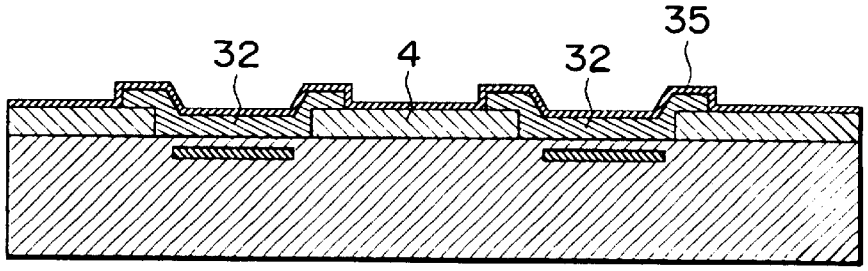
Figure 6D:
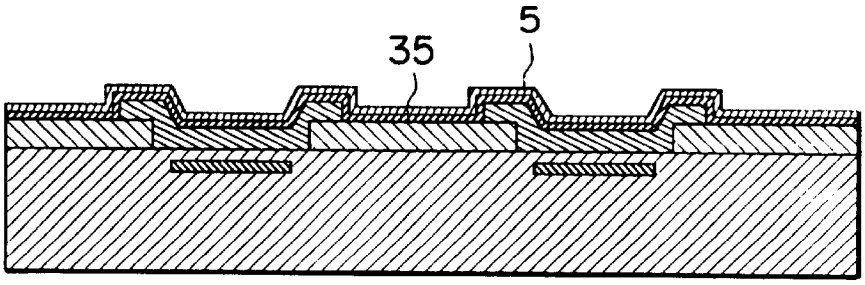
Figure 6E:
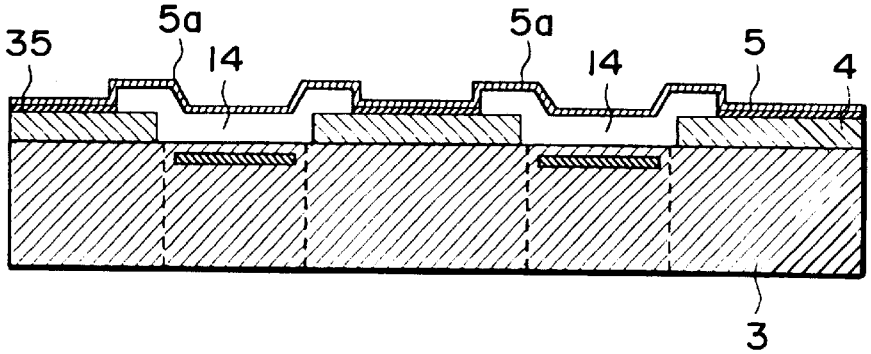

After that, as shown in FIG. 4*c*, using tetra-methyl-ammonium-hydroxide (hereinafter referred to as TMAH) the portion of the silicon wafer 21 that becomes the aperture of the common liquid chamber is etched through the silicon wafer, thus manufacturing the ceiling plate 6 integrally formed with the flow path walls 7 and the liquid chamber frame 8.

Now, in conjunction with FIGS. 5*a* to 5*e* and FIGS. 6*a* to 6*e*, the description will be made of the method for manufacturing the substrate for use of a liquid jet hen ad which is formed integrally with the movable separation film. Here, the processes a to e referred to in the following description correspond to these represented in FIGS. 5*a* to 5*e* and FIGS. 6*a* to 6*e*, respectively.

(Process a)

On the entire upper surface of the elemental substrate 3 where the heat generating elements 2 and the external contact pads 9 (see FIG. 1) are formed among some others, the TiW film is formed by the sputtering method in a film thickness of approximately 5000 Å as the protection layer that protects the external contact pads 9. Then, on the TiW film, the SiN film is formed by the plasma CVD method in a thickness of approximately 10 μm, and the portion of the SiN film that becomes the second liquid flow paths, and the portions other than the area having the external contact pads 9 formed are patterned by the known method, such as photolithography, to form the pedestals 4. In this respect, the elemental substrate 3 is formed by silicon, and each of the heat generating elements 2 is formed on silicon using the semiconductor manufacturing process.

The film thickness of the SiN film is the factor whereby to determine the height of each second liquid flow path. Therefore, in terms of the balance of the entire flow paths corresponding to the liquid supply configuration to the second liquid flow paths, it is preferable to define the thickness to be valued so as to maximize the effect of the movable portion. Here, SiN is generally used for the semiconductor process, while it has excellent resistance to alkali, and excellent chemical stability as well.

(Process b)

On the upper surface of the elemental substrate 3 where the pedestal 4 is formed, Al film is formed by the sputtering method in a thickness of approximately 5 μm. Then, each of the sacrifice layers 32 is formed by patterning the portions other than the one that becomes the second liquid flow paths and the circumference thereof by use of the known method, such as photolithography. Thus, each sacrifice layer 32 is configured to be convex with the circumference thereof being in a state that it runs on to the pedestal 4.

(Process c)

On the upper surface of each of the pedestals 4 and the sacrifice layers 32, silane coupling agent is coated in a laminar form to be the bonding agent 35.

(Process d)

On the upper surface of the bonding agent 35, the polyparaxylene film which becomes the movable separation film 5 is formed by the CVD method in a film thickness of approximately 2 μm. The fundamental structure, method of manufacture, and method of polymerization of the polyparaxylene to be used for the present invention are disclosed in the specification of U.S. Pat. No. 3,379,803, Japanese Patent Publication 44-21353, and Japanese Patent Publication 52-37479 among some others.

The film thus obtained is excellent in heat resistance, and also, it presents excellent resistance to various organic solutions, and chemical resistance as well to acid, alkali, or the like. It also has an excellent stretching followability. Further, the vapor phase polymerization is adopted for the formation of this film to make it possible to effectuate the conformal coating even on the minutely shaped portions, and the complicatedly shaped portions as well.

(Process e)

After the $SiO_2$ film is formed on the reverse side of the elemental substrate 3 by the thermal oxidation in a film thickness of approximately 1 μm, the aperture portions of the supply port 15 and exhaust port 16 are patterned by use of the known method, such as photolithography. Then, on the reverse side of the elemental substrate 3, the circular column-shaped supply port 15 and exhaust port 16 of 10 to 50 μm diameter are formed by means of the trench structured etching using the dielectric coupling plasma etching apparatus. In this case, the sacrifice layer 32 functions as the etching stop layer. Therefore, the movable separation film 5 is not etched.

Subsequently, the sacrifice layers 32 are removed by use of a mixed solution of phosphoric acid, acetic acid, and hydrochloric acid. Further, the bonding agent 35 is removed to form the second liquid flow paths 14. When the bonding agent 35 is removed, the pedestals 4 function as the mask for the solution, and the solution acts upon the portions where the bonding agent 35 is exposed when the sacrifice layers 32 are removed. As a result, the solution is not allowed to act upon the region between each pedestal 4 and the movable separation film 5. Thus, the bonding agent 35 remains intact only on the region which becomes the fixing portion for the movable separation film 5 and each pedestal 4. The region of the movable separation film 5 which is in contact with the movable portion 5*a* is removed assuredly. In other words, the area of the bonding agent 35 which is in contact with the movable portion 5*a* of the movable separation film 5 is patterned in this process.

Therefore, only the portion of the movable separation film 5 that becomes the fixing portion is fixed to each pedestal 4 by use of the bonding agent 35, and there is no possibility that the bonding agent 35 remains on the movable portion 5*a*. Also, since the movable separation film 5 is fixed to the pedestals 4 through the bonding agent 35, the fixing force of the movable separation film 5 becomes stronger than the case where the movable separation film 5 is directly fixed to the pedestals 4. Thus, the fixing portion of the movable separation film 5 is fixed to the pedestals 4 assuredly, and the resultant operation of the movable portion 5*a*, which will be described later, becomes stable to stabilize the discharge characteristics accordingly.

When the movable separation film 5 that constitutes the second liquid flow paths 14 is fixed by use of the bonding agent, the operation of the movable separation film 5 becomes instable as described later if the bonding agent leaks or defective bonding takes place. Particularly, if the bonding agent remains irregularly, the movable range of the movable separation film 5 becomes irregular, and the resultant discharge characteristics, such as discharge amount, are caused to vary inevitably. Therefore, as in the present invention, it is arranged to remove the bonding agent 35 from the reverse side (the second flow path side) of the movable separation film 5 after the movable separation film 5 has been formed on the bonding agent 35. Thus, the pattering is effectuated after the portions unwanted for bonding the movable separation film 5 are removed. As a result, it becomes possible to secure the movable range of the movable separation film 5 in high precision. In this way, the irregularity of the discharge characteristics is made smaller. Particularly when the silane coupling agent is used as the bonding agent, the durability of the bonded portions is enhanced still more.

Here, there are some cases where the bonding agent residing on the edge of the bonding area of the movable separation film 5 with the pedestals is slightly removed, but such removal, if any, may be at the level of the thickness of the coated bonding agent (5000 Å approximately). Therefore, there is no influence that may be exerted on the width of the bonding region in practice.

In this respect, with the plural through holes of the supply port 15 and exhaust port 16 provided for the elemental substrate 3 as the liquid moving passages for the second liquid flow paths 14, it becomes possible to promote the removal of the sacrifice layers 32 and the bonding agent 35.

Now, as has been described above, in accordance with the method for manufacturing the substrate 1 for use of the liquid jet head integrally formed with the movable separation film 5, there is no possibility to handle individually the movable separation film 5 formed in a thickness of as extremely thin as approximately 2 μm. As a result, it becomes possible to avoid the use of any complicated device to install film or avoid a danger that the film may be damaged when it is installed on the installation device.

Further, with the movable separation film 5 which is arranged integrally with the elemental substrate 3 provided with the heat generating elements 2, it becomes possible to minimize the irregularity of the discharge characteristics by the production lots or the like, because the movable portions 5*a* can be positioned exactly with respect to each of the heat generating elements 2. Also, with the utilization of the semi-conductor manufacturing process for the formation of the second liquid flow paths 14, it becomes possible to narrow the flow path pitches up to approximately 10 to 20 μm for the easier materialization of nozzle in higher density.

Now, the description will be made of the bonding of the ceiling plate 6 and the substrate 1 for use of a liquid jet head.

For the present embodiment, the ceiling plate 6 and the substrate 1 are closely in contact with each other by use of a spring (not shown) which presses only the ceiling plate 6 or pinches both of them under pressure. In this case, each of the side walls that form the first liquid flow paths is closely in contact with the movable separation film 5 which is an organic resin film of polyparaxylene arranged on the upper part of the side walls of the corresponding second liquid flow paths. Therefore, the sealing capability is enhanced for the first liquid flow paths adjacent to each other. In the case of the present embodiment, as shown in the cross-sectional view of FIG. 3, the width W2 of the contact area of the separation film provided by the bonding agent 35 for the pedestals 4 that form the second liquid flow paths is larger than the width W1 of the contact area with the organic separation film 5 of the flow path walls 7 that form the first liquid flow path of the ceiling plate 1. Therefore, the positions of the edge portion 5*b* of the contact area with the flow path wall 7 of the organic separation film and the portion (the edge portion of the contact area) 5*c* which becomes the fixing end of the movable portion 5*a* of the separation film are deviated to make it possible to provide the movable separation film which is excellent in the durability thereof. As the material for the organic movable separation film, it is particularly preferable to use polyparaxylene from the viewpoint of its durability.

The cold bonding apparatus used here comprises two vacuum chambers, that is, each one of the preparatory chamber and the pressurized contact chamber, and the applied vacuum is 1 to 10 [Pa]. Then, in the preparatory chamber, the substrate 1 for use of a liquid jet head and the ceiling plate 6 are set by use of image processing in a state where the alignment positions are matched for positioning the portions to be bonded. After that, while such state is kept, the substrate and ceiling plate are transferred to the pressurized contact chamber where energy particles are irradiated on the bonding surface of the SiN film by the application of high speed beams of saddle filed type. Subsequent to having the surface activated by this irradiation, the substrate 1 for use of a liquid jet head and the ceiling plate 6 are bonded. At this juncture, heat may be given at a temperature of 200° or less or pressure may be given in order to increase strength in some cases.

In this respect, the area where polyparaxylene is removed may be only the area where it is in contact with the ceiling plate 6 if the arrangement density of nozzle array is lower. However, if the arrangement of the nozzle array should be in higher density, it is desirable to remove this material from the area where the ceiling plate 6 is bonded with a slight room of approximately 5 to 10 μm from the viewpoint of the precision required at the time of the ceiling plate 6 being closely in closely with the substrate (or bonded therewith).

In this respect, as the bonding method, it may be possible to adopt the one where a thin film (3000 Å) of water glass (sodium silicate) is coated on the bonding portion of the substrate 1 for use of a liquid jet head, and after patterning, it is heated to a temperature of approximately 100° to bond it with the ceiling plate 6 or it may be possible to bond them by heating under pressure after bonding agent is coated by use of transfer method either on the substrate 1 for use of a liquid jet head or on the ceiling plate 6.

Then, after the substrate 1 for use of a liquid jet head and the ceiling plate 6 are closely in contact or bonded, the orifice plate 10 is bonded to complete the liquid jet head.

The orifice plate 10 is also formed with silicon material. For example, the silicon substrate that forms the discharge ports 11 is cut to a thickness of approximately 10 to 150 μm to provide the orifice plate. Here, the orifice plate 10 is not necessarily required for the structure of the present invention. In place of the orifice plate 10, it may be possible to provide the ceiling plate with discharge ports by keeping a wall to remain in a thickness equivalent to the thickness of the orifice plate 10 on the leading end of the ceiling plate 6 when the flow path walls 7 are formed for the ceiling plate 6, and then, discharge ports 11 are formed on this particular portion.

Now, in conjunction with FIGS. 7*a* to 7*e*, the description will be made of the liquid discharges from the liquid jet head of the present embodiment. FIGS. 7*a* to 7*e* are cross-sectional views taken in the flow path direction, which schematically illustrate in time-series the states of liquid discharge of the liquid jet head shown in FIG. 1 to FIG. 3. Here, in FIGS. 7*a* to 7*e*, the bonding agent 35 (see FIG. 2 and the like), which is needed to fix the movable separation film 5 to the pedestals 4, is omitted.

In FIGS. 7*a* to 7*e*, the discharge liquid which is supplied form the common liquid chamber 13 is filled in the first liquid flow paths 12 directly communicated with the discharge ports 11. Also, in the second liquid flow paths 14 provided with the bubble generating areas are filled with the bubbling liquid which bubbles when thermal energy is applied by means of the heat generating elements 2.

Figure 7A:
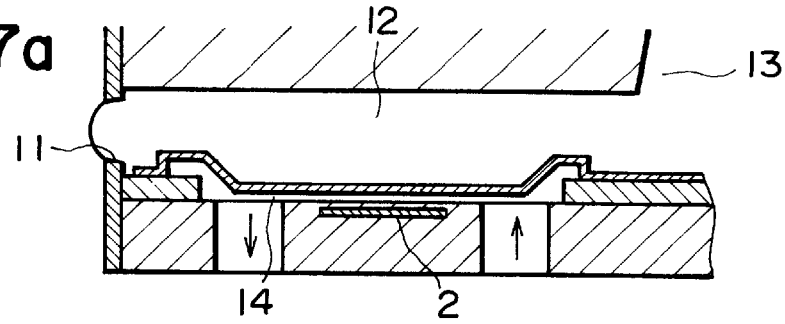
FIGS. 7*a*, 7*b*, 7*c*, 7*d* and 7*e* are cross-sectional views which schematically illustrate time serially the states of a liquid discharge of the liquid jet head in accordance with the first embodiment of the present invention, taken in the direction of the flow paths.

At the initial stage shown in FIG. 7*a* , the discharge liquid in each of the first liquid flow path 12 is withdrawn up to the vicinity of the discharge port 11 by means of the capillary force. Here, in accordance with the present embodiment, the discharge port 11 is positioned on the downstream side in the liquid flow direction in the first liquid flow path 12 with respect to the projection area of the heat generating element 2 to the first liquid flow path 12. Also, the bubbling liquid moves in the second flow path 14 as described earlier by the flow in the direction indicated by an arrow.

Figure 7B:
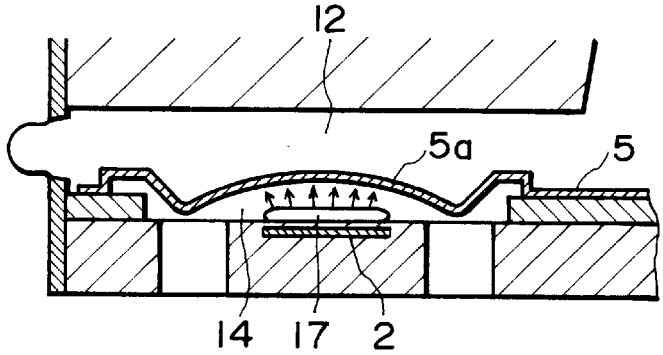

In this state, when thermal energy is applied to the heat generating element 2, the heat generating element 2 is rapidly heated. Then, the surface of the bubble generating area, which is in contact with the bubbling liquid, is caused to heat and bubble the bubbling liquid (FIG. 7*b*). The bubble 17 created by means of this heating and bubbling is the bubble which is based upon the film boiling phenomenon such as disclosed in the specification of U.S. Pat. No. 4,723,129, and created at a time on the entire surface of the heat generating element 2, which is accompanied by extremely high pressure. The pressure thus generated at that time becomes the pressure waves to propagate the bubbling liquid in the second flow path 14 to activate the movable separation film 5. Then, the movable portion 5*a* of the movable separation film 5 is displaced to initiate discharging the discharge liquid in the first liquid flow path 12.

Figure 7C:
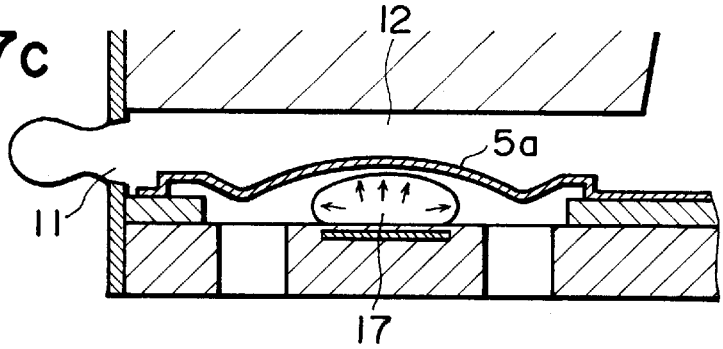
Figure 7D:
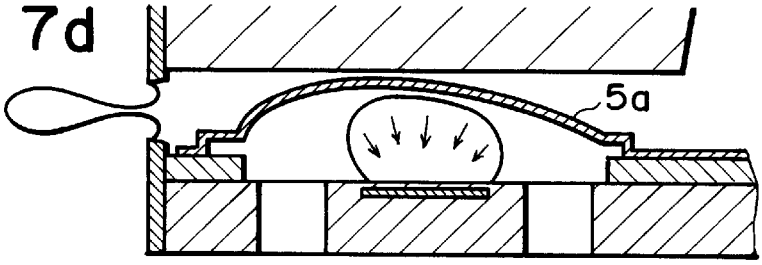
Figure 7E:
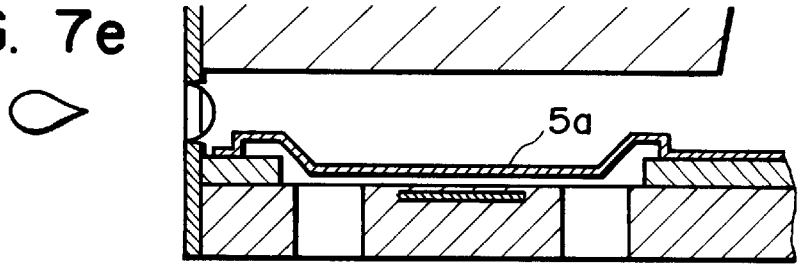

When the bubble 17 created on the entire surface of the heat generating element 2 is rapidly developed, it presents the film-like state (FIG. 7*c*). The expansion of the bubble 17 by the extremely high pressure at the earlier stage of its creation causes the movable portion 5*a* to be further displaced. Then, the discharge of the discharge liquid in the first liquid flow path 12 form the discharge port 11 is promoted. After that, when the bubble 17 is further developed, the displacement of the movable portion 5*a* becomes greater (FIG. 7*d*). Then, subsequent to the defoaming of the bubble, the movable portion 5*a* is displaced by its own restoring force and returns to the initial state shown in FIG. 7*a* (FIG. 7*e*).

For the liquid jet head of the present embodiment, the movable separation film 5 is supported on the elemental substrate 3 by means of the pedestals 4, and the movable portion 5*a* thereof becomes convex to the second liquid flow path 14 side and faces the heat generating element 2. In this way, it is possible to arrange the movable portion 5*a* closely to the heat generating element 2. The pressure exerted by the creation of the bubble 17 is then allowed to act upon the movable portion 5*a* effectively. Therefore, even if the pressure that follows the creation of the bubble 17 is propagated to the discharge liquid through the movable separation film 5, it is possible to discharge the discharge liquid with high discharging efficiency.

Also, since the movable portion 5*a* extrudes in advance to the second liquid flow path 14 side, the amount of displacement of the movable portion 5*a* becomes greater, which guides the pressure propagating direction of the bubble 17 by the pressure exerted by the creation of the bubble 17. This also contributes largely to enhancing the discharge efficiency of the discharge liquid.

Further, the circumference of the movable portion 5*a* of the movable separation film 5 is configured to be convex to the first liquid flow path 12 side. Then, there are at least two bending sections in the area of the movable separation film 5 between its bonding portion with each pedestal 4 and the region that it faces the heat generating element 2. Therefore, when the movable portion 5*a* of the movable separation film 5 displaces, it becomes possible to reduce the force exerted on the bonding section with the pedestals 4 or to eliminate it to enhance the durability of the bonding section. As a result, in addition to the condition that the movable separation film 5 is fixed to the pedestals 4 through the bonding agent 35 as described above, it becomes possible to enhance the assembling precision at the time of manufacture, and at the same time, it is possible to reliably function each movable portion 5*a* and fixing portion of the movable separation film 5 as the movable section and fixing section, respectively, hence obtaining highly precise output images stably.

In addition, since the ceiling plate 6 of the present embodiment is formed with the material that contains silicon atom. Therefore, as compared with the ceiling plate produced by use of resin or the like, the heat radiation of the head is enhanced. Also, the flow path walls 7 that constitute the first liquid flow paths 12 are formed with SiN, hence increasing resistance to ink.

Also, in accordance with the present embodiment, the movable portion 5*a* is displaced by a specific amount with the provision of a desired bubbly power for the movable portion 5*a* of the separation film 5. Then, the liquid droplet is discharge from each of the discharge ports 11 in a specific amount. When it is desired to make discharge droplets larger locally in the multiple nozzle arrangement, it should be good enough if only the bubble power in each of the particular nozzles is made greater so as to displace (move, expand, or elongate) the corresponding movable portion 5*a* greater. Further, if the size (amount) of each discharge droplet should vary with the same bubbling power, it is good enough to adjust the bubbling power as to each of the movable portions 5*a*. In this case, fine adjustments are needed with respect to each of the movable portions 5*a* of the separation film. Here, therefore, the inventors hereof further propose to distort desired movable portions 5*a* (may be referred to as movable separation film, too) of the separation film once after the completion of the head mode in the processes shown in FIGS. 5*a* to 5*e* and FIGS. 6*a* to 6*e*, that is, a process is added to provide a permanent distortion (plastic distortion), in order to provide a liquid jet head capable of discharging larger and smaller dots locally without any adjustment of bubbling power in the multiple nozzle arrangement or capable of discharging specific amount of liquid droplets without any fluctuations.

Figure 8:
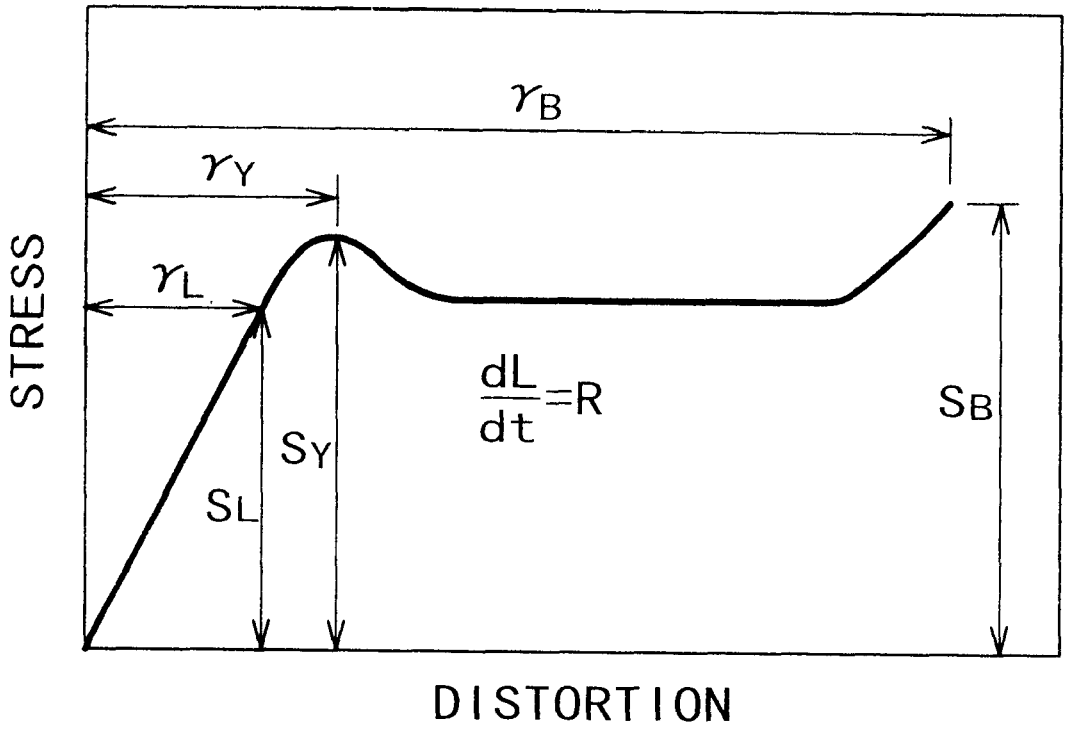
FIG. 8 is a view which shows the generally observed curve of the stress and distortion.

FIG. 8 shows the shape of the stress and distortion curve generally and actually observed often for the polymeric material which is not stretched. The experimented curve is obtainable as a function that expresses its stretching, that is, the change of lengths thereof, provided that the force F applied to the sample is defined as the function of time or the degree of stretch is proportional to time. This force F is transformed to the stress S, and the stretch, the distortion $\gamma$, and then, the former is plotted against the latter, hence obtaining the stress-distortion curve. In FIG. 8, the stress-distortion curve is straight up to the $\gamma L$, and the stress S increases in proportion to the $\gamma$. The point where the distortion arrives at the point $\gamma L$ is the elastic limit, and beyond this point, the stress is caused to deviate from the straight line, and arrive at the yielding point at $\gamma Y$ where the stress becomes the maximum value.

For the head of the present invention, it is preferable to give stress to a desired movable separation film in order to provide the permanent distortion therefor so that the amount of the distortion of the film becomes larger than the amount of distortion at the elastic limit or more preferably, the amount of distortion becomes greater than the one at the yielding point. The stress should of course be exerted within a range where the film is not broken. For example, the preliminary discharges are performed under the following condition as the aging process to give distortion to the movable separation film:

Driving frequency: 10,000 Hz

Driving voltage: 23 V

The number of discharged nozzles: all

The pulse number: 6E6

The method for distorting the movable separation film is not necessarily limited to the aforesaid one. Any method should be applicable if only the method can distort the film appropriately. For example, a method may be arranged so that liquid is circulated in the bubbling liquid flow path, while the outlet of the liquid is closed, and that the liquid is forced to be carried from the inlet thereof to increase the inner pressure in the bubble liquid flow path.

FIGS. 9*a* to 9*d* are cross-sectional views which illustrate one example of the process in which distortion is given to the movable portion 5*a* of the separation film 5.

Figure 9A:
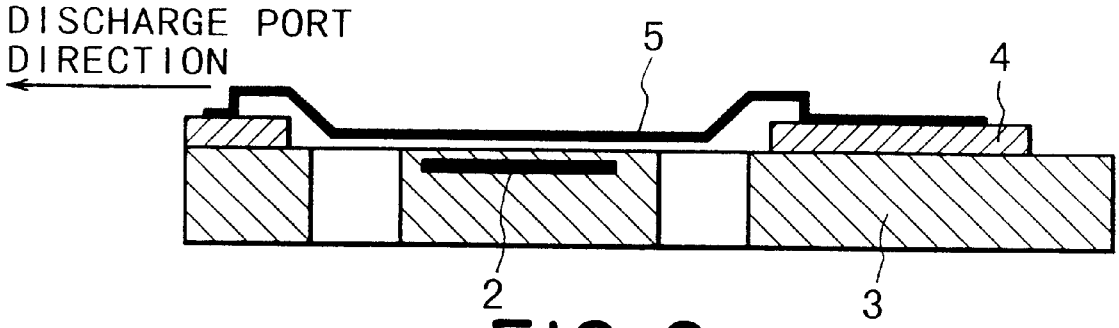
FIGS. 9*a*, 9*b*, 9*c* and 9*d* are cross-sectional views which illustrate the process of the distortion treatment of the separation film additionally applicable to the manufacture of the substrate for use of a liquid jet head that constitutes the liquid jet head in accordance with the first embodiment of the present invention, taken in the direction of the liquid flow paths.
Figure 9B:
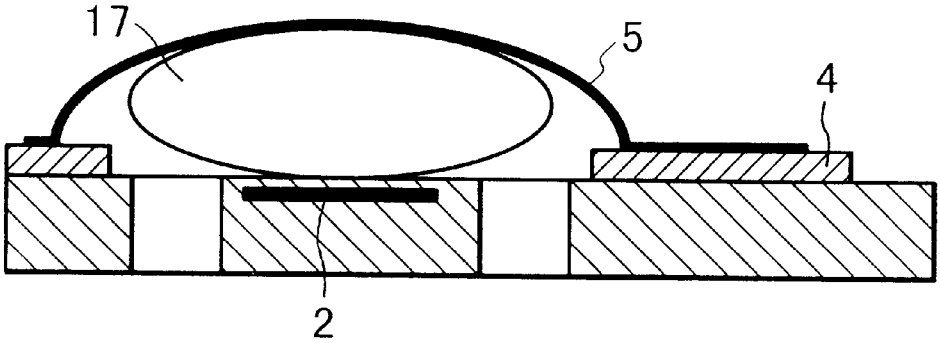
Figure 9C:
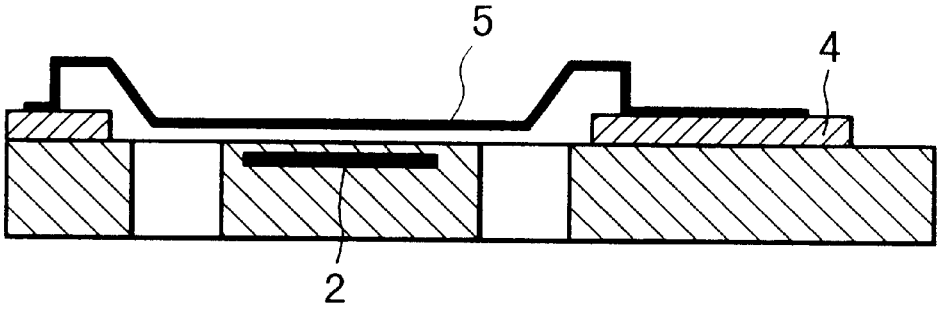
Figure 9D:
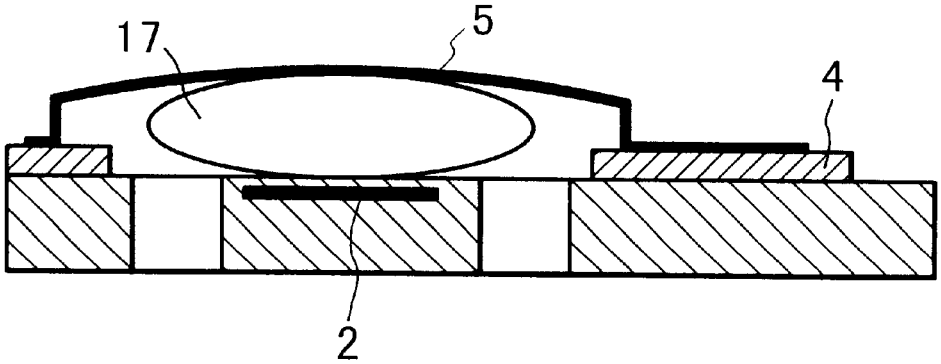

FIG. 9*a* shows the state of the movable separation film after the completion of the head mode in accordance with the processes represented in FIGS. 5*a* to 5*e* and FIGS. 6*a* to 6*e*. Against the movable portion 5*a* of this separation film 5, bubbling is performed at a k value (1.3) which is higher than the usual k value (1.2). Then, the bubbling power which is higher than the usual one is generated to give stress to the movable portion 5*a* of the separation film 5 (see FIG. 9*b*). For the control of a desired stress value, it is desirable to provide this stress by means of the development of the bubble 17 that utilizes the nuclear boiling. In this manner, the movable portion 5*a* of the separation film 5 is distorted to arrive at the plastic region. Then, as shown in FIG. 9*c*, it presents the state where the surface area of the movable separation film increases. After that, when the usual bubbling is performed, the movable portion 5*a* of the separation film 5 is displaced as shown in FIG. 9*d* to continuously maintain the stabilized discharges.

In accordance with this method, the permanent distortion is generated by deforming a desired movable separation film once beyond the elastic limit after the completion of the head mode, thus eliminating most of elasticity of this particular movable separation film (that is, the movable separation film is plastically deformed). In this way, it is made possible to prevent part of the bubbling power from being transformed into the energy that causes the film to be stretched. In other words, all of the bubbling power is applied only to the displacement of the film. Consequently, for the movable separation film in the plastic region, the discharging droplet becomes a larger dot to the extent that part of the bubbling power is not transformed into the energy that causes the film to be stretched, because the film can be displaced larger as compared with the case where it is given the same bubbling power as provided for the other movable separation film in the elastic region. In other word, in accordance with the present invention, it is possible to provide a method for manufacturing a liquid jet head which is capable of changing the discharge droplet from the smaller one to the larger one with the same bubbling power given to the smaller one with respect to a desired movable separation film. Since a head of the kind can discharge larger dots without increasing the bubbling power, it is possible to reduce the power dissipation, leading to making the life of the head longer. In this respect, the deformation beyond the yielding point is preferable from the viewpoint that, with such deformation, most of the elasticity of the movable separation film is eliminated.

Now, in conjunction with FIG. 10*a* to FIG. 12*c*, the description will be made of the preferable example in which a head of this type is applicable. Here, FIGS. 10*a* to 10*c*, 11*a* to 11*d* and 12*a* to 12*c* are cross-sectional views which schematically illustrate the recording heads in the arrangement direction of the heat generating element 2, respectively. Each of the solid black circles shown under each nozzle schematically represents the liquid droplet from each nozzle, respectively.

At first, using FIGS. 10*a* to 10*c*, the description will be made of the case where the discharge amount of each nozzle is changed from the beginning.

Figure 10A:
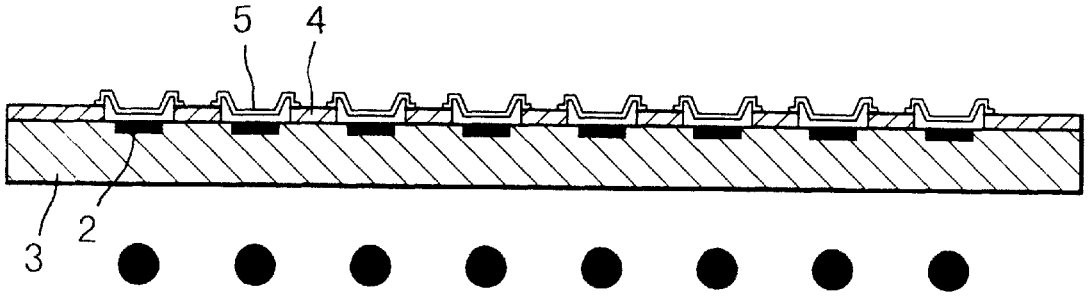
FIGS. 10*a*, 10*b* and 10*c* are cross-sectional views which illustrate an example of the preferred application of the distortion treatment of the separation film shown in FIGS. 9*a* to 9*d*, taken in the arrangement direction of the heat generating elements.
Figure 10B:
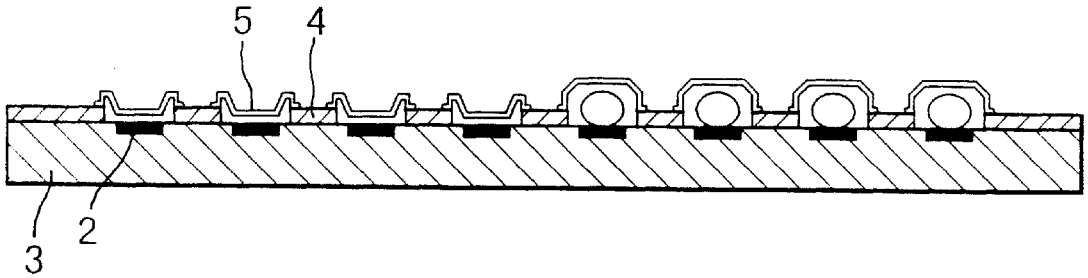
Figure 10C:
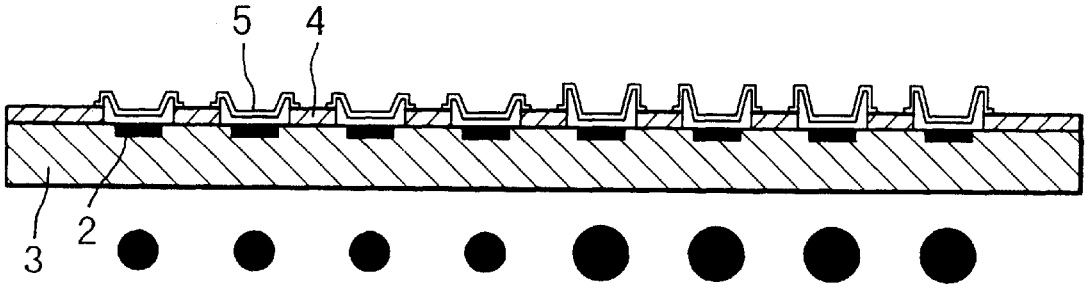

FIG. 10*a* shows the recording head manufactured by the aforesaid method of manufacture, which is provided with the movable separation film 5*a* before the distorting treatment is applied. This recording head can discharge the same amount of liquid droplet from each of the discharge ports stably when the same bubbling power is given to each of the movable separation films 5*a* from each of the heat generating elements 2 arranged for each of the nozzles. In this case, the amount of displacement of each movable separation film 5*a* is the same.

Here, for example, it is assumed that, of the eight nozzles shown in FIG. 10*a*, four nozzles on the left side are given relatively small amount of discharges, and four nozzles on the right side are given relatively large amount of discharges. In this case, only for the four nozzles on the right side where relatively large amount of discharges is given as shown in FIG. 10*b*, the larger bubbling power than usual is provided in order to provided the specific movable separation film with the stress which is beyond the elastic limit (preferably, beyond the yielding point), hence distorting such specific movable separation film. Consequently, as shown in FIG. 10*b*, the plastic deformation is generated so that the surface area of the specific movable separation film increases. Then, the elasticity of the specific movable film has been mostly eliminated.

Therefore, when the same bubbling power is given to all the movable separation film, the specific movable separation film is displaced larger than the other movable separation film in the elastic region to the extent that part of the bubbling power given to the specific movable separation film is not transformed into the energy that causes the film to be stretched. Therefore, as shown in FIG. 10*c*, larger dots are discharged from the discharge ports having the specific movable separation film thus processed.

Now, in conjunction with FIGS. 11*a* to 11*d*, the description will be made of the case where larger dots are discharged from all the discharge ports in the stage of the head being manufactured.

Figure 11A:
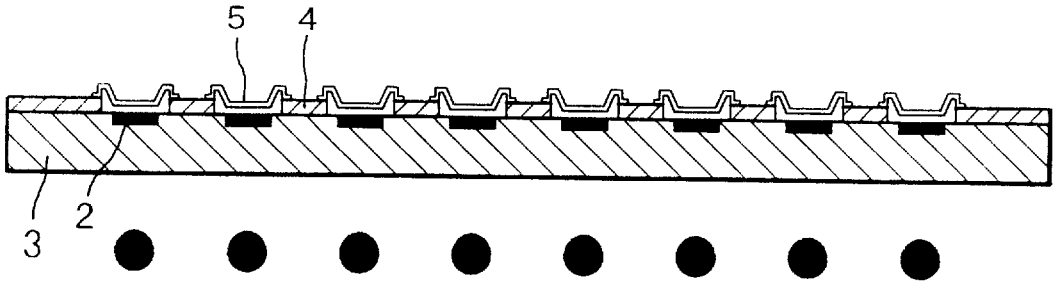
FIGS. 11*a*, 11*b*, 11*c* and 11*d* are cross-sectional views which illustrate an example of the preferred application of the distortion treatment of the separation film shown in FIGS. 9*a* to 9*d*, taken in the arrangement direction of the heat generating elements.
Figure 11B:
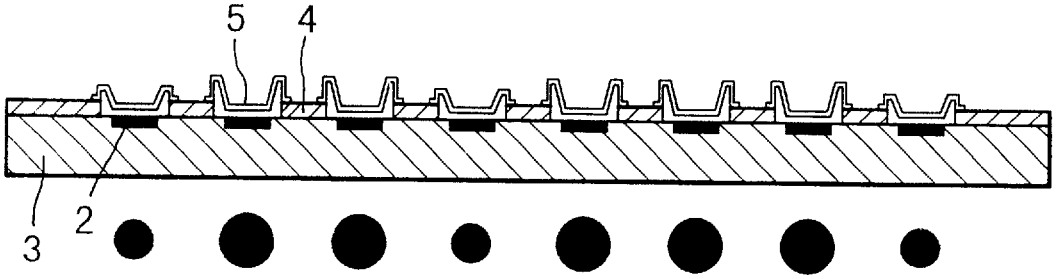

As in FIG. 10*a*, FIG. 11*a* shows the recording head manufactured by the aforesaid method of manufacture, which is provided with the movable separation film 5*a* before the distortion is applied. This recording head can discharge the same amount of liquid droplet from each of the discharge ports stably when the same bubbling power is given to each of the movable separation films 5*a* from each of the heat generating elements 2 arranged for each of the nozzles. In this case, the amount of displacement of each movable separation film 5*a* is the same.

However, due to the manufacturing accuracy or the like which may fluctuate, the resultant stretching is different depending on the movable separation film even if the same bubbling power is applied. Then, when actual discharges are performed, variations may take place in the discharged liquid droplets as shown under FIG. 11*b* in some cases.

Figure 11C:
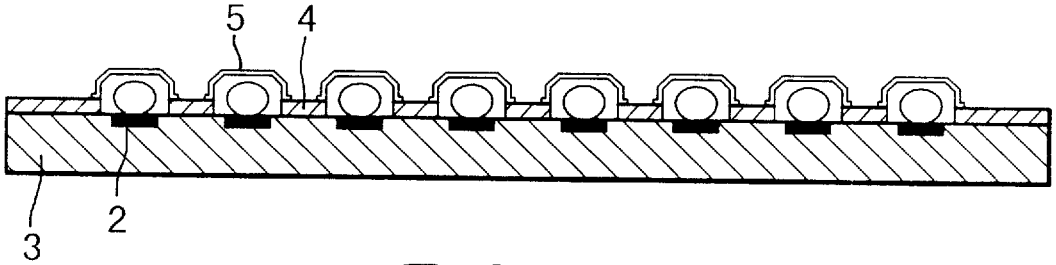
Figure 11D:
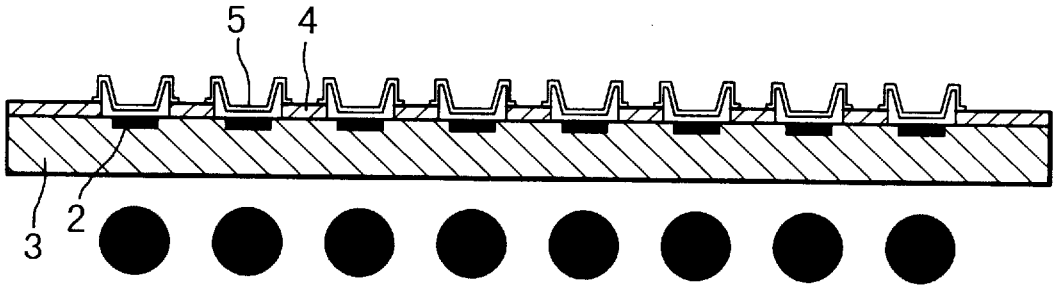

Now, therefore, as shown in FIG. 11*c*, the stress which is beyond the elastic limit is given to all the movable separation film by the application of the larger bubbling power than usual. Thus, all the movable separation film is distorted to generate the plastic deformation as shown in the upper part of FIG. 11*d* so that the surface area of the film increases equally. Then, after that, when the same bubbling power is applied to all the movable separation film, the film is allowed to displace larger all the same to the extent that part of the bubbling power which is not transformed into the energy that cause the film to stretch as compared with the film which is in the elastic region. Consequently, the large dots can be discharged from all the discharge ports stably as shown under FIG. 11*d*. Here, in place of providing the stress beyond the elastic limit for all the movable separation film, it may be possible to provide the stress beyond the elastic limit only for the nozzles that discharge liquid droplets in an amount less than the specific amount of discharges performed as described in conjunction with FIG. 11*b*.

Also, if the bubbling power applied to the discharge of the larger dots as described above is lowered uniformly, it may be possible to discharge smaller dots from each of the discharge ports.

Figure 12A:
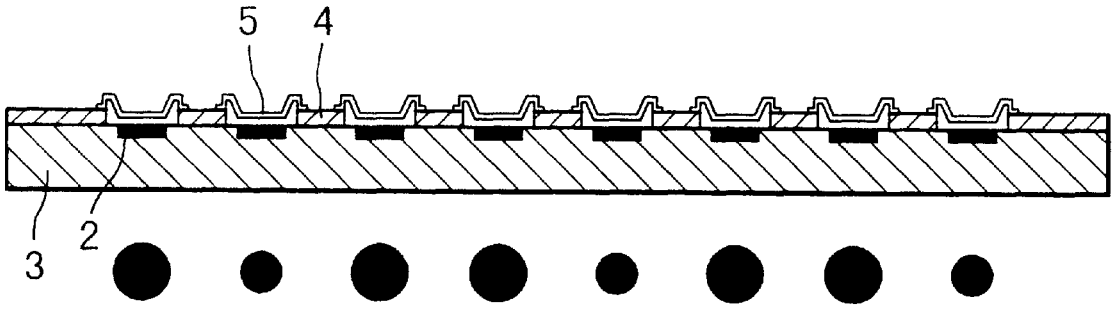
FIGS. 12*a*, 12*b* , and 12*c* are cross-sectional views which illustrate an example of the preferred application of the distortion treatment of the separation film shown in FIGS. 9*a* to 9*d*, taken in the arrangement direction of the heat generating elements.

Now, in conjunction with FIGS. 12*a* to 12*c*, the description will be made of the case where the amount of discharge from each of the discharge ports is adjusted while the recording head is in use.

In accordance with the examples described above, if the configuration of the movable separation film is the same as shown in FIG. 10*a* and others, the amount of discharge obtainable from each discharge port should be the same stably. However, since the use frequency is different per nozzle, the stretching of the nozzle whose use frequency is smaller is small as compared with other nozzles even when the same bubbling power is applied. Thus, as shown under FIG. 12*a*, the discharge liquid droplet may become smaller in some cases. In other words, there is the case where the amount of discharge from each of the discharge ports may vary even if the bubbling power is given to all the movable separation film equally.

Figure 12B:
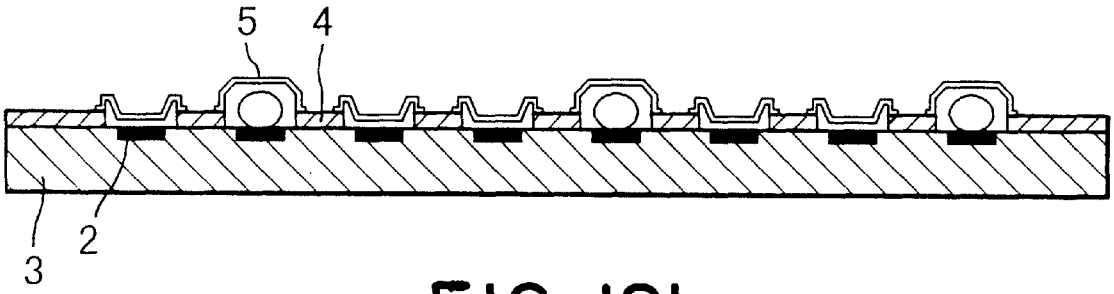

In this case, the movable separation film that presents the smaller dots (the second, fifth, eighth from the left in FIG. 12*a*) is provided with the bubbling power higher than the usual bubbling power as shown in FIG. 12*b* in order to distort the corresponding movable separation film.

Figure 12C:
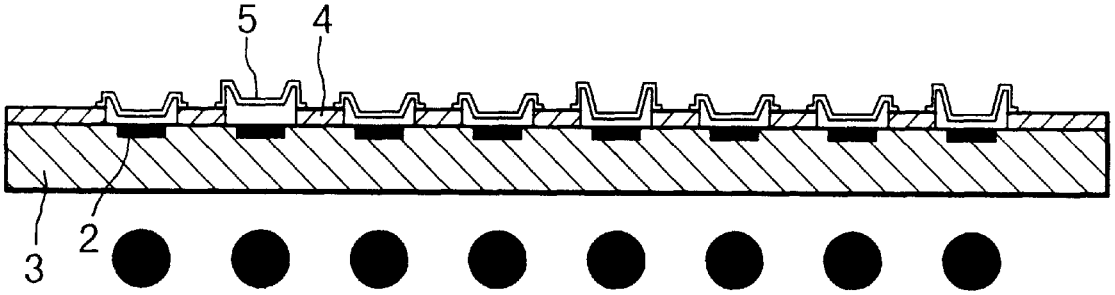

In this way, as shown in the upper part of FIG. 12*c*, the movable separation film that presents the smaller dots is no longer influenced by the elasticity of the film. As a result, it becomes possible to displace each movable separation film uniformly when the same bubbling power is given to each movable separation film equally. Then, as shown under FIG. 12*c*, the same amount of discharged liquid droplets (larger dots) can be obtained from each of the discharge ports.

As described above, in accordance with the present invention, it is possible to provide the organic film with essential sagging by giving the permanent distortion to the organic film. As the usage thereof, the present invention is construed to include the equalization of the discharge amount by making the amount of distortion of all the film equal at the time of manufacture as described in conjunction with FIGS. 11*a* to 11*d*, and the adjustment of the amount of distortion of the organic separation film corresponding at least to the specific portion of the flow paths in order to correct the fluctuation of the discharged amounts at the time of manufacturing the first liquid flow paths or the manual or automatic adjustment of discharge amounts by adjusting the amount of the permanent distortion provided for the initial organic separation film at the initial stage of recording or during the recording operation as shown in FIGS. 12*a* to 12*c*.

Further referring to the other examples, the present invention is effectively utilized even when it is desired to change the amount of discharges from the very beginning. For example, if it is intended to form the parallel arrangement of the first liquid flow path for providing relatively small amount of discharges, and the first liquid flow path for providing relative large amount of discharges, no distortion is given to the former as shown in FIGS. 10*a* to 10*c*, and then, the manufacture of the organic film is executed as disclosed in the specification hereof, while distortion is given to the latter by the means for providing distortion which will be described later in accordance with the present invention.

Now, with the additional structure described above, the effect of the present embodiment becomes excellent synergistically in a better condition to stably obtain highly precise output images as described earlier.

(Second Embodiment)

Figure 13:
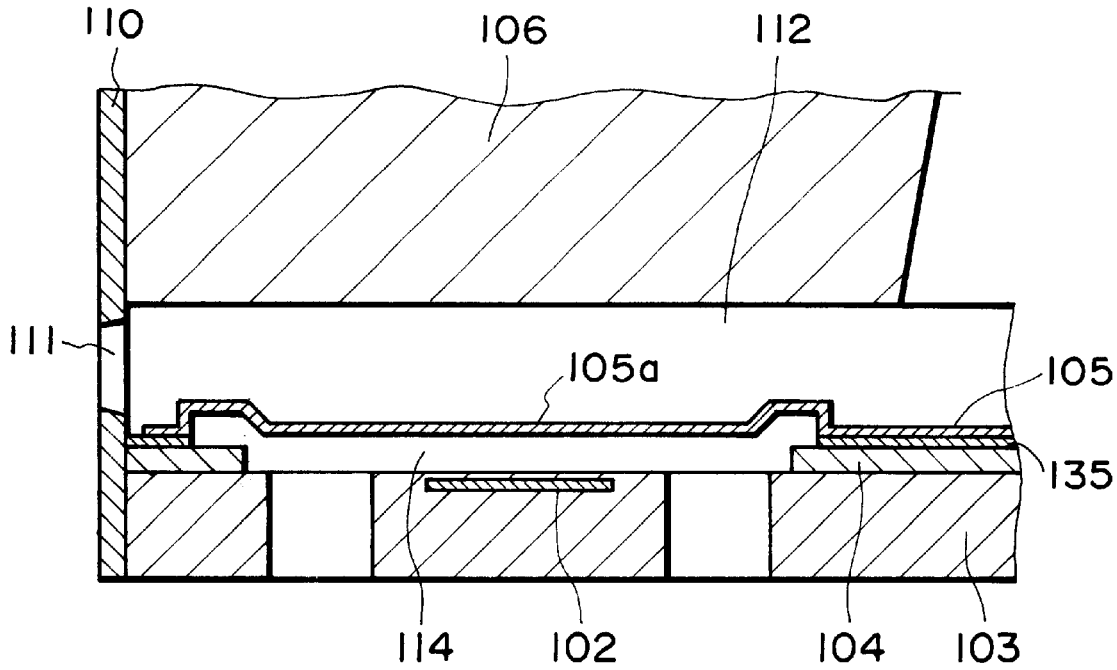
FIG. 13 is a cross-sectional view which shows the liquid jet head in accordance with a second embodiment of the present invention, taken in the direction of the liquid flow path thereof.
Figure 14:
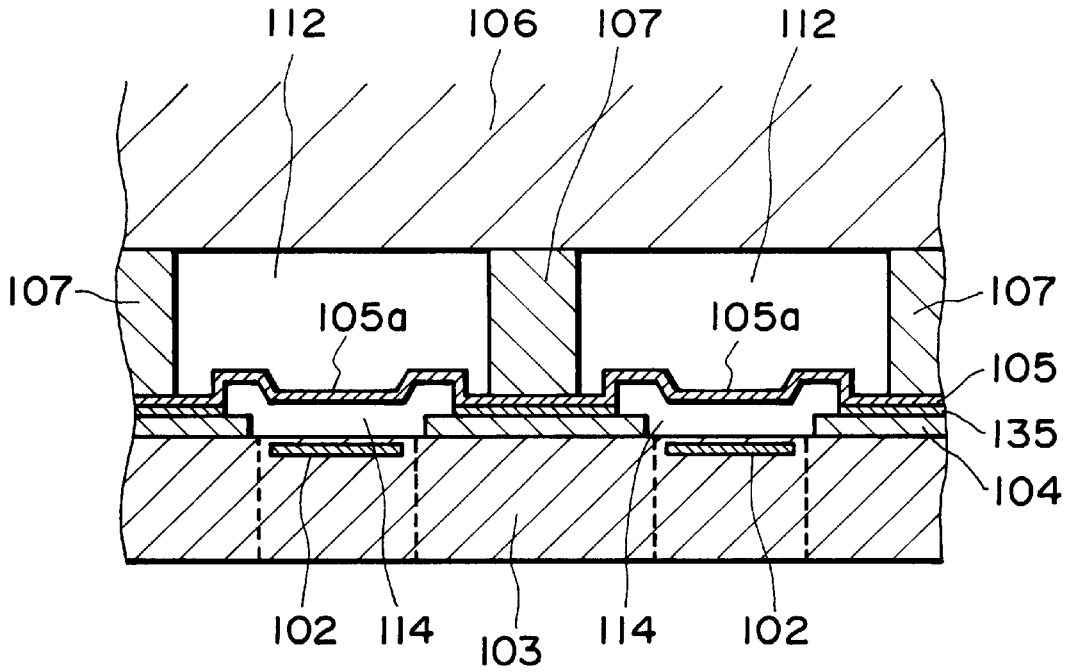
FIG. 14 is a cross-sectional view which shows the liquid jet head in accordance with the second embodiment of the present invention, taken in the arrangement direction of the heat generating elements.
Figures 15A, 15B, 15C, 15D, 15E, 15F:
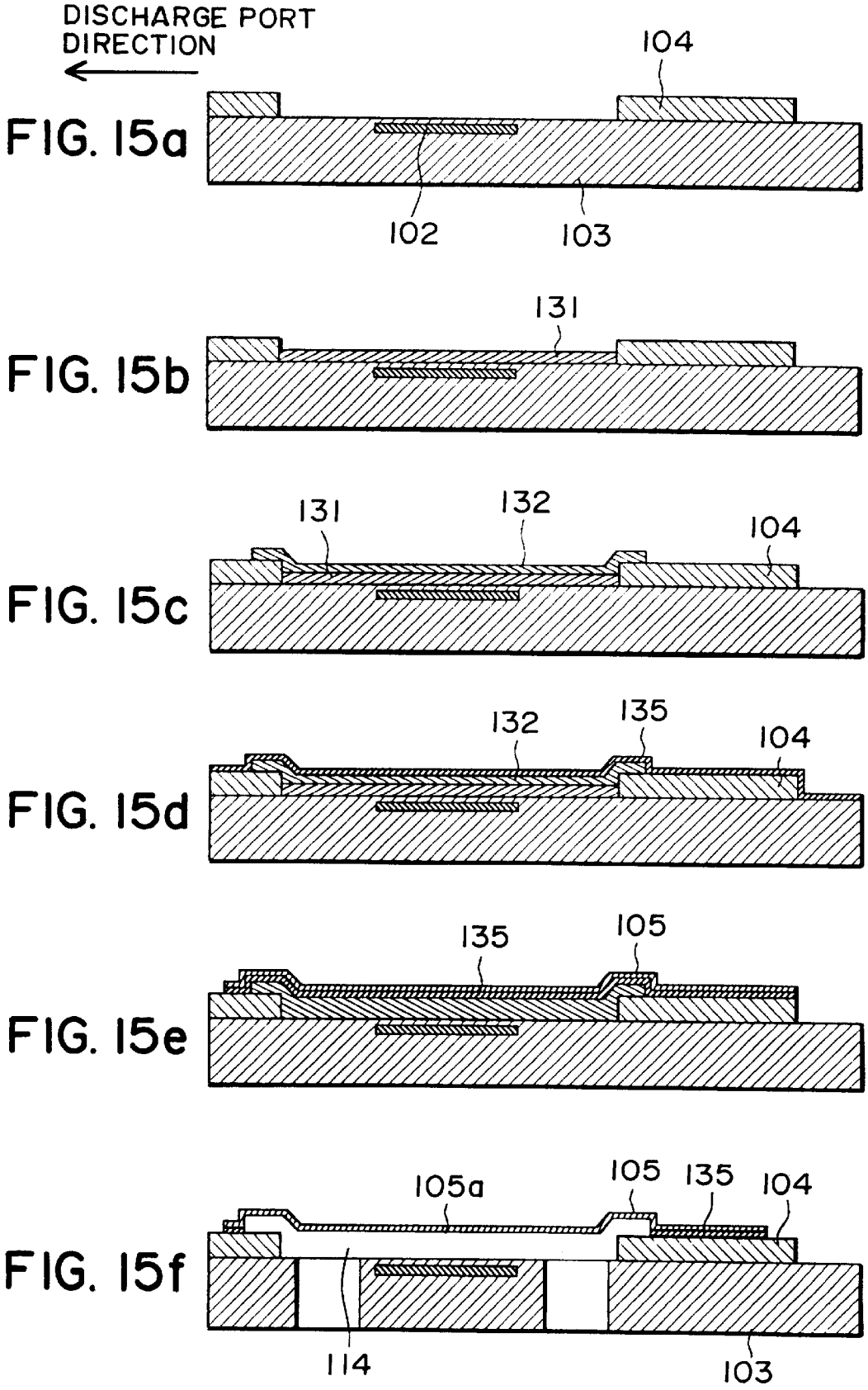
FIGS. 15*a*, 15*b*, 15*c*, 15*d*, 15*e* and 15*f* are cross-sectional views which illustrate the manufacturing process of the substrate for use of a liquid jet head that constitutes the liquid jet head in accordance with the second embodiment of the present invention, taken in the direction of the liquid flow paths.
Figure 16A:
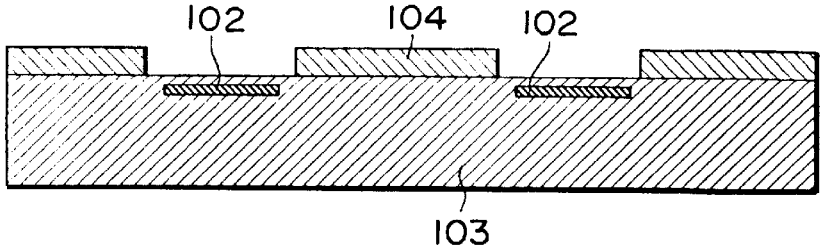
FIGS. 16*a*, 16*b*, 16*c*, 16*d*, 16*e* and 16*f* are cross-sectional views which illustrate the manufacturing process of the substrate for use of the liquid jet head that constitutes the liquid jet head in accordance with the second embodiment of the present invention, taken in the arrangement direction of the heat generating elements.
Figure 16B:
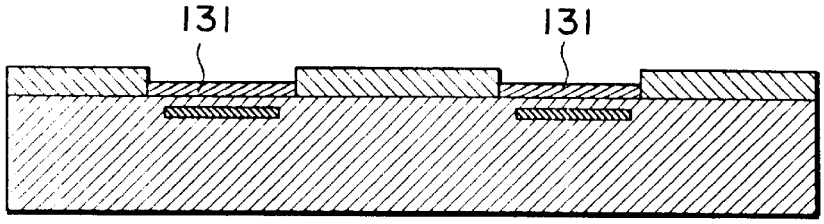
Figure 16C:
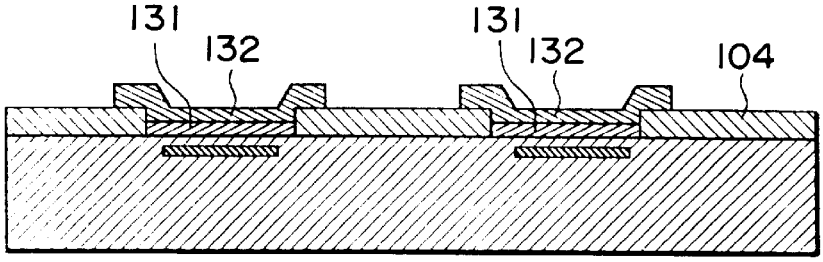
Figure 16D:
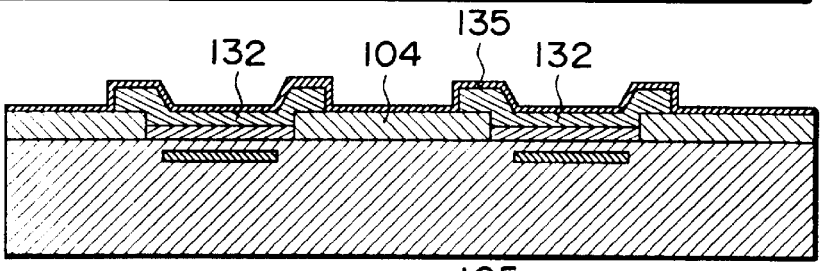
Figure 16E:
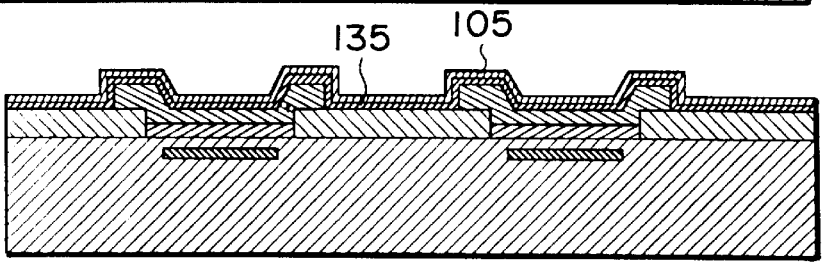
Figure 16F:
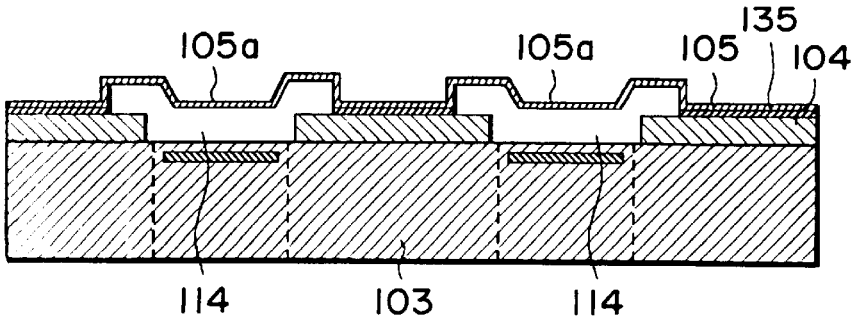

FIG. 13 and FIG. 14 are cross-sectional views which illustrate a liquid jet head in accordance with a second embodiment of the present invention. FIG. 13 is the cross-sectional view which is taken in the direction of the liquid flow path thereof. FIG. 14 is the cross-sectional which is taken in the arrangement direction of the heat generating elements.

The fundamental structure of the liquid jet head of the present embodiment is the same as that of the first embodiment. In other words, the pedestals 104 that support the movable separation film 105 are arranged on the elemental substrate 103 where a plurality of heat generating elements 102 are arranged in parallel. On the pedestals 104, the movable separation film 105 is fixed through the bonding agent 135. Thus, the substrate for use of a liquid jet head is structured with a plurality of second liquid flow paths 114 provided therefor corresponding to the heat generating elements 102. Then, the ceiling plate 106 having a plurality of flow path walls 107 integrally formed and positioned between each of the heat generating elements 102, respectively, is bonded onto the elemental substrate to constitute the first liquid flow paths 112 corresponding to the second liquid flow paths 114. Also, the orifice plate 110 is bonded to cover the front face of the substrate for use of a liquid jet head and the front face of the ceiling plate 106. For the orifice plate 110, a plurality of discharge ports 111 are formed and communicated with the first liquid flow paths 112, respectively.

Here, the movable separation film 105, which separates the first liquid flow paths 112 and the second liquid flow path 114 completely, is configured in the same form as that of the first embodiment. The movable portion 105*a* that faces each of the heat generating elements 102 is configured to be convex toward the second liquid flow path 114 side. However, the degree of extrusion thereof is smaller than that of the first embodiment, and the distance between each of the heat generating elements 103 and the movable portions 105*a* is greater than that of the first embodiment.

Now, the description will be made of the method for manufacturing the liquid jet head of the present embodiment.

As in the first embodiment, the liquid jet head of the present embodiment is manufactured in such a manner that the ceiling plate 106 is bonded to the substrate for use of a liquid jet head, and then, the orifice plate 110 is bonded thereto. Here, the method for manufacturing the ceiling plate 106 and the ceiling plate 110 is the same as that of the first embodiment. Therefore, the description thereof will be omitted. Now, hereunder, in conjunction with FIGS. 15*a* to 15*f* and FIGS. 16*a* to 16*f*, the description will be made of the method for manufacturing the substrate for use of a liquid jet head. In this respect, the processes a to f referred to in the following description correspond to those represented in FIGS. 15*a* to 15*f* and FIGS. 16*a* to 16*f*, respectively.

(Process a)

On the entire upper surface of the elemental substrate 103 where the heat generating elements 102 and the external contact pads (not shown) are formed among some others, the TiW film is formed by the sputtering method in a film thickness of approximately 5000 Å as the protection layer that protects the external contact pads. Then, on the TiW film, the SiN film is formed by the plasma CVD method in a thickness of approximately 10 $\mu$m, and the portion of the SiN film that becomes the second liquid flow paths, and the portions other than the area having the external contact pads formed are patterned by the known method, such as photolithography, to form the pedestals 104. In this respect, the elemental substrate 103 is formed by silicon, and each of the heat generating elements 102 is formed on silicon using the semiconductor manufacturing process.

(Process b)

The Al film is buried in the portion that becomes the second liquid flow paths in a thickness of approximately 5 $\mu$m to form the first sacrifice layer 131.

(Process c)

On the upper surface of each of the pedestals 104 and the sacrifice layers 131, the Al film is formed by the sputtering method in a thickness of approximately 5 μm. Then, the portions other than those becoming the second liquid flow paths and the circumference thereof are patterned by the known photolithographic method or the like to form the second sacrifice layer 132. At this juncture, the step is created between the first sacrifice layer 131 and the pedestals 104, and the height of each pedestal 104 is higher than that of the first sacrifice layer 131. As a result, the second sacrifice layer 132 is formed to be convex in a state where the circumference thereof runs over each of the pedestals 104.

(Process d)

On the upper surface of the pedestals 104 and the second sacrifice layer 132, the silane coupling agent that becomes the bonding agent 135 is coated in the laminar form.

(Process e)

On the bonding agent 135, the polyparaxylene film that becomes the movable separation film 105 is formed by the CVD method in a thickness of approximately 2 μm.

(Process f)

After the $SiO_2$ film is formed on the reverse side of the elemental substrate 103 by the thermal oxidation in a film thickness of approximately 1 μm, the aperture portions of the supply port and exhaust port are patterned by use of the known method, such as photolithography. Then, on the reverse side of the elemental substrate 103, the circular column-shaped supply port and exhaust port of 10 to 50 μm diameter are formed by means of the trench structured etching using the dielectric coupling plasma etching apparatus. In this case, the first sacrifice layer 131 functions as the etching stop layer. Therefore, the movable separation film 105 is not etched.

Subsequently, the first sacrifice layers 131 and the second sacrifice layer 132 are removed by use of a mixed solution of phosphoric acid, acetic acid, and hydrochloric acid. Further, the bonding agent 135 is removed to form the second liquid flow paths 114. In this manner, as in the first embodiment, the bonding agent 135 remains intact only on the region which becomes the fixing portion of the movable separation film 105 to the pedestals 104, but not allowed to remain on the movable portions 105*a*.

In this way, it is possible to obtain the substrate for use of a liquid jet head provided with the movable separation film 105 whose distance from the surface of the elemental substrate 103 to the movable portion 105*a* is approximately 10 μm.

The liquid jet head that uses such substrate for use of a liquid jet head is capable of preventing the drawback related to the film installation as in the first embodiment, because there is no case where the movable separation film 105 should be handled as a single element. Also, with the specific configuration of the movable portions 105*a* of the movable separation film 105 thus provided, it is possible to produce an effect that the discharge efficiency is enhanced to obtain highly precise output images stably.

Further, for the liquid jet head of the present embodiment, the sacrifice layer is structured in two layers when the movable separation film 105 is formed. Therefore, while each movable portion 105*a* of the movable separation film 105 is configured to be convex toward the second liquid flow path 114, it becomes possible to provide a sufficient distance between the movable portion 105*a* and the heat generating element 102. Consequently, in the process between the creation of the bubble and the defoaming thereof at the time of liquid discharge, the influence exerted by heat on the movable portion 105*a* is made smaller. In other words, when the material of the movable separation film 105 is selected, the restriction on its heat resistance is eased to widen the range of material selections for the movable separation film 105.

Also, with the provision of a plurality of sacrifice layers, the distance between the movable portion 105*a* and the heat generating element 102 becomes greater. However, it may be possible to make the distance between the movable portion 105*a* and the heat generating element 102 greater with the provision of a single sacrifice layer whose film thickness is large. Here, nevertheless, if the circumference of the movable portion 105*a* is configured to be convex toward the first liquid flow path 112 side as in the present embodiment, the height of the circumference of the movable portion 105*a* is also made higher inevitably when the film thickness of the sacrifice layer is made larger. If the height of the circumference of the movable portion 105*a* becomes higher, the liquid flow in the first liquid flow path 112 tends to be disturbed easily, provided that the distance between the ceiling plate and substrate is constant. Then, the liquid discharge and refilling (the supply of liquid from the upstream side in the first flow path 112) tends to be instable. Therefore, if the movable portion 105*a* should be configured as in the present embodiment, it is preferable to arrange sacrifice layers each individually plural times so as not to make the height of the circumference of the movable portion 105*a* too high eventually.

Also, in accordance with the present embodiment, the movable portion 105*a* is displaced by a specific amount with a desired bubbling power provided for the movable portion 105*a* of the separation film 105, thus discharging a specific amount of liquid droplet from each of the discharge ports 111. If the discharging droplets should be made larger locally for the multiple nozzle arrangement, it should be good enough if only the bubbling power in the corresponding nozzles is made greater to displace (move, expand, or elongate) the corresponding movable portions 105*a* larger. Further, if the size (amount) of each of the discharge droplets is caused to vary even by the application of the same bubbling power, it should be good enough to adjust the bubbling power for each of the movable portions 105*a* of the separation film 105.

Further, in order to provide the liquid jet head capable of discharging larger and smaller dots locally from the multiple nozzles without adjusting the bubbling power or capable of discharging a specific amount of liquid droplets stably without any fluctuation, it is preferable to add the process to distort a desired movable separation film once (to give the permanent distortion within a range where the film is not broken) (see FIGS. 9*a* to 9*d*) after the completion of the head mode in the processes shown in FIGS. 15*a* to 15*f* and FIGS. 16*a* to 16*f*. As described in conjunction with the first embodiment, the stress should only be applied to the desired movable separation film in this additional process. As the method for distorting the movable separation film, any method may be adoptable if only it can provide an appropriate permanent distortion for the film. With a distortion treatment of the kind thus given to the movable separation film, most of the elasticity of the corresponding movable separation film is eliminated, and part of the bubbling power is not allowed to be transformed into the energy which causes the film to stretch. Consequently, for the desired movable separation film in the plastic region, the film can be displaced greater to the extent that the part of the bubble power is not allowed to be transformed into the energy that causes the film to stretch as compared with the case where the same bubbling power is applied to the other movable separation film in the elastic region. The discharge liquid droplets become larger dots accordingly. In other words, if the process is added to give the permanent distortion to the movable separation film, it becomes possible to provide the method for manufacturing the liquid jet head capable of changing the discharging liquid droplets into larger dots with the application of the bubbling power to the desired movable separation film, which is equivalent to making the smaller dots. Since a head of the kind can discharge larger dots without increasing the bubbling power, it becomes possible to reduce the power dissipation, leading to making the life of the head longer.

(Third Embodiment)

Figure 17:
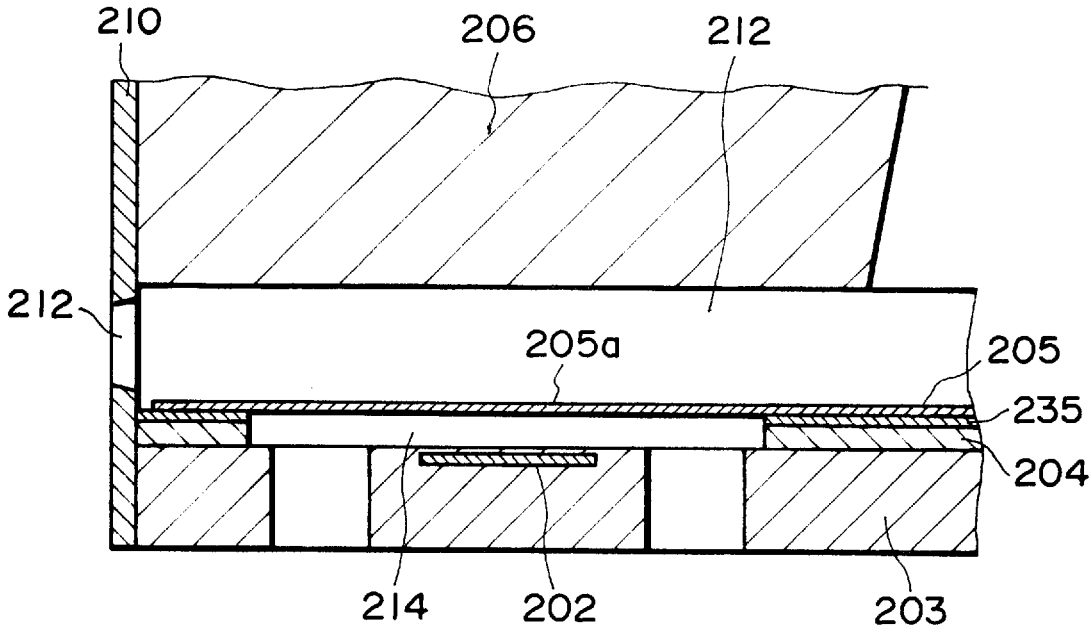
FIG. 17 is a cross-sectional view which shows a liquid jet head in accordance with a third embodiment of the present invention, taken in the direction of the liquid flow paths.
Figure 18:
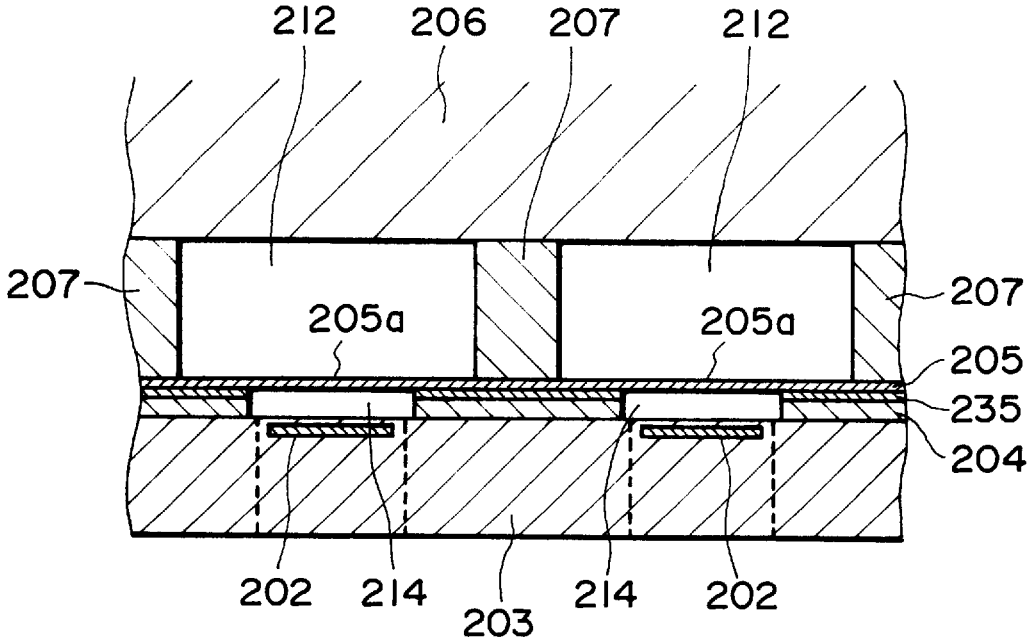
FIG. 18 is a cross-sectional veiw which shows a liquid jet head in accordance with the third embodiment of the present invention, taken in the arrangement direction of the heat generating elements.
Figure 19A:
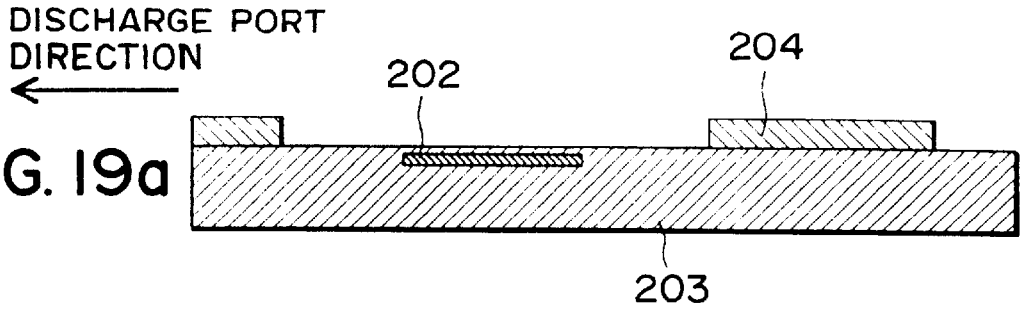
FIGS. 19*a*, 19*b*, 19*c*, 19*d* and 19*e* are cross-sectional views which illustrate the manufacturing process of the substrate for use of a liquid jet head that constitutes the liquid jet head in accordance with the second embodiment of the present invention, taken in the direction of the liquid flow paths.
Figure 19B:
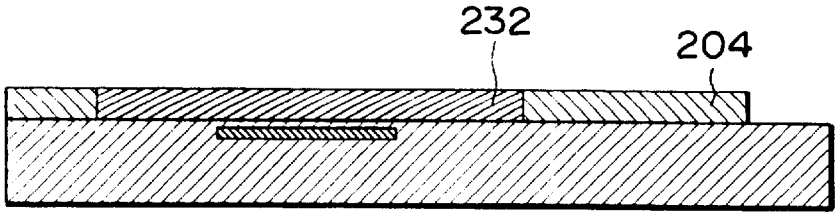
Figure 19C:
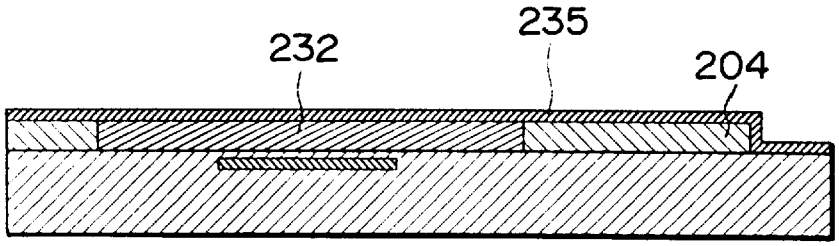
Figure 19D:
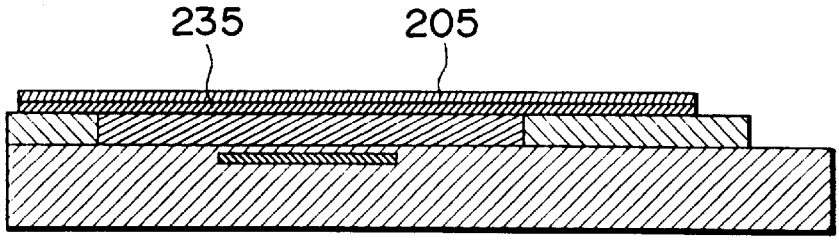
Figure 19E:
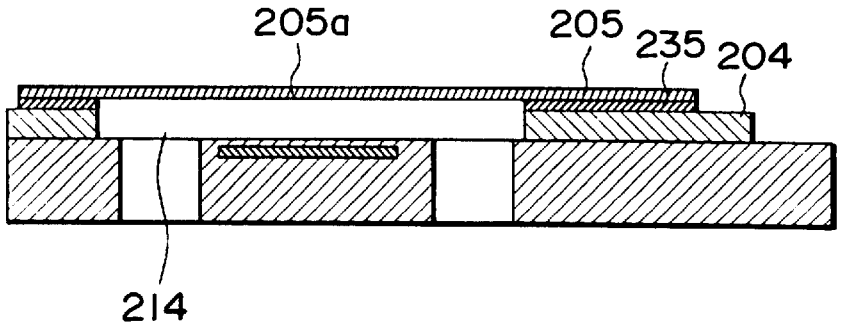
Figure 20A:
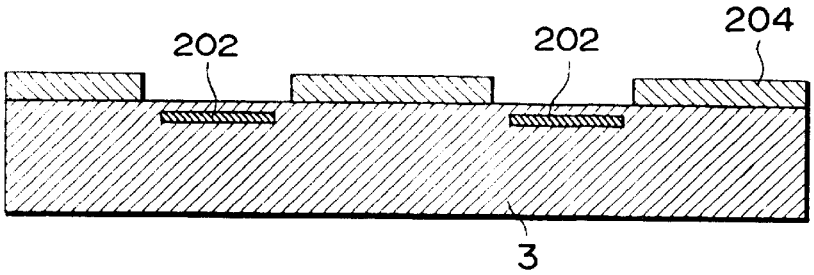
FIGS. 20*a*, 20*b*, 20*c*, 20*d* and 20*e* are cross-sectional views which illustrate the manufacturing process of the substrate for use of the liquid jet head that constitutes the liquid jet head in accordance with the second embodiment of the present invention, taken in the arrangement direction of the heat generating elements.
Figure 20B:
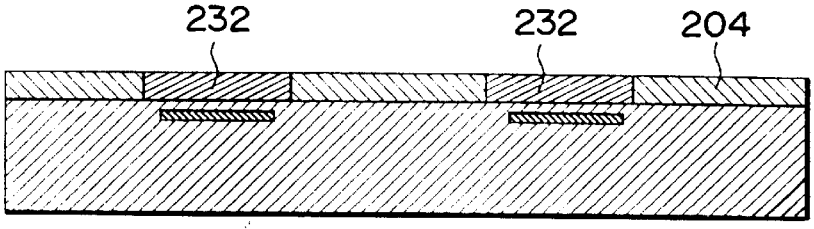
Figure 20C:
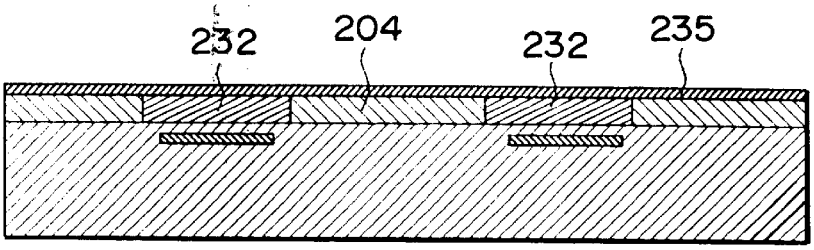
Figure 20D:
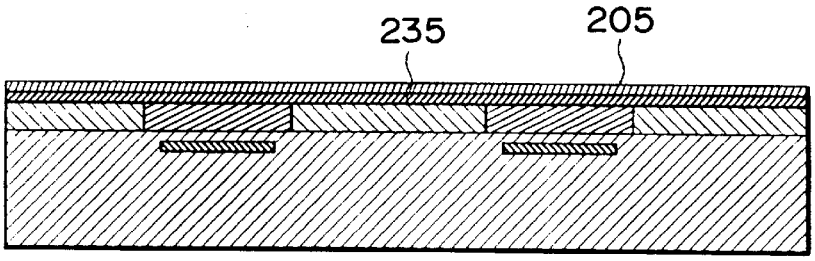
Figure 20E:
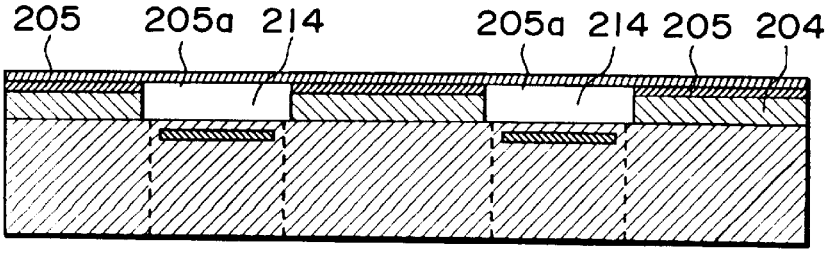

FIG. 17 and FIG. 18 are cross-sectional views which illustrate the liquid jet head in accordance with a third embodiment of the present invention. FIG. 17 is the cross-sectional view which is taken in the direction of the liquid flow paths. FIG. 18 is the cross-sectional view which is taken in the arrangement direction of the heat generating elements.

The fundamental structure of the liquid jet head of the present embodiment is the same as that of the first embodiment. In other words, the pedestals 204 that support the movable separation film 205 are arranged on the elemental substrate 203 where a plurality of heat generating elements 202 are arranged in parallel. On the pedestals 204, the movable separation film 205 is fixed through the bonding agent 235. Thus, the substrate for use of a liquid jet head is structured with a plurality of second liquid flow paths 214 provided therefor corresponding to the heat generating elements 202. Then, the ceiling plate 206 having a plurality of flow path walls 207 integrally formed and positioned between each of the heat generating elements 202, respectively, is bonded onto the elemental substrate to constitute the first liquid flow paths 212 corresponding to the second liquid flow paths 214. Also, the orifice plate 210 is bonded to it to cover the front face of the substrate for use of a liquid jet head and the front face of the ceiling plate 206. For the orifice plate 210, a plurality of discharge ports 211 are formed and communicated with the first liquid flow paths 212, respectively.

Here, the movable separation film 205, which separates the first liquid flow paths 212 and the second liquid flow path 214 completely, is formed as the flat film, and the distance between the surface of the elemental substrate 203 and the movable portions 205*a* is made to be equal to the height of the pedestals 204.

Now, the description will be made of the method for manufacturing the liquid jet head of the present embodiment.

As in the first embodiment, the liquid jet head of the present embodiment is manufactured in such a manner that the ceiling plate 206 is bonded to the substrate for use of a liquid jet head, and then, the orifice plate 210 is bonded thereto. Here, the method for manufacturing the ceiling plate 206 and the orifice plate 120 is the same as that of the first embodiment. Therefore, the description thereof will be omitted. Now, hereunder, in conjunction with FIGS. 19*a* to 19*e* and FIGS. 20*a* to 20*e*, the description will be made of the method for manufacturing the substrate for use of a liquid jet head. In this respect, the processes a to e referred to in the following description correspond to those represented in FIGS. 19*a* to 19*e* and FIGS. 20*a* to 20*e*, respectively.

(Process a)

On the entire upper surface of the elemental substrate 203 where the heat generating elements 202 and the external contact pads (not shown) are formed among some others, the TiW film is formed by the sputtering method in a film thickness of approximately 5000 Å as the protection layer that protects the external contact pads. Then, on the TiW film, the SiN film is formed by the plasma CVD method in a thickness of approximately 10 $\mu$m, and the portion of the SiN film that becomes the second liquid flow paths, and the portions other than the area having the external contact pads formed are patterned by the known method, such as photolithography, to form the pedestals 204. In this respect, the elemental substrate 203 is formed by silicon, and each of the heat generating elements 202 is formed on silicon using the semiconductor manufacturing process.

(Process b)

The Al film is buried in the portion that becomes the second liquid flow paths in a thickness of approximately 10 $\mu$m to form the first sacrifice layer 231. Thus, the portion that becomes the second flow paths is completely buried, and the surface of the pedestals 203 and that of the sacrifice layer 231 becomes the same flat plane.

(Process c)

On the upper surface of the pedestals 204 and the sacrifice layer 231, the silane coupling agent that becomes the bonding agent 235 is coated in the laminar form.

(Process d)

On the upper surface of the bonding agent 235, the polyparaxylene film that becomes the movable separation film 205 is formed by the CVD method in a thickness of approximately 2 $\mu$m.

(Process e)

After the $SiO_2$ film is formed on the reverse side of the elemental substrate 203 by the thermal oxidation in a film thickness of approximately 1 $\mu$m, the aperture portions of the supply port and exhaust port are patterned by use of the known method, such as photolithography. Then, on the reverse side of the elemental substrate 203, the circular column-shaped supply port and exhaust port of 10 to 50 $\mu$m diameter are formed by means of the trench structured etching using the dielectric coupling plasma etching apparatus. In this case, the sacrifice layer 231 functions as the etching stop layer. Therefore, the movable separation film 205 is not etched.

Subsequently, the sacrifice layers 231 is removed by use of a mixed solution of phosphoric acid, acetic acid, and hydrochloric acid. Further, the bonding agent 235 is removed to form the second liquid flow paths 214. In this manner, as in the first embodiment, the bonding agent 235 remains intact only on the region which becomes the fixing portion of the movable separation film 205 to the pedestals 204, but not allowed to remain on the movable portions 205*a*.

In this way, it is possible to obtain the substrate for use of a liquid jet head which is provided with the flat movable separation film 205 supported by the pedestals 204.

In accordance with the present embodiment, since the movable separation film 205 is configured simply, it becomes possible to simplify the formation process of the sacrifice layer 231 that determines the configuration of the movable separation film 205. As a result, it becomes easier to manufacture the substrate for use of a liquid jet head which is integrally formed with the movable separation film 205. This arrangement is particularly effective when there is a need for making the distance greater between the heat generating elements 202 and the movable separation film 205 because of the material of the movable separation film whose property tends to be affected by heat easily.

(Fourth Embodiment)

Figure 21:
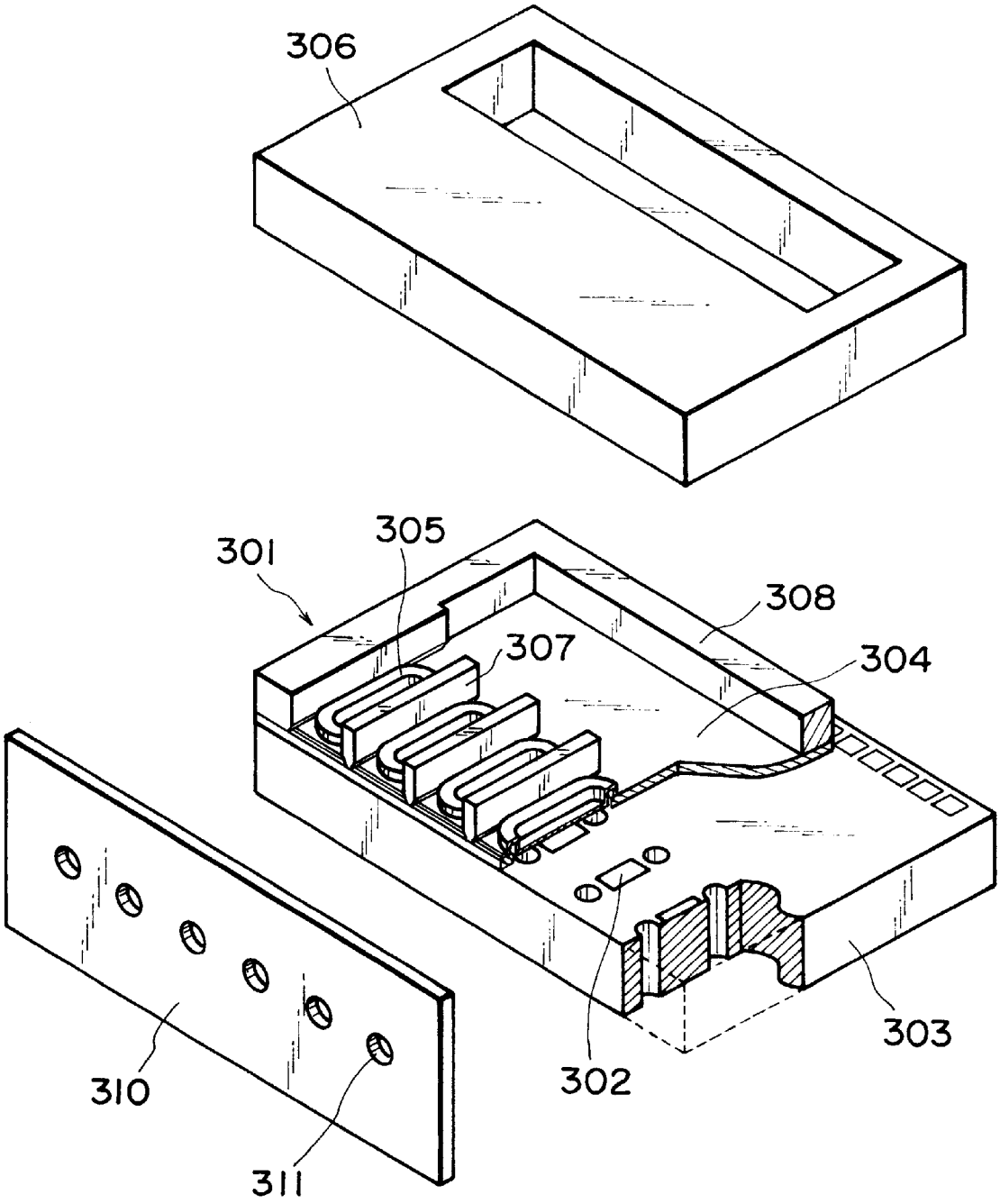
FIG. 21 is a cross-sectional view which shows a liquid jet head in accordance with a third embodiment of the present invention.
Figure 22:
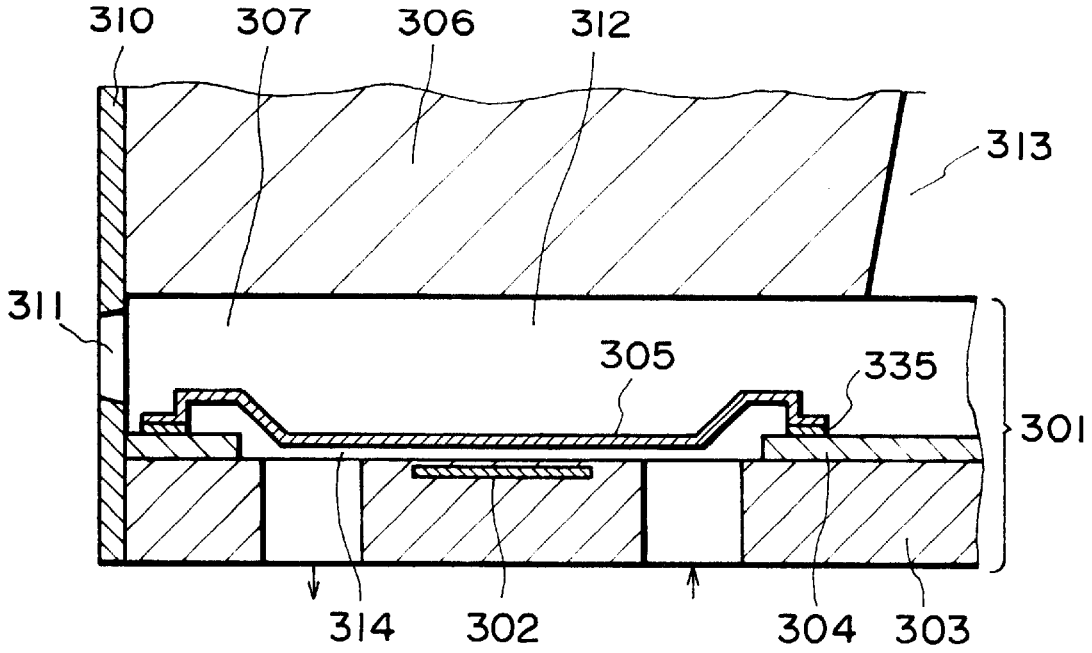
FIG. 22 is cross-sectional view which shows the liquid jet head represented in FIG. 21, taken in the direction of the liquid flow paths.
Figure 23:
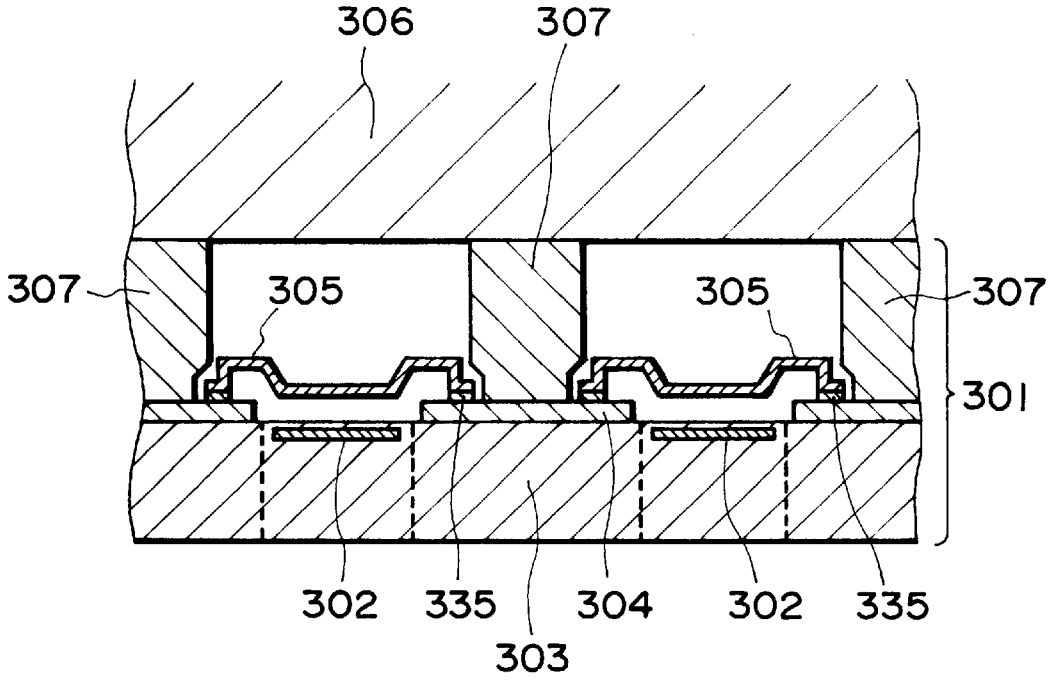
FIG. 23 is a cross-sectional view which shows the liquid jet head represented in FIG. 21, taken in the arrangement direction of the heat generating elements.
Figure 24A:
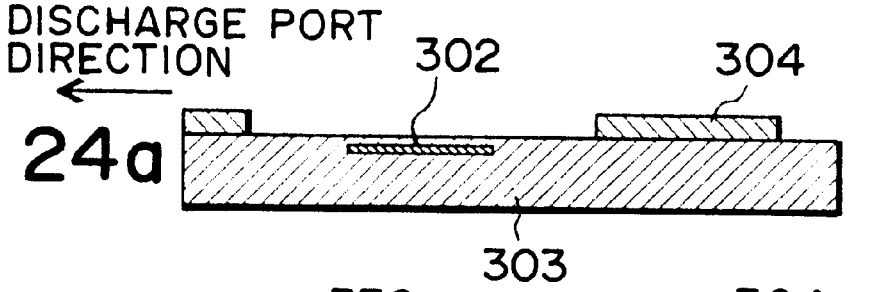
FIGS. 24*a*, 24*b*, 24*c*, 24*d*, 24*e*, 24*f*, 24*g* and 24*h* are cross-sectional views which illustrate the manufacturing process of the substrate for use of a liquid jet head that constitutes the liquid jet head in accordance with the third embodiment of the present invention, taken in the direction of the liquid flow paths.
Figure 24B:
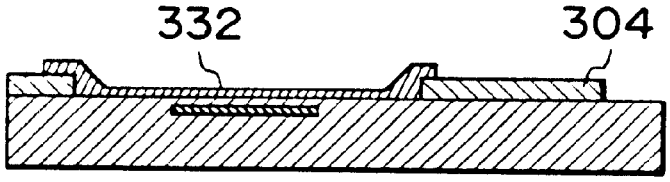
Figure 24C:
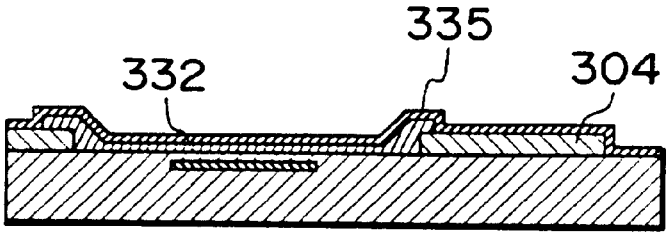
Figure 24D:
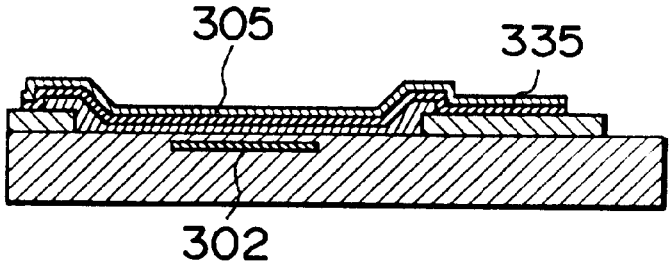
Figure 24E:
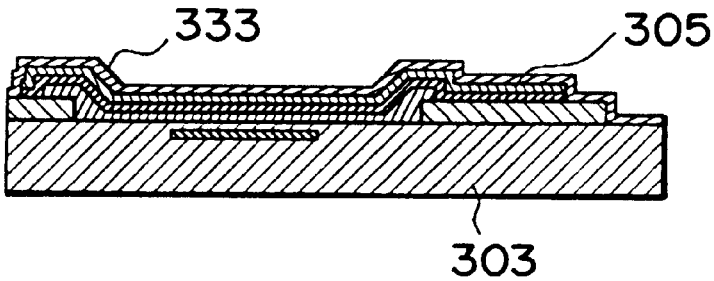
Figure 24F:
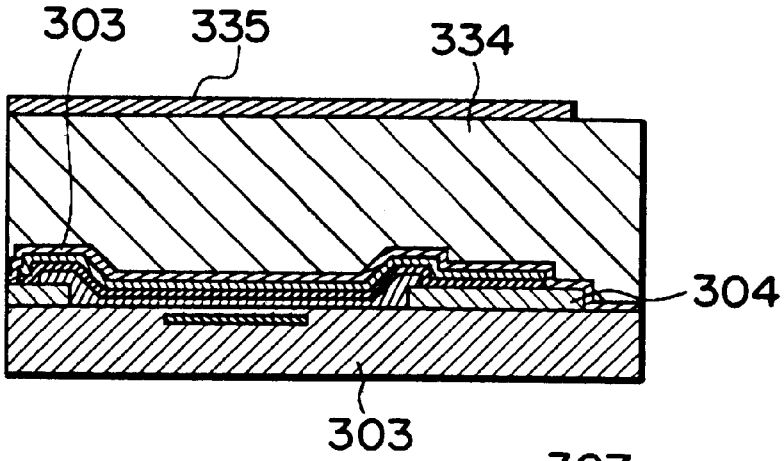
Figure 24G:
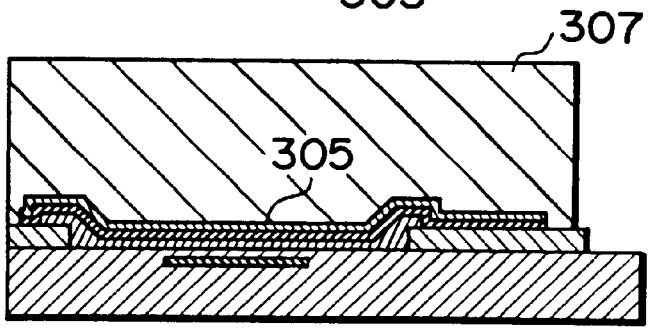
Figure 24H:
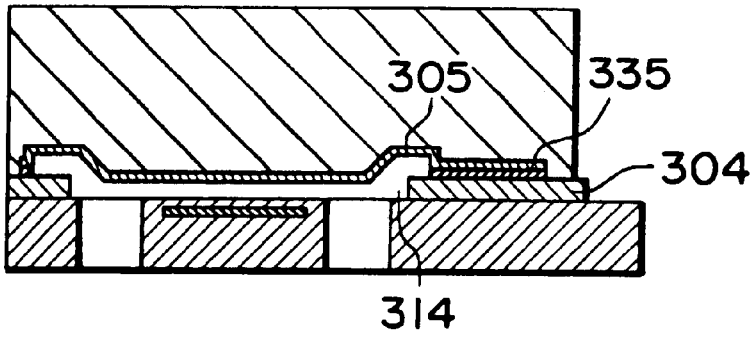
Figure 25A:
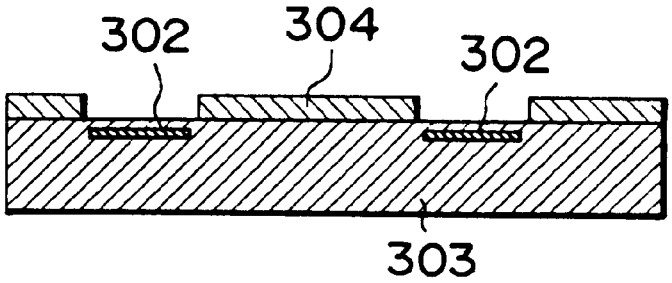
FIGS. 25*a*, 25*b*, 25*c*, 25*d*, 25*e*, 25*f*, 25*g* and 25*h* are cross-sectional views which illustrate the manufacturing process of the substrate for the use of the liquid jet head that constitutes the liquid jet head in accordance with the fourth embodiment of the present invention, taken in the arrangement direction of the heat generating elements.
Figure 25B:
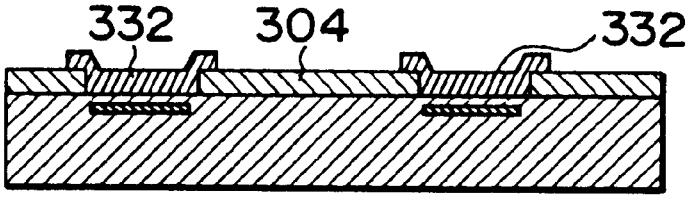
Figure 25C:
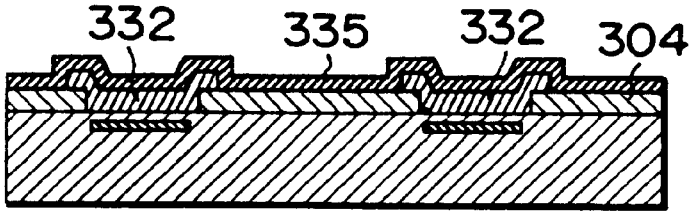
Figure 25D:
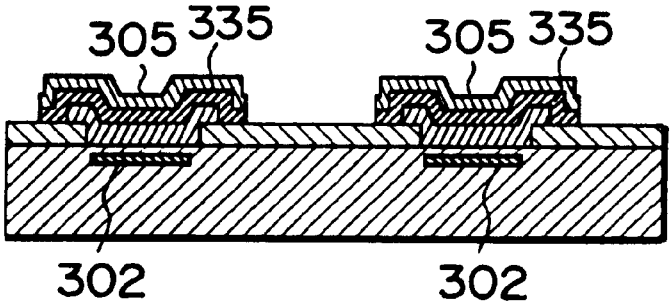
Figure 25E:
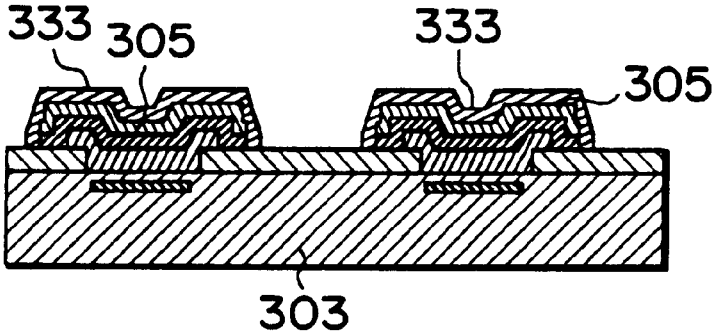
Figure 25F:
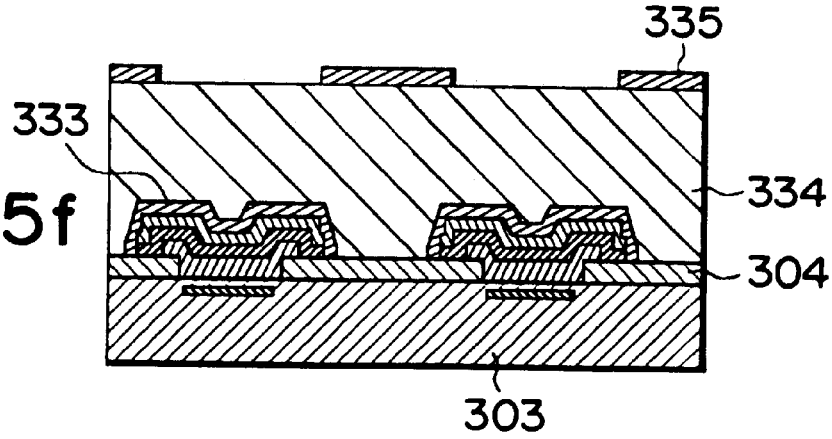
Figure 25G:
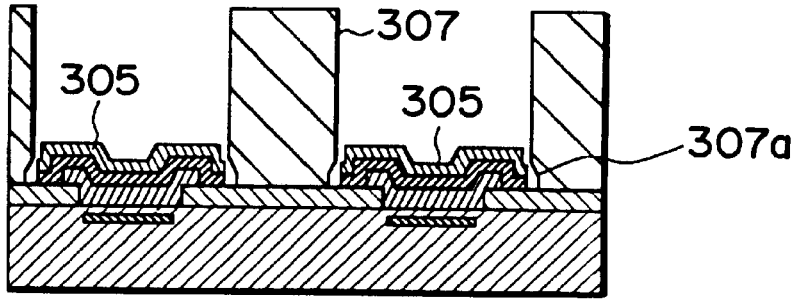
Figure 25H:
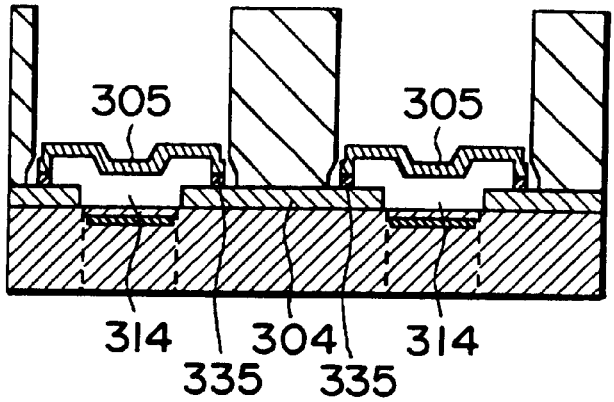

FIG. 21 is an exploded perspective view which shows the liquid jet head in accordance with a fourth embodiment of the present invention. FIG. 22 is a cross-sectional view which shows the liquid jet head represented in FIG. 21, taken in the direction of the liquid flow paths. FIG. 23 is a cross-sectional view which shows the liquid jet head represented in FIG. 21, taken in the arrangement direction of the heat generating elements thereof.

As shown in FIG. 21 to FIG. 23, the liquid jet head of the present embodiment is provided with the substrate 301 for use of a liquid jet head, the ceiling plate 306, and the orifice plate 310 as in the first embodiment.

The substrate 301 for use of a liquid jet head is provided with the elemental substrate 303 having a plurality of heat generating elements 302 each generating energy to create bubbles in liquid, and a plurality of separation films 305 which are independent from each other and each of which is supported through the bonding agent 335 by each pedestal 304 arranged on the elemental substrate to face each of the heat generating elements 302 with a gap with each of the head generating elements 102, respectively. In this manner, for the substrate 301 for use of a liquid jet head, each of the second liquid flow paths 314 is formed corresponding to each of the heat generating elements 302. The configuration of the individual separation film 305 on the portions other than the contact portions with the pedestals 304 is the same as that of the first embodiment. Also, as in the first embodiment, there are provided on the elemental substrate 303 the supply port through which the bubbling liquid is supplied to each of the second liquid flow paths 314, and the exhaust port through which the bubbling liquid supplied to each of the second liquid flow paths 314 is exhausted from each second liquid flow path 314.

Further, for the substrate 301 of the present embodiment for use of a liquid jet head, there are integrally formed on the upper surface of pedestals 304 the low path walls 307 that constitutes a plurality of first liquid flow paths 314 corresponding to the second liquid flow paths 312, and the liquid chamber 308 that constitutes the common liquid chamber 313 as well.

Thus, with the flow path walls 307 and the liquid chamber frame 308 provided for the substrate 301 for use of a liquid jet head, the ceiling plate 306 is structured as the plate member having the aperture of the common liquid chamber 313 formed.

besides, as in the first embodiment, the first liquid flow paths 312 and the second liquid flow paths 314 are completely separated by the individual separation films 305; a plurality of discharge ports 311 communicated with each of the first liquid flow paths 312 are arranged on the orifice plate; and the external pads and the like are arranged for the elemental substrate 303, among some others.

Now, the description will be made of the method for manufacturing the substrate for use of a liquid jet head in accordance with the present embodiment.

At first, as to the ceiling plate 306, the same silicon wafer as the first embodiment is used, and then, with the etching processing or the like, it is possible to form the aperture of the common liquid chamber 313 on the ceiling plate. Also, it is possible to produce the orifice plate 310 in the same manner as the first embodiment.

Now, in conjunction with FIGS. 24*a* to 24*h* and FIGS. 25*a* to 25*h*, the description will be made of the method for manufacturing the substrate for use of a liquid jet head. In this respect, the processes a to h referred to in the following description correspond to those represented in FIGS. 24*a* to 24*h* and FIGS. 25*a* to 25*h*, respectively.

(Process a)

On the entire upper surface of the elemental substrate 303 where the heat generating elements 302 and the external contact pads are formed among some others, the TiW film is formed by the sputtering method in a film thickness of approximately 5000 Å as the protection layer that protects the external contact pads. Then, on the TiW film, the SiN film is formed by the plasma CVD method in a thickness of approximately 10 μm, and the portion of the SiN film that becomes the second liquid flow paths, and the portions other than the area having the external contact pads formed are patterned by the known photolithographic method or the like for the formation of the pedestals 304. In this respect, the elemental substrate 303 is formed by silicon, and each of the heat generating elements 302 is formed on silicon using the semiconductor manufacturing process.

(Process b)

On the upper surface of the elemental substrate 303 where the pedestals 304 are formed, the Al film is formed by the sputtering method in a thickness of approximately 5 μm. Then, the portions other than those becoming the second flow paths and the circumference thereof are patterned by the known photolithographic method or the like to form the sacrifice layer 332. In this manner, the sacrifice layer 332 is formed to be convex in the state where the circumference thereof runs over the pedestals 304.

(Process c)

On the upper surface of the pedestals 304 and the sacrifice layer 332, the silane coupling agent that becomes the bonding agent 335 is coated in the laminar form.

(Process d)

On the upper surface of the bonding agent 335, the polyparaxylene film is formed by the CVD method in a thickness of approximately 2 μm. Then, this film is removed with above the sacrifice layer 332 and only the pedestal 304 portions on the circumference thereof being left intact, hence producing a plurality of individual separation films 305 which are independent from each other with respect to each of the heat generating elements 302.

(Process e)

On the elemental substrate 303 where the individual separation films 305 are formed, the Al film is formed by the sputtering method. This film is patterned by the known lithographic method or the like to form the etching stop layer 333 which is used when the flow path walls 308, which will be described later, are formed on the individual separation films 305, respectively.

(Process f)

On the elemental substrate 303 where the etching stop layer 333 is formed, the SiN film 334 is formed by the μW-CVD method in a thickness of approximately 50 μm to cover the etching stop layer 333 and the pedestals 304. After that, on the upper surface of the SiN film 334, the Al film is formed by the sputtering method to produce the mask 335 by patterning the portions of this film that become the flow path walls 307 and the liquid chamber frame 308 (see FIG. 21) by the known method, such as photolithography.

(Process g)

From the surface where the mask 335 is produced on the SiN film 334, the excimer laser is irradiated to execute the laser ablation processing for the removal of the portions of the SiN film 334 that become the first liquid flow paths and the common liquid chamber, hence forming the flow path walls 307 and the liquid chamber frame 308. At this juncture, since the etching stop layer 333 is present on the bottom end of those portions of the SiN film 334 which should be removed, the individual separation films 305 are not removed. After that, the etching stop layer 333 and the mask 335 are removed by etching. The area 307*a* of the flow path walls 307 thus produced, which is near the individual separation films, is in the scooped form by the aforesaid etching stop layer 333.

(Process h)

After the $SiO_2$ film is formed on the reverse side of the elemental substrate 303 by the thermal oxidation in a film thickness of approximately 1 $\mu$m, the aperture portions of the supply port and exhaust port are patterned by use of the known method, such as photolithography. Then, on the reverse side of the elemental substrate 303, the circular column-shaped supply port and exhaust port of 10 to 50 $\mu$m diameter are formed by means of the trench structured etching using the dielectric coupling plasma etching apparatus. In this case, the sacrifice layer 332 functions as the etching stop layer. Therefore, the individual separation films 305 are not etched.

Subsequently, the sacrifice layer 332 is removed by use of a mixed solution of phosphoric acid, acetic acid, and hydrochloric acid. Further, the bonding agent 335 is removed to form the second liquid flow paths 314. In this manner, as in the first embodiment, the bonding agent 335 remains intact only on the region which becomes the fixing portion of the movable separation film 305 to the pedestals 304, but not allowed to remain on the movable portions.

In this way, it is possible to obtain the substrate for use of a liquid jet head 301 which is integrally formed with the flow path walls 307 that constitute the first liquid flow paths 312. With the flow path walls 307 that constitute the first liquid flow paths 312 thus provided together for the substrate 301 for use of a liquid jet head, there is no possibility that the position of the first liquid flow paths 312 is not deviated from that of the second liquid flow paths 314, hence making it possible to provided a highly reliable liquid jet head the discharge characteristics of which are rarely caused to fluctuate. Also, the ceiling plate 306 can be formed to be a simple plate. Then, the ceiling plate 306 and the substrate 301 for use of a liquid jet head can be positioned in a precision which is not so rigid as required for the aforesaid first to third embodiments when the ceiling plate and substrate are bonded. As a result, the positioning process of the ceiling plate 306 and the substrate 301 for use of a liquid jet head can be simplified.

As described above, for the present embodiment, the example is shown in which each of the individual separation films 305 having the portion that faces each of the heat generating elements 302, which is formed to be convex toward each of the second liquid flow paths 314 by the utilization of the single-layered sacrifice layer. However, as in the second embodiment, it may be possible to form the sacrifice layers separately in plural times so as to make the distance greater between each of the individual separation films 305 and the heat generating elements 302 or as in the third embodiment, it may be possible to make each of them a flat movable separation film. In these cases, too, if the processes after the process d are executed as described in the present embodiment subsequent to the formation of the movable separation film, it is possible to obtain the substrate for use of a liquid jet head which is formed integrally with the flow path walls.

Also, in accordance with the present embodiment, each movable portion 305*a* of the individual separation films 305 is displaced by a specific amount with a desired bubbling power provided for the movable portion 305*a*, thus discharging a specific amount of liquid droplet from each of the discharge ports 311. If the discharging droplets should be made larger locally for the multiple nozzle arrangement, it should be good enough if only the bubbling power in the corresponding nozzles is made greater to displace (move, expand, or elongate) the corresponding movable portions 305*a* larger. Further, if the size (amount) of each of the discharge droplets is caused to vary even by the application of the same bubbling power, it should be good enough to adjust the bubbling power for each of the movable portions 305*a* of the separation films 305.

Further, in order to provide the liquid jet head capable of discharging larger and smaller dots locally from the multiple nozzles without adjusting the bubbling power or capable of discharging a specific amount of liquid droplets stably without any fluctuation, it is preferable to add the process to distort a desired movable separation film once (to give the permanent distortion within a range where the film is not broken) after the completion of the head mode in the processes shown in FIGS. 24*a* to 24*h* and FIGS. 25*a* to 25*h*. As described in conjunction with the first embodiment, the stress should only be applied to the desired movable separation film in this additional process. As the method for distorting the movable separation film, any method may be adoptable if only it can provide an appropriate permanent distortion for the film.

FIGS. 26*a* to 26*d* are cross-sectional views which illustrate one example of the process in which distortion is given to the movable portion 305*a* of the separation film 305.

Figure 26A:
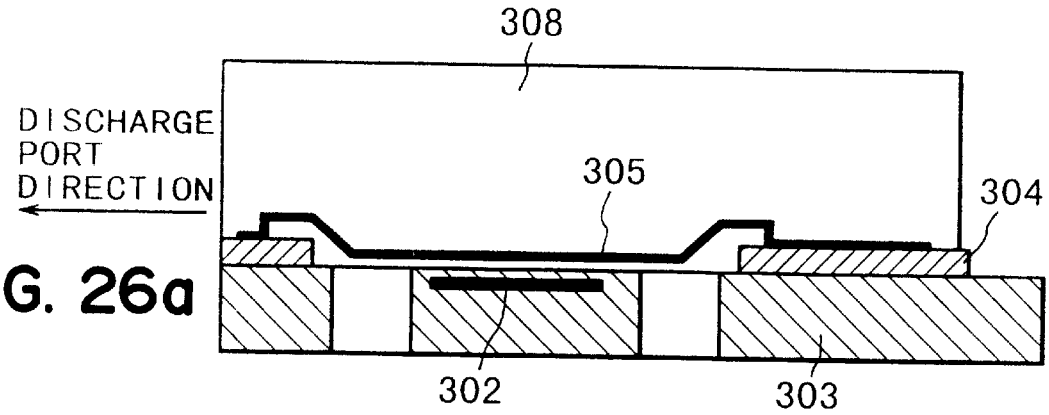
FIGS. 26*a*, 26*b*, 26*c* and 26*d* are cross-sectional views which illustrate the distortion treatment of the separation film additionally applied to the manufacture of the substrate for use of a liquid jet head that constitutes the liquid jet head in accordance with the fourth embodiment of the present invention, taken in the arrangement direction of the heat generating elements.
Figure 26B:
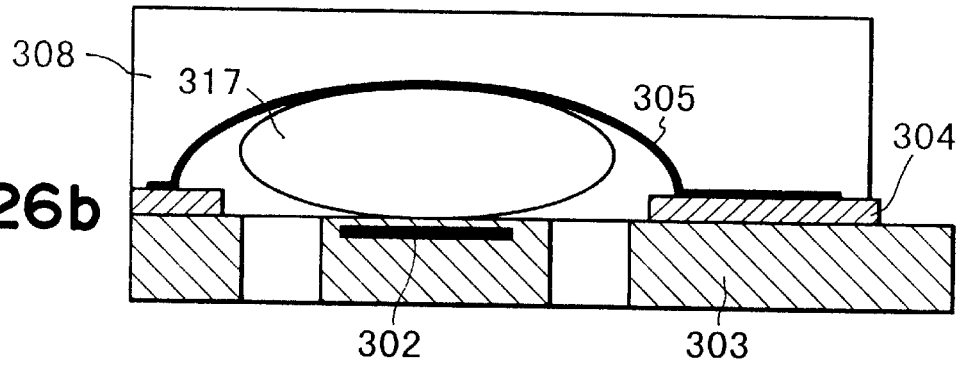
Figure 26C:
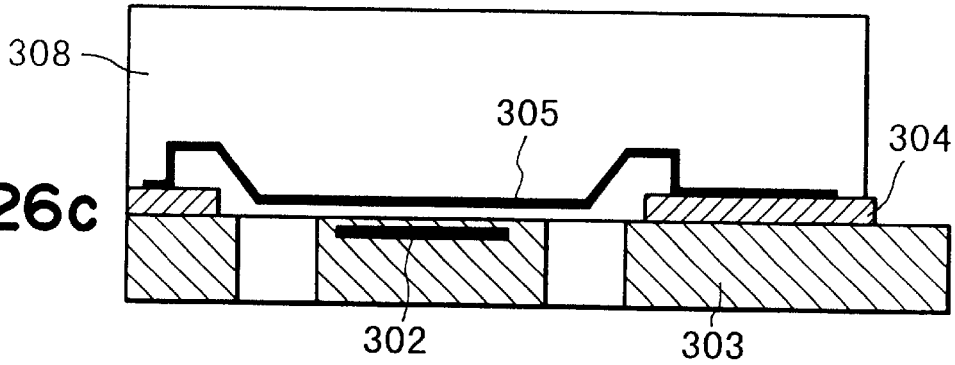
Figure 26D:
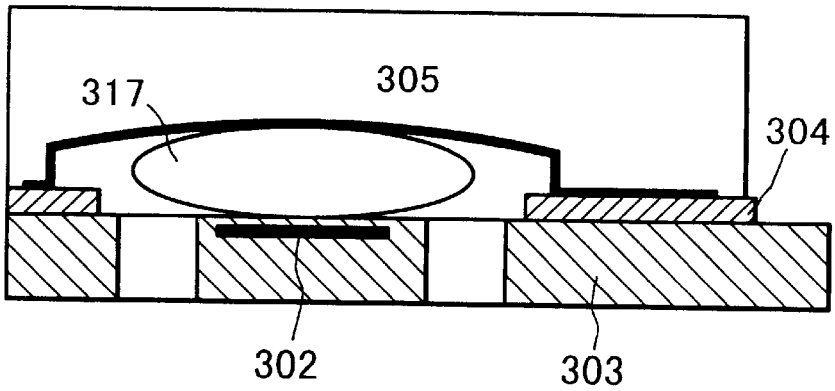

FIG. 26*a* shows the state of the movable separation film after the completion of the head mode in accordance with the processes represented in FIGS. 24*a* to 24*h* and FIGS. 25*a* to 25*h*. Against this movable separation film, bubbling is performed at a k value (1.3) which is higher than the usual k value (1.2). Then, the bubbling power which is higher than the usual one is generated to give stress to the separation film (see FIG. 26*b*). For the control of a desired stress value, it is desirable to provide this stress by means of the development of the bubble 317 that utilizes the nuclear boiling. In this manner, the separation film 305 is distorted to arrive at the plastic region. Then, as shown in FIG. 26*c*, it presents the state where the surface area of the film increases. After that, when the usual bubbling is performed, the separation film is displaced as shown in FIG. 26*d* to continuously maintain the stabilized discharges.

With the distortion processing given to the movable separation film described above, most of the elasticity of this particular movable separation film is eliminated, and part of the bubbling power is not transformed into the energy that causes the film to be stretched. Consequently, for the desired movable separation film in the plastic region, the discharging droplet becomes a larger dot to the extent that part of the bubbling power is not transformed into the energy that causes the film to be stretched, because the film can be displaced larger as compared with the case where it is given the same bubbling power as provided for the other movable separation film in the elastic region. In other word, if the process of giving the permanent distortion to the movable separation film is added, it becomes possible to provide a method for manufacturing a liquid jet head which is capable of changing the discharge droplet from the smaller dot to the larger dot with the same bubbling power which is applied to making the smaller one with respect to a desired movable separation film. Since a head of the kind can discharge larger dots without increasing the bubbling power, it is possible to reduce the power dissipation, leading to making the life of the head longer.

(Other Embodiments)

The description has been made of the embodiments of the principal part of the present invention so far. Now, hereunder, the description will be made of the other embodiments which are applicable to each of the aforesaid embodiments, as well as the other variational examples of each of the embodiments. In this respect, unless specifically stated in the following description, the embodiments that will be described will be applicable to each of the embodiments described above.

(The Fundamental Principle of the Liquid Jet Head Capable of Enhancing the Liquid Discharge Efficiency)

Now, for the liquid jet head that uses such movable separation film as described in accordance with the present invention, the description will be made of the fundamental concept of discharges to enhance the discharge efficiency still more by citing two examples given below.

FIGS. 27*a* to 27*e* and FIGS. 29*a* to 29*c* are views which illustrate the embodiments of the discharge method of the aforesaid liquid jet head. Each discharge port is arranged for the end region of each first liquid flow path. Then, the displacement area of the displaceable movable separation film is present on the upstream side of the discharge port (in the flow direction of the discharge liquid in the first liquid flow path) where the movable separation film is displaced in accordance with the development of the created bubble. Also, each of the second liquid flow paths retains the bubbling liquid or it is filled with the bubbling liquid (preferably, it is filled with the bubbling liquid or more preferably, the bubbling liquid is made movable), and then, each of them is provided with the bubble generating area.

In accordance with the present embodiment, the bubble generating area is also positioned on the upstream side of the discharge port side with respect to the flow direction of the aforesaid discharge liquid. In addition, the separation film is made longer than each of the electrothermal transducing devices that forms each bubbling generating area, and it is provided with the movable region. Here, the separation film is provided with a fixing section (not shown) between the end portion of the electrothermal transducing device on the upstream side and the common liquid chamber of the first liquid flow path, or the fixing section should preferably be arranged on the end portion in the upstream side, with respect to the flow direction described above. Therefore, the essential movable range of the separation film is readily understandable from the representations of FIGS. 27*a* to 27*e*, FIGS. 28*a* to 28*e*, and FIGS. 29*a* to 29*c*.

Each state of the movable separation film in those figures is the element which represents the elasticity and thickness, or all factors related thereto which are obtainable from other additional structures here.

(First Discharge Principle)

FIGS. 27*a* to 27*e* are the cross-sectional views which illustrate a first discharge method in accordance with the liquid jet head of the present invention (when the displacement process of the invention is made available on the way of the discharge process), taken in the flow path direction. For this example, in the first liquid flow path 703 directly communicated with the discharge port 711, the first liquid supplied from the common liquid chamber 743 is filled as shown in FIGS. 27*a* to 27*e*. Also, in the second liquid flow path 704 provided with the bubble generating area 707, the liquid for bubbling use is filled, which is bubbled when thermal energy is given by the heat generating element 702. In this respect, there is arranged the movable separation film 705 between the first liquid flow path 703 and the second liquid flow path 704 to separate the first liquid flow path 703 and the second liquid flow path 704 from each other. Also, the movable separation film 705 and the orifice plate 709 are closely fixed to each other. Consequently, there is no possibility that the liquid in each of the liquid flow paths is mixed.

Here, the movable separation film 705 is not usually provided with any directivity when it is displaced by the creation of bubble in the bubble generating area 707 or rather there is a case where the displacement is made progress toward the common liquid chamber side where the freedom of displacement is higher.

For the present embodiment, attention is given to this movement of the movable separation film 705. Then, with the provision of means for regulating the direction of displacement which acts upon the movable separation film 705 itself directly or indirectly. With such arrangement, the displacement (movement, expansion, elongation, or the like) of the movable separation film 705, which is actuated by bubbling, is directed toward the discharge port.

Figure 27A:
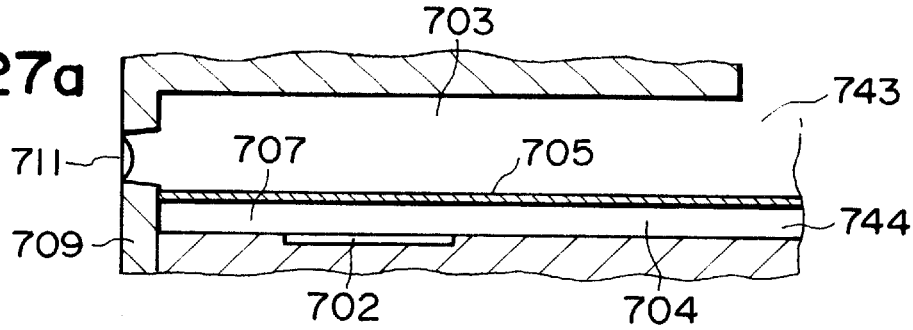
FIGS. 27*a*, 27*b*, 27*c*, 27*d* and 27*e* are cross-sectional views which illustrate the fundamental discharge pattern for the enhancement of the discharge efficiency in accordance with the liquid jet head of the present invention taken in the direction of the flow paths.

In the initial stage shown in FIG. 27*a*, liquid in the first liquid flow path 703 is withdrawn up to the vicinity of the discharge port 711 by means of the capillary force. Here, in accordance with the present embodiment, the discharge port 711 is positioned on the downstream side in the liquid flow in the first liquid flow path 703 with respect to the projection area of the heat generating element 702 to the first liquid flow path 703.

Figure 27B:
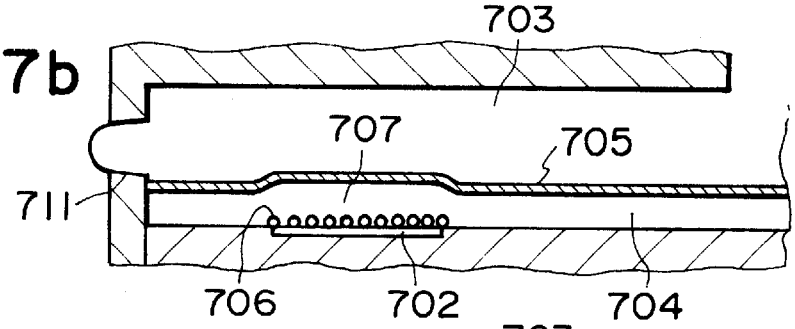

In this state, when thermal energy is applied to the heat generating element 702 (which is the heat generating resistive element in a form of 40 $\mu$m×105 $\mu$m in accordance with the present embodiment), the heat generating element 702 is rapidly heated so that the surface of the bubble generating area 707 which is in contact with the second liquid is heated to bubble the second liquid (FIG. 27*b*). The bubble 706 thus created by this bubbling caused by heating is the bubble based upon the film boiling phenomenon disclosed in the specification of U.S. Pat. No. 4,723,129, which is created at all over the entire surface of the heat generating element at once with an extremely high pressure to follow. The pressure thus exerted at that time is propagated as the pressure waves in the second liquid in the second liquid flow path 704 to act upon the movable separation film 705. In this manner, the movable separation film 705 is displaced to initiate making the discharge of the first liquid in the first liquid flow path 703.

Figure 27C:
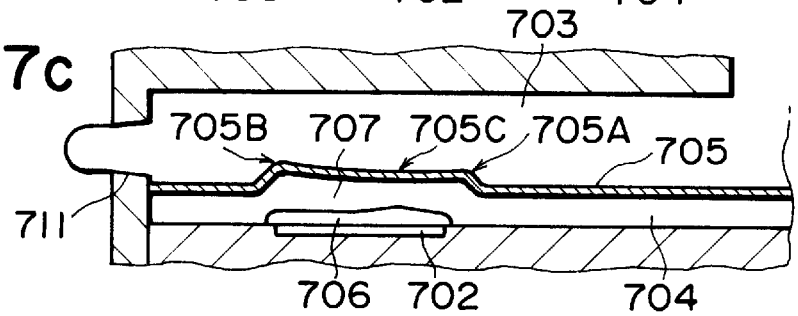

When the bubble 706 created on the entire surface of the heat generating element 702 is developed rapidly, this bubble presents the film state (FIG. 27*c*). The expansion of the bubble 706 caused by the extremely high pressure at the initial stage of bubble creation enables the movable separation film 705 to further displace. Then, the discharge of the first liquid from the discharge port 711 is promoted in the first liquid flow path 703.

Figure 27D:
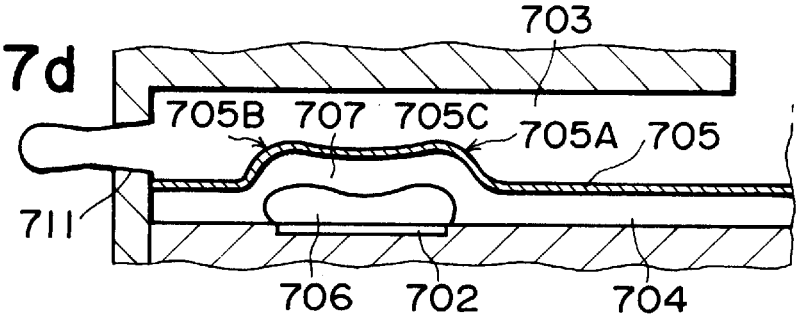

After that, when the development of the bubble 706 is further developed, the displacement of the movable separation film 705 becomes greater (FIG. 27*d*). Here, up to the state shown in FIG. 27*d*, the movable separation film 705 is being expanded so that the displacement on the upstream side at 705A and the displacement on the downstream side at 705B are made substantially equal with respect to the central portion of the movable separation film 705 at 705C which faces the heat generating element 702.

After that, when the bubble 706 is developed further still, the bubble 706 and the movable separation film 705 which displaces continuously are caused to displace relatively larger toward the discharge port on the downstream side at 705B than the upstream side at 705A, respectively. In this manner, the first liquid in the first liquid flow path 703 is directly moved in the discharge port 711 direction (FIG. 27*e*).

Thus, with the process in which the movable separation film 705 is displaced in the discharge direction on the downstream side so as to move liquid directly toward the discharge port, the discharge efficiency is enhanced still more. Further, the movement of liquid toward the upstream side which becomes relatively small may contribute to effectively functioning the liquid refilling (supply from the upstream side) particularly into the displacement area of the movement separation film 705 in the nozzle.

Figure 27E:
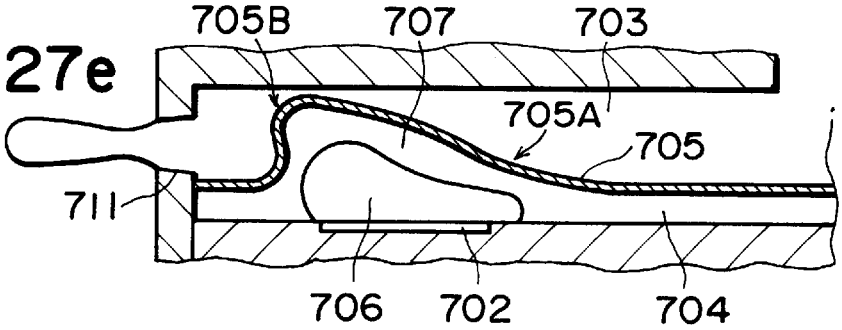

Also, as shown in FIG. 27*d* and FIG. 27*e*, when the movable separation film 705 itself is displaced toward the discharge port with the changes represented in FIG. 27*d* and FIG. 27*e*, it becomes possible to enhance the discharge efficiency and the refilling efficiency still more as described above, at the same time, effectuating the carrier movement of the first liquid in the projection area of the heat generating element 702 toward the discharge port in the first liquid flow path 703. In this way, the enhancement of the discharge amount can be implemented.

(Second Discharge Principle)

FIGS. 28*a* to 28*e* are the cross-sectional views which illustrate a second discharge method in accordance with the liquid jet head of the present invention, taken in the flow path direction (that is, the example in which the displacement process of the invention is effectuated from the initial stage of the discharge process). Since this example also presents the same structure as the first discharge principle fundamentally, the same reference marks are applied in the description thereof.

Figure 28A:
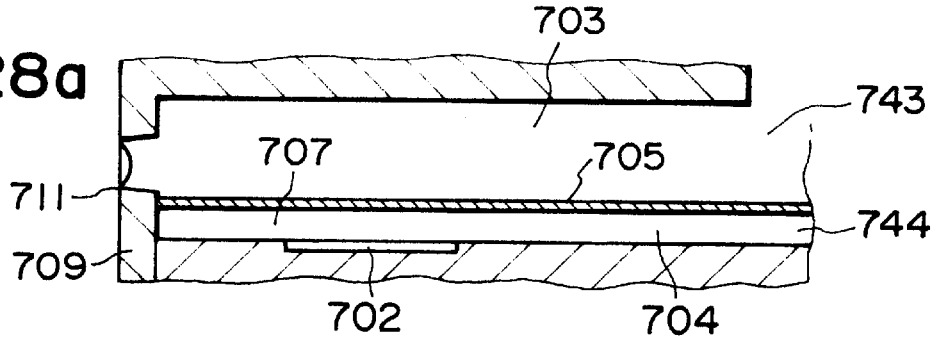
FIGS. 28*a*, 28*b*, 28*c*, 28*d* and 28*e* are cross-sectional views which illustrate the fundamental discharge pattern for the enhancement of the discharge efficiency in accordance with the liquid jet head of the present invention taken in the direction of the flow paths.

In the initial stage shown in FIG. 28*a*, liquid in the first liquid flow path 703 is withdrawn up to the vicinity of the discharge port 711 by means of the capillary force as in FIG. 27*a*. Here, in accordance with the present embodiment, the discharge port 711 is positioned on the downstream side in the liquid flow in the first liquid flow path 703 with respect to the projection area of the heat generating element 702 to the first liquid flow path 703.

Figure 28B:
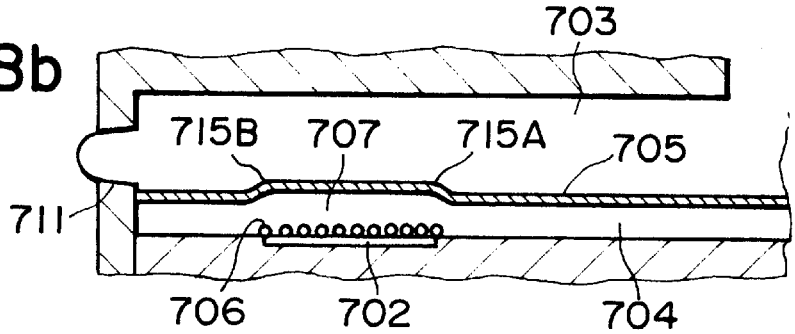

In this state, when thermal energy is applied to the heat generating element 702, the heat generating element 702 is rapidly heated so that the surface of the bubble generating area 707 which is in contact with the second liquid is heated to bubble the second liquid (FIG. 28*b*). The pressure exerted at that time is propagated as the pressure waves in the second liquid in the second liquid flow path 704 to act upon the movable separation film 705. In this manner, the movable separation film 705 is displaced to initiate making the discharge of the first liquid in the first liquid flow path 703.

Figure 28C:
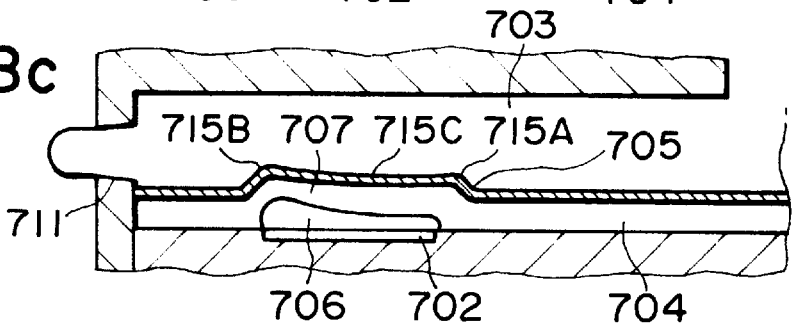

When the bubble 706 created on the entire surface of the heat generating element 702 is developed rapidly, this bubble presents the film state (FIG. 28*c*). The expansion of the bubble 706 caused by the extremely high pressure at the initial stage of bubble creation enables the movable separation film 705 to further displace. Then, the discharge of the first liquid from the discharge port 711 is promoted in the first liquid flow path 703. At this juncture, as shown in FIG. 28*c*, the movable separation film 705 is displaced in the movable region relatively larger on the downstream side at 715*b* than the upstream side at 715A from the initial stage. In this manner, the first liquid in the first liquid flow path 703 is allowed to move efficiently toward the discharge port 711 from the initial stage.

Figure 28D:
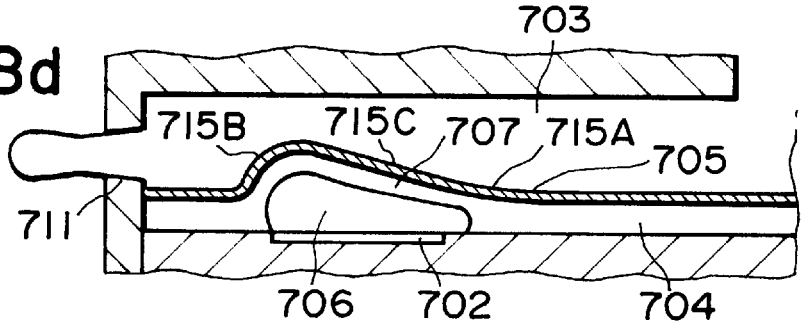

After that, when the development of the bubble 706 is further developed, the displacement of the movable separation film 705 and the development bubble are promoted from the state shown in FIG. 28*c*, along with which the displacement of the movable separation film 705 becomes greater (FIG. 28*d*). Particularly, the downstream side of the movable region at 715B is displaced greater still in the discharge port direction than the upstream side at 715A and the central portion at 715C. As a result, the first liquid in the first liquid flow path 703 is accelerated directly to move in the discharge port direction. At the same time, the liquid movement in the upstream direction becomes smaller because the displacement on the upstream side at 715A is smaller in the entire process.

Therefore, it becomes possible to enhance the discharge efficiency, particularly, to enhance the discharge speed, at the same time, advantageously stabilizing the refilling of liquid in nozzles, and the volume of discharging liquid droplets as well.

Figure 28E:
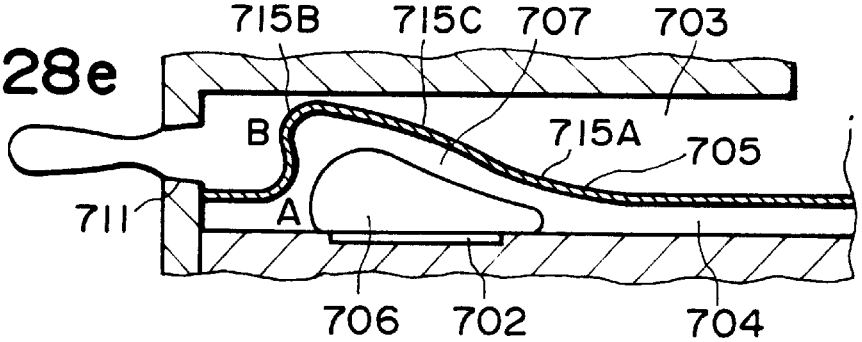

After that, when the bubble 706 is developed further still, the movable separation film 705 is further displaced and expanded in the discharge port direction on the downstream side at 715B and the central portion at 715C, hence producing the aforesaid effect, that is, the enhancement of the discharge efficiency and discharge speed is attempted (FIG. 28*e*). Particularly in this case, the movable separation film 705 is displaced and expanded larger not only in the sectional configuration as its shape, but also, it is displaced and expanded in the wide direction of the liquid flow path. Therefore, the activation region becomes greater to move the first liquid in the first liquid flow path 703 in the discharge port direction, hence making it possible to enhance the discharge efficiency synergetically. Particularly, the displaced configuration of the movable separation film 705 at that time resembles the nose of human being. Thus, this displacement state is called "nose shape". Here, it is assumed as shown in FIG. 28*e* that this nose shape includes the S-letter shape where the point b positioned on the upstream side in the initial state is caused to be positioned on the downstream side than the point A which is positioned on the downstream side in the initial state, and the shape where the points A and b are positioned equally as shown in FIG. 27*c*.

(Embodiments of the Movable Separation Film Displacement)

Figure 29A:
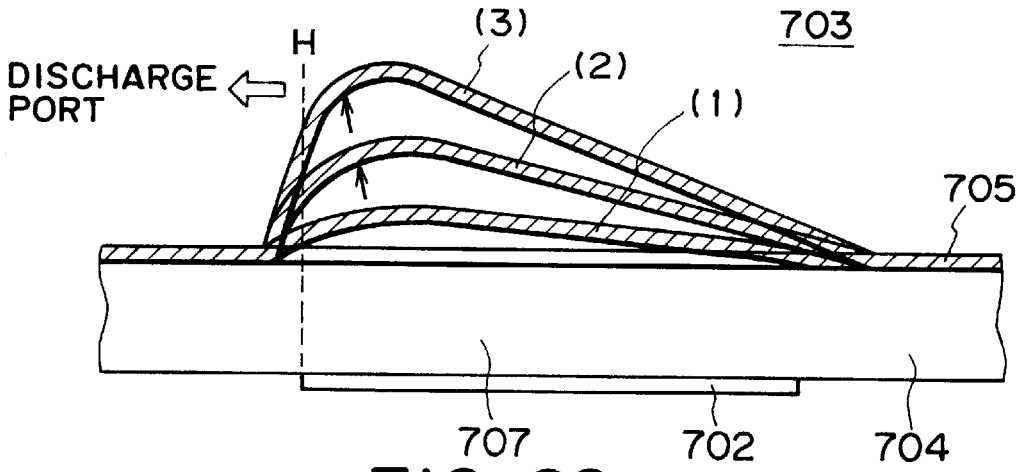
FIGS. 29*a*, 29*b* and 29*c* are views which illustrate the displacement process of the movable separation film for the enhancement of the discharge efficiency in accordance with the liquid jet head of the present invention, taken in the direction of the flow paths.
Figure 29B:
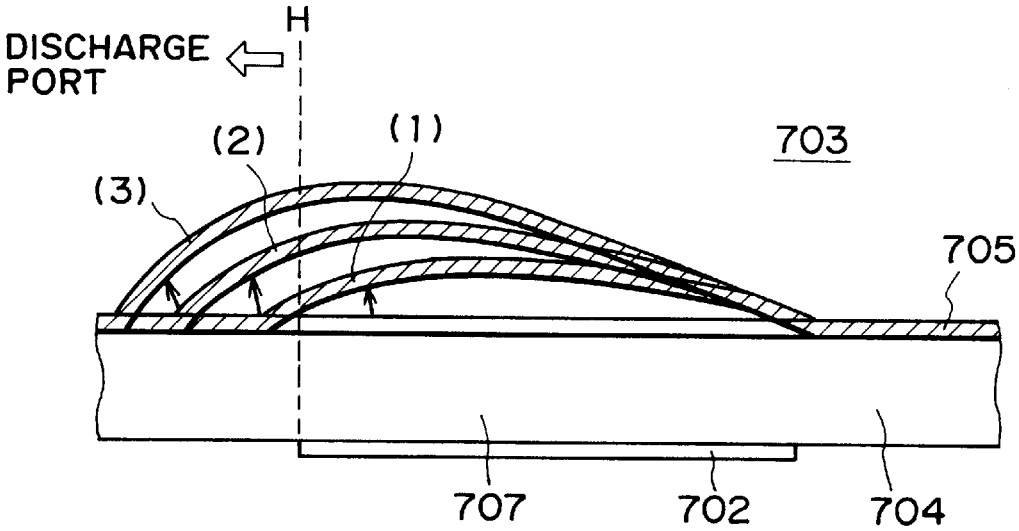
Figure 29C:
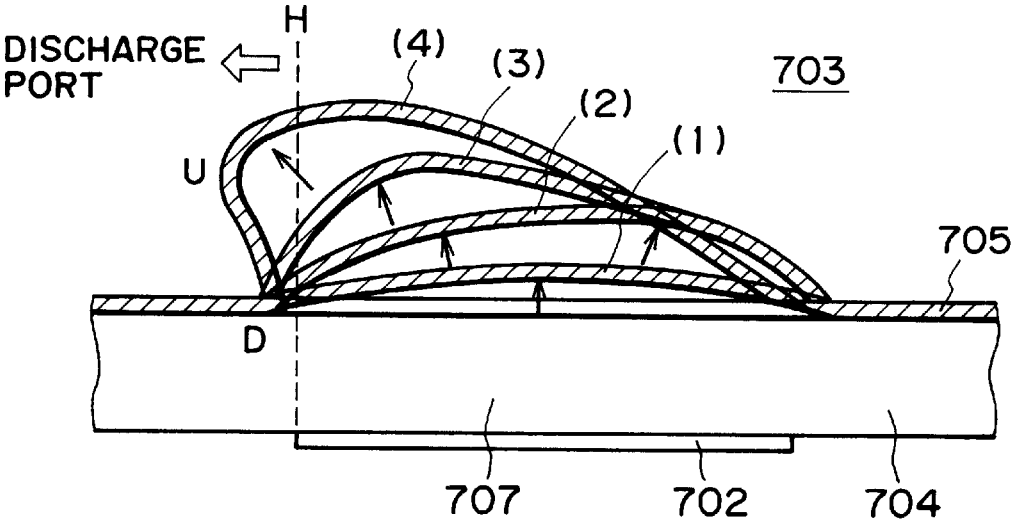

FIGS. 29*a* to 29*c* are cross-sectional views which illustrate the displacement process of the movable separation film at the time of discharge operation of the liquid jet head in accordance with the present invention.

In this respect, the description will be made with particular attention given to the movable range and the change of displacements of the movable separation film. Therefore, any representations of the bubble, the first liquid flow path, and the discharge port will be omitted. However, any of FIGS. 29*a* to 29*c*, the structure is the fundamental one, and of the second liquid flow path 704, the portion which is near the projection area of the heat generating element 702 is the bubble generating area 707, and the second liquid flow path 704 and the first liquid flow path 703 are always separated by the movable separation film 705. In other words, these flow paths are essentially separated during the period of displacement from its initiation. Also, on the downstream side with the end portion of the heat generating element 702 on the downstream side (at H line in FIGS. 29*a* to 29*d*) being boundary, there are provided the discharge port, and on the upstream side, the supply unit of the first liquid, respectively. Here, from now on, the terms "upstream side" and "downstream side" are meant to be the respective sides in the direction of liquid flow in the flow path, observed from the central portion of the movable range of the movable separation film.

Now, the one shown in FIG. 29*a* is such that the movable separation film 705 is being displaced in the order of (1), (2), and (3) from the initial state, which is provided with the process in which the downstream side is displaced larger than the upstream side from the initial state. Particularly, the discharge efficiency is enhanced, and at the same time, it is activated to generate the movement of the displacement on the downstream side to push out the first liquid in the first liquid flow path 703 in the discharge port direction. Therefore, the enhancement of the discharge speed can be attempted. Here, in FIG. 29*a*, the aforesaid movable region is substantially made specific.

For the one shown in FIG. 29*b*, as the movable separation film 705 is being displaced in the order of (1), (2), and (3), the movable range of the movable separation film 705 is shifted or expanded to the disport port side. In this mode, the upstream side of the aforesaid movable range upstream side is fixed. Here, the downstream side of the movable separation film 705 is displaced greater than the upstream side, and at the same time, the development of the bubble itself can be developed in the discharge port direction, hence making it possible to enhance the discharge efficiency still more.

For the one shown in FIG. 29*c*, the movable separation film 705 is displaced with the upstream side and the downstream side being equal or with the upstream side being slightly larger form the initial state (1) up to the state (2) shown in FIG. 29*c*. However, when the bubble is developed further to the states (3) to (4) shown in FIG. 29*c*, the downstream side is displaced later than the upstream side. In this manner, the first liquid residing on the upper part of the movable region can be moved in the discharge port direction to enhance the discharge efficiency, at the same time, increasing the discharge amount.

Further, in the process (4) shown in FIG. 29*c*, the point U where the movable separation film 705 resides is displaced to the discharge port side than the point D which is positioned more on the downstream side in the initial state. Therefore, with this expanded portion that extrudes to the discharge port side, the discharge efficiency is enhanced still more. Here, this shape is called the "nose shape" described earlier.

The present invention includes a liquid discharge method of the kind described above. However, any one of those shown in FIGS. 29*a* to 29*c* is not necessarily independent. It is construed that the process that may contain any one of the respective components is included in the scope of the present invention. Also, it is possible not only to introduce the process that includes the formation of the "nose shape" into the one sown in FIG. 29*c*, but also, into those shown in FIGS. 29A and 29*b*. Also, there is no particular meaning as to the thickness of the movable separation film represented on each of FIGS. 29*a* to 29*c*.

(Liquid Jet Head Cartridge and Liquid Jet Recording Apparatus)

Now, in conjunction with FIG. 30 and FIG. 31, the description will be made of the liquid jet head cartridge having mounted on it the liquid jet head embodying the present invention, and the liquid jet recording apparatus as well.

Figure 30:
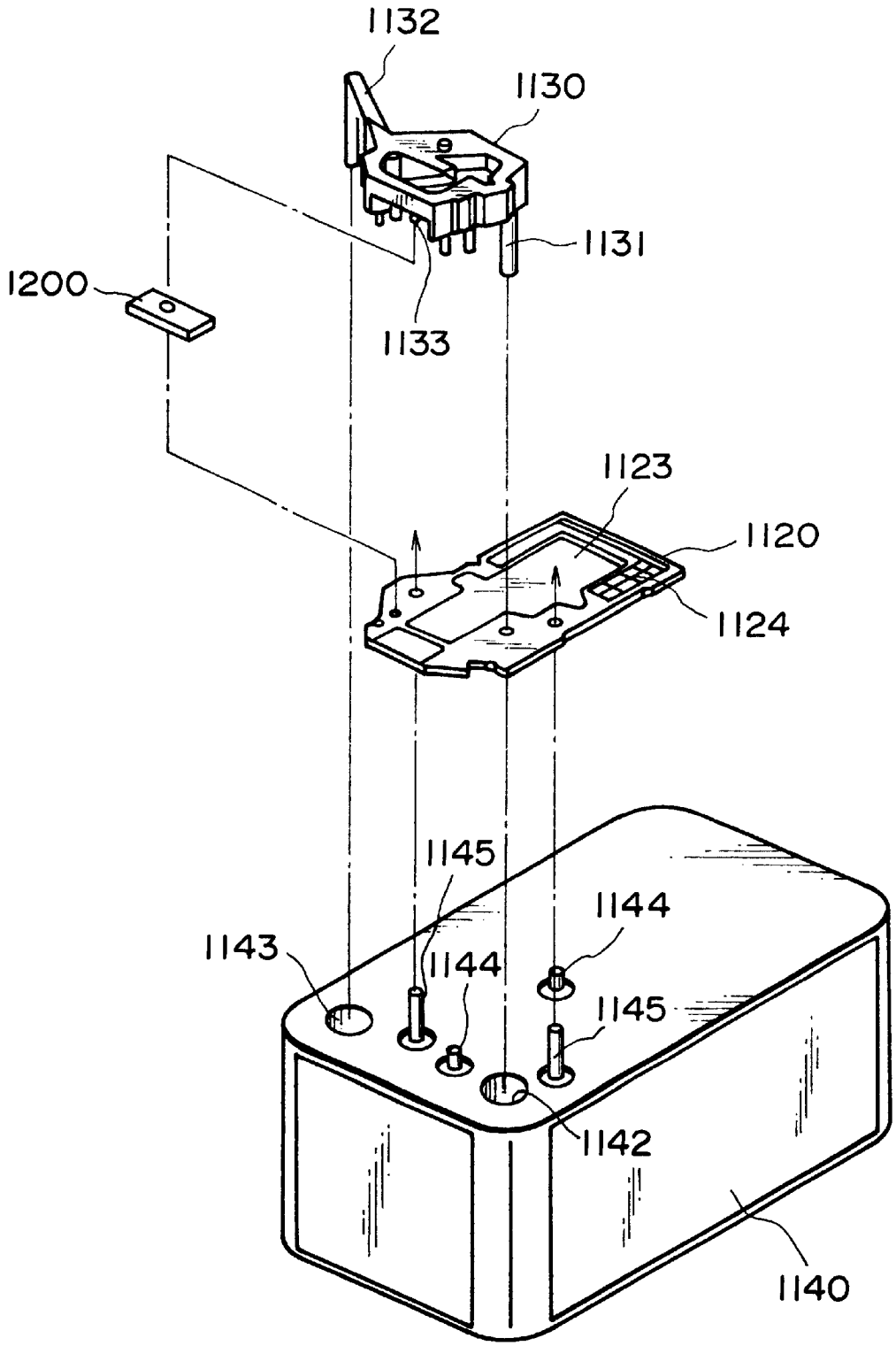
FIG. 30 is an exploded perspective view which shows the liquid jet head cartridge to which the present invention is applicable.

FIG. 30 is an exploded perspective view which schematically shows the liquid jet head cartridge having the liquid jet head described earlier included briefly, the liquid jet head cartridge is mainly structured with the liquid jet head unit and the liquid container 1140.

The liquid jet head unit comprises the aforesaid liquid jet head 1200; the liquid supply member 1130; and the aluminum plate (supporting member) 1120, among some others. The supporting member 1120 is to support the liquid jet head 1200 and others, and on the supporting member 1120, there are arranged the printed-circuit board 1123 connected with the liquid jet head 1200 to supply electric signals; and the contact pads 1124 through which electric signals are exchanged with the apparatus side when the pads are connected with the apparatus side.

The liquid container 1140 contains liquid to be supplied to the liquid jet head 1200. On the outer side of the liquid container 1140, there are arranged the positioning member 1144 for the arrangement of the connecting member to connect the liquid jet head and the liquid container 1140, and the fixing shaft 1145 to fix the connecting member. Liquid is supplied from the liquid supply paths 1142 and 1143 of the liquid container 1140 to the liquid supply paths 1131 and 1132 of the liquid supply member 1130 through the supply paths of the connecting member, and then, supplied to the common liquid chamber of the liquid jet head 1200 through the liquid supply paths 1132, 1129, and 1153*c* of each of the members. Here, the liquid supply from the liquid container 1140 to the liquid supply member 1130 is made by two passages. However, it is not necessarily required to arrange the separate passages.

In this respect, the liquid container 1140 may be used again after refilling liquid after the consumption thereof. For that purpose, it is desirable to arrange the liquid injection port for the liquid container 1140. Also, it may be possible to arrange the liquid jet head unit and liquid container 1140 integrally as one body or it may be possible to arrange them separately.

Figure 31:
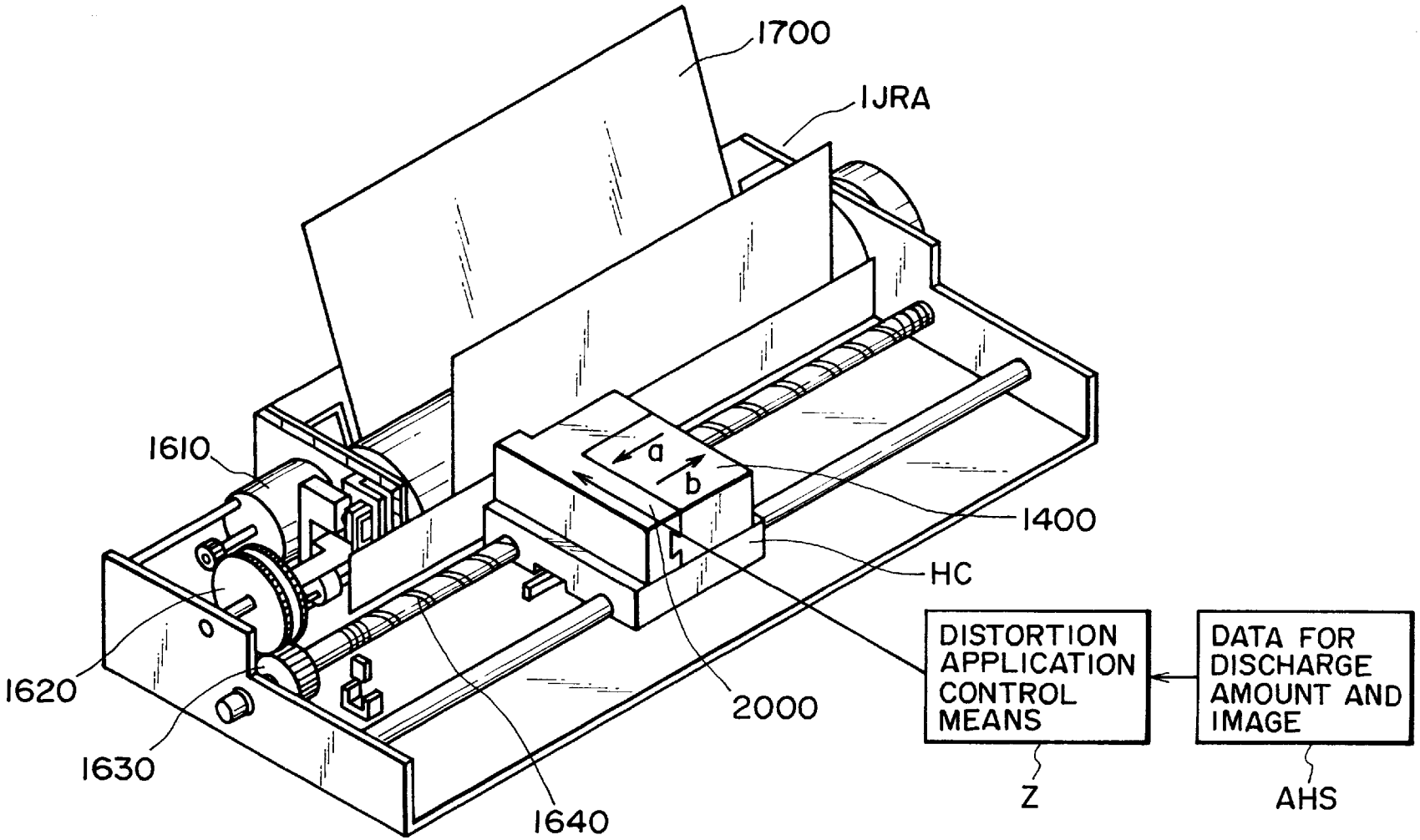
FIG. 31 is a view which schematically shows the liquid jet apparatus to which the present invention is applicable.

FIG. 31 is a view which schematically shows the structure of the liquid jet apparatus having the aforesaid liquid jet head mounted on it. For the present embodiment, the description will be made of an ink jet recording apparatus IJRA that uses ink in particular as the discharge liquid. The carriage HC of the liquid jet apparatus mounts the head cartridge which can detachably mount the liquid jet head unit 2000 and the liquid container 1400 that contains ink, which reciprocates in the width direction (directions indicated by arrows a and b) of the recording medium 170 which a recording paper sheet to be carried by recording medium carrying means. Here, the structure is arranged so that the liquid container and the liquid jet head unit are separable from each other.

In FIG. 31, when driving signals are supplied from driving signal supplying means (not shown) to liquid discharging means on the carriage HC, the recording liquid is discharged from the liquid jet head 2000 to the recording medium 1700 in accordance with the driving signals.

Also, for the liquid jet apparatus of the present embodiment, there are arranged the motor 1610 that serves as the driving source to drive the recording medium carrying means and the carriage HC; gears 1620 and 1630 for transmitting the driving power of the driving source to the carriage HC; and the carriage shaft 1640. With this recording apparatus, it is possible to obtain recorded objects having good images by discharging liquid to each of various recording media.

The apparatus shown in FIG. 31, which embodies the present invention, is arranged to essentially sag the organic film by providing the organic film with the permanent distortion. For the specific example thereof, the amount of discharges is made equal by uniformalizing the amount of distortion of all the films at the time of manufacture or as described in conjunction with FIGS. 11*a* to 11*d*, only the amount of distortion of the organic separation film is adjusted at least for a specific portion in order to correct the variation of discharge amounts as to the first liquid flow path at the time of manufacture, among some others. As shown in FIGS. 12*a* to 12*c*, in the initial state of recording or on the way thereof, the amount of permanent distortion provided for the organic separation film is adjusted in the initial state manually or automatically in accordance with the amount of discharges for the actual recording or the images to be recorded, and then, by means AHS or the like for adjusting the amount of discharges, the amount of discharges can be adjusted by providing distortion for the selected separation organic films by use of control means Z for applying distortion for the formation of bubble equivalent to the amount of applied distortion which is set in advance.

(The Preferable Technical Views of the Separation Film)

With the present invention, the polyparaxylene (hereinafter referred to as PPX) separation film used for the first to fourth embodiments may be applicable to the other liquid jet head having the separation film other than the one embodying the present invention. On this basis, the present invention has found the resultant condition which is preferable in applying the aforesaid separation film. Particularly, with the studies on the properties of the PPX, the new practical knowledge (particularly as to the decomposition temperature of the organic film) has been obtained as given below.

Here, in the following description, the phrase "on the surface layer of the heat generating element" is used as the one which indicates the surface of the film on the uppermost layer when the protection film which protects the heat generating element, and the cavitation proof film are formed on the surface of the elemental substrate or which indicates the surface of the heat generating element if such protection film is not provided. In other words, this phrase is used to indicate the portion where the bubble is created by the application of heat generated by the heat generating element on the elemental substrate.

(The Relationship Between the Movable Separation Film and the Surface Layer Temperature of the Heat Generating Element)

In the general case of the usual color ink, the film boiling for use of the creation of bubble may bring about the case where the initial temperature of bubbling is the temperature obtainable by the abrupt temperature rise (for example, 300° C. or more on the surface layer of the heat generating element. In practice, 350° C. or more), and then, it arrives at the maximum temperature of as high as approximately 600° C. on the surface layer of the heat generating element at the time of bubbling in some cases). This temperature is arrived at in the period of time of μsec order, and it does not last long. Then, at the time of the bubble defoaming, the temperature on the surface layer becomes approximately 180° (in practice, approximately 200° C.).

When the separation film is used under such condition, there may be some cases where the characteristics of the separation film is locally deteriorated unexpectedly or some portion thereof may be broken. With the studies being made to find the causes that may bring about such damages, the preferable condition required for the separation film has found at last.

In other words, when the movable separation film is formed by accumulating organic material by means of the gas phase reaction or plasma polymeric reaction method or the like, it should be good enough if the thermal decomposition temperature in the reaction process of the movable separation film is higher than the conditional temperature which may affect the movable separation film. Also, in a period of time which is as short as several tens of μsec to several minutes order, there is no particular consideration which should be given even if the temperature of the movable separation film becomes temporarily higher than the fusion point of the movable separation film (which is lower than the thermal decomposition temperature).

Therefore, the relationship between the separation film and the temperature on the surface layer of the heat generating element, which is given at the time of discharge, may sometimes present the cases as given below. The following is the condition which may effectively cope with such cases.

(1) At the Time of Single Discharge Operation

At first, consideration is given to the case where one liquid droplet should be discharged at the initial state (or the case where a discharge operation is continued at along interval to the next discharge (several tenth of ms to several seconds or more, for example).

At this juncture, it is unnecessary to consider the influence that the temperature of the surface layer of the heat generating element may exert directly or indirectly on the movable separation film, because the movable separation film is usually fixed to the second flow path walls during the period from the bubbling initiation to the bubble development, and it is away from the surface layer of the heat generating element in a specific distance through liquid (bubbling liquid).

However, with the liquid having been discharged from the discharge port and the bubble being defoamed, the movable separation film is caused to approach the surface layer of the heat generating element more or assumed to be in contact with it. In this case, after defoaming, the movable separation film tends to return to the initial state immediately by the refilling of the bubbling liquid or the like. Therefore, it should be good enough if only an instantaneous resistance to heat.

Therefore, if the thermal decomposition temperature of the material used for the separation film should be higher than the temperature of the surface layer of the heat generating element at the time of defoaming, there is no possibility that the movable separation film is decomposed even when the movable separation film is in contact with the surface layer of the heat generating element.

(2) At the Time of a Continuous Discharge Operation

Now, the consideration is given to the case where a discharge operation is continuously made at interval of several tens to several hundredth of μsec. When the interval between the discharge operations becomes short like this, a fear should be taken into consideration that the movable separation film may adhere to the surface layer of the heat generating element at the time of initiating bubbling rather than at the time of defoaming as far as the refilling of the bubbling liquid is performed so that a desired amount of the bubbling liquid resides on the bubble generating area as required.

In this case, if an extremely fine bubble is created by heating of the heat generating element, the bubble resides between the movable separation film and the surface layer of the heat generating element, and the surface layer of the heat generating element and the separation film is not allowed to approach closer than at the time of initiating bubbling as far as the bubble is being developed.

Therefore, it should be good enough if only the consideration is given to the temperature of the surface layer of the heat generating element at the time of initiating bubbling. Also, since the period of time during which the movable separation film is in contact with the surface layer of the heat generating element is extremely short as described above, there is no possibility that the movable separation film is decomposed even if the movable separation film should be in contact with the surface layer of the heat generating element as at the time of defoaming described earlier, provided that the thermal decomposition temperature of the material used for the movable separation film is higher than the temperature on the surface layer of the heat generating element at the time of initiating bubbling.

Also, under the circumstances where the continuous discharge operation is made for a period of as long as several minutes to several tenth of minutes, the consideration should be given not only to the condition at the time of initiating bubbling, but also, to the maximum temperature on the surface layer of the heat generating element in some cases. In such a case, it is preferable to attach importance to the possibility that the movable separation film is subjected to the thermal decomposition even if it is anticipated that there is no sufficient radiation of the liquid jet head due to the continuous discharge operation.

In other words, the temperature of the liquid jet head does not exceed the maximum temperature on the surface layer of the heat generating element at the time of bubbling as described earlier. Therefore, as far as the temperature at which the movable separation film is thermally decomposed is made higher than the maximum temperature on the surface layer of the heat generating element, there is no fear that the movable separation film is thermally decomposed.

(3) At the Time of Abnormal Operation

Now, the case will be discussed where an abnormal operation takes place on the bubble generating area in the second liquid flow path, such as the bubbling liquid becoming short (or absent) due to the insufficient refilling of the bubbling liquid or the like.

In this case, a fear increases that the movable separation film arranged for the corresponding nozzle is caused to adhere to the surface layer of the heat generating element, and at the same time, the phenomenon that liquid is not discharged from the corresponding discharge port may appear eventually.

Usually, the liquid jet head or the liquid jet recording apparatus having the head mounted on it is provided with a detection unit to detect non-discharges. Then, based on the result of such detection, it is possible to restore the bubbling liquid flow path (and, if necessary, the discharge liquid flow path) to the normal state by use of known recovery means.

If a recovery means of the kind is provided, the condition that may be required for the film is different depending on the time that may elapse before the recovery operation is executed after such abnormal condition occurs or depending on the amount of the bubbling liquid currently residing on the bubble generating area.

For example, if the aforesaid recovery operation is performed within a period of approximately several tens of seconds or several minuets after the abnormal condition occurs, there is no need for considering the fusion point of the movable separation film. The attention should be given only to the temperature of the thermal decomposition thereof.

However, if the case is such that the movable separation film is left intact while it adheres to the surface layer of the heat generating element at the time of defoaming without refilling the bubbling liquid or the state where the movable separation film often contacts the surface layer of the heat generating element at the time of defoaming may last as long as several tens of minutes due to the insufficient refilling of the bubbling liquid at the time of the continuous discharge operation as described earlier, it is preferable to attach importance to the higher fusion point of the movable separation film than the surface layer temperature of the heat generating element at the time of defoaming.

On the other hand, in a case where almost no bubbling liquid resides on the bubble generating area continuously for a period of as long as several tens of minutes or more, it is preferable to attach importance to the higher fusion point of the movable separation film than the surface layer temperature of the heat generating element at the time of initiating bubbling.

(The Examples of PPX)

The inventors hereof have given attention to the PPX as the material that may satisfy the aforesaid relationship between the movable separation film and the surface layer temperature of the heat generating element.

Here, the fundamental structure of the PPX used for the present invention, the method of manufacture and the method of polymerization thereof have been disclosed in each of the publications referred to each of the embodiments described above. More specifically, these are defined in accordance with the following chemical formulas (A) to (F) (where the n is an integer of 5000 or more), and each of them may be used individually or in combination:

(A)

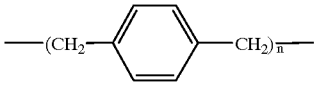

(B)

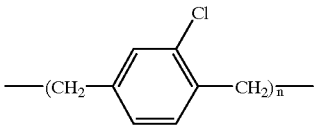

(C)

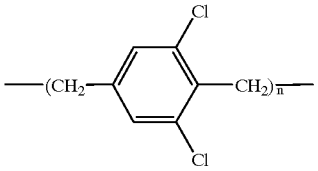

(D)

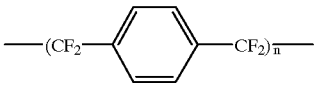

(E)

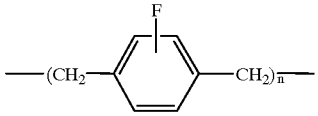

(F)

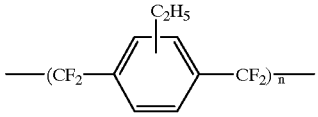

Further, as the characteristics of PPX that may be shared by them, the following points can be cited:

The PPX does not contain any ion impurities. Then, the approximate degree of its crystallization is 60%, and it is a highly pure crystalline polymer of approximately 500,000 molecular weight. It is also excellent in water repellency and gas barrier capability. Also, it is indissoluble against any organic solvents at a temperature of 150° C. or less, and presents resistance to most of all acids, alkali or other eroding liquids. Also, it has an excellent stability against the repeated displacement. Further, it is easier to control the thickness precisely at the time of film formation to make it possible to form the film just matching the configuration of the target object. At the same time, depending on the target object, it is possible to form the film without pin holes even in a thickness of 0.2 μm. Moreover, it presents an excellent bonding stability to the target object after the film formation thereof, because no mechanical stress due to the effect stress against the target object or no thermal stress due to the thermal distortion is added to the film thus formed.

Now, with the material expressed by the chemical formula (A), (B), or (C), the substrate for use of a liquid jet head integrally provided with the movable separation film is manufactured by the method in accordance with the first embodiment described in conjunction with FIGS. 5*a* to 5*e*. (However, the vapor polymerization method is adopted for the film formation itself of the movable separation film, and for the sacrifice layer, an appropriate material (such as Al) is selected so that the selection ratio is provided for the movable separation film and the elemental substrate by the etching rate of the applied solvent.) Then, the orifice plate is bonded to manufacture the liquid jet head by use of the ceiling plate having the liquid flow paths together and the bonding agent as sown in FIG. 4.

After that, each of the physical properties and fundamental characteristics, as well as the properties with respect to the vapor deposition at the time of film formation, are examined with the results shown in the Table 1 as follows:

TABLE 1

| Sample | A (Chemical formula (A)) | B (Chemical formula (B)) | C (Chemical formula (C)) |
|---|---|---|---|
| Fusing point | 405° C. | 280° C. | 350° C. |
| Property | •Colorless and transparent<br>•Excellent in permeability into small gaps<br>•Coated film softer<br>•Excellent in electric characteristics<br>•Presentation of specific dielectric characteristic in each frequency region<br>•High insulation | •Colorless and transparent<br>•Excellent in the prevention of water vapor and gas permeation<br>•Capability of forming a thin film without pin holes<br>•Excellent in electric characteristics | •Colorless and transparent<br>•Coated film slighter harder<br>•Excellent resistance to chemicals<br>•Excellent resistance to heat |
| Deposition | Slightly slow | Good | Not very good |

One example of the thermal decomposition temperature of these samples is 680° C., but any one of them is approximately 700° C. The thermal decomposition temperature thereof is all higher than the temperature on the surface layer of the heat generating element at the time of initiating the film boiling, at the time of defoaming, or the maximum temperature of the surface layer of the heat generating element. Also, the fusion point of any one of the samples is higher than the surface layer temperature of the heat generating element at the time of defoaming. Here, the comparison between the fusion point of each sample and the surface layer temperature of the heat generating element at the time of initiating film boiling is such that the fusion point of each of the samples A and C is higher than the surface layer temperature of the heat generating element at the time of initiating film boiling.

The liquid jet head that uses the aforesaid material for the movable separation film for it demonstrates the significant increase of the frequency of liquid droplets at each of the nozzles thereof, and also, the durability of the head is enhanced as compared with the liquid jet head that uses polyimide or some other known organic material for its movable separation film. It has also been confirmed that such liquid jet head can be recovered to the normal state immediately by the recovery process when any non-discharge is detected. There is observed no corrosion due to ink, either.

In this respect, when the aforesaid separation film is used, the substrate for use of a liquid jet head and the ceiling plate are both formed by silicon material. Therefore, the head thus produced is excellent in heat radiation, which may contribute to producing the effect that the life of the aforesaid head is made longer still.

Here, in conjunction with the chemical formulas (G) to (I), the vapor deposition of the PPX film in the aforesaid manufacturing process will be described supplementarily.

Each of the following chemical formulas (G) to (I) indicates the changes in the material in the vapor deposition reaction process when the separation film is produced with the PPX (the sample A) expressed in the chemical formula A individually. At first, the diparaxylene which is the dimer solid becoming the material expressed in the chemical formula (G) is vaporized under the environment of 100° C. to 200° C. Then, as expressed in the chemical formula (H), the stable diragical paraxylene monomer is formed by the thermal decomposition of the dimer element under the aforesaid environment of approximately 700° C. Then, the adsorption and polymerization of the diragical paraxylene is performed simultaneously for such member as the substrate for use of a head with the sacrifice layer having been coated or the Si wafer. In this manner, the polyparaxylene movable film is formed at the room temperature.

Particularly, here, the condition changes from the one expressed in the chemical formula (H) to (I), and the permeability of the radical paraxylene into the minute portions, which is the product of the dimer element produced in the vapor phase condition, is promoted when the movable film is produced under the vacuum of 0.1 [Torr] or less. In this manner, the close contactness between the fixing portions (pedestals, liquid flow paths, and the like) of the movable film and the movable film is enhanced by providing the chemically stable binding for the fixing portions of the movable film.

(G)

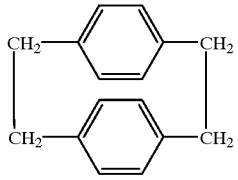

(H)

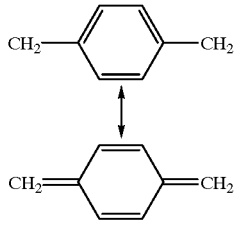

-continued (I)

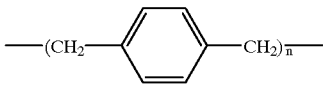

(The Problems and Effects of the Additional Technology)

When the aforesaid organic film is used in accordance with the present invention, and the liquid discharges are preformed on the basis of the bubble formation brought about by the film boiling by use of the heat generating elements, the provision of such film is beyond the conventional level of technology after considering the situations that may be encountered in practice, and the invention is effective.

In this respect, although there are some in which the enhancement of the discharge efficiency is attempted as the problem that should be solved, most of the conventional technologies are those aimed at the simple provision of the separation film with which to separate the bubbling liquid and the discharge liquid.

With this in view, the problem that the present invention should attempt to solve anew is the enhancement of the durability of the separation film itself, and the ink jet head as well, with particular consideration given to the displacement of the separation film accompanied by a series of changes, such as the creation, the development and the defoaming of the bubble".

Therefore, each of the inventions that have solved this problem eliminates all the causes of the previous problems themselves, and also, if any abnormal operation is encountered, the recovery process functions immediately to complete the restoration. Here, as compared with the liquid jet head having the conventional separation film, the period during which the head can be used without braking the separation film is much longer, and the life of the head itself becomes much longer, and at the same time, it can demonstrate the effect that the portion of the head where a plurality of nozzles are arranged is prevented from the local damage that may be caused. Not only each of the inventions is effective by itself, but also, the invention can demonstrate excellent effects in a better condition by combining each of them.

As described above, in accordance with the liquid jet head of the present invention, a desired movable separation film is provided with the permanent distortion after the formation of the movable separation film that can essentially separate the first liquid flow paths for use of the discharge liquid and the second liquid flow paths for use of the bubbling liquid. Then, it is possible to eliminate most of the elasticity of the desired movable separation film so that part of the bubbling power is not transformed into the energy that causes the film to stretch. Therefore, it becomes possible to displace the film largely for the desired movable separation film to the extent that part of the bubbling power is not transformed into the energy that causes the film to stretch as compared with the case where the same bubbling power is given to the other movable separation film which is in the elastic region. In other words, with the present invention, the desired movable separation film can change the discharge droplet into the larger dot by the same bubbling power applied to the formation of the smaller dot. As a result, with the addition of the distorting process of the present invention, the larger dots and the smaller dots can be impacted locally by use of the multiple nozzle head or there is no need for the adjustment of the bubbling power when the amount of discharge droplets should be adjusted in order to perform the discharge of liquid droplets in a specific amount without fluctuation. With a head of the kind, the larger dots can be discharged without increasing the bubbling power, hence reducing the dissipation power, leading to making the life of the head longer.

What is claimed is:

1. A method for manufacturing a liquid jet head provided with first liquid flow paths communicating with discharge ports for discharging discharge liquid, second liquid flow paths having heat generating elements for creating bubbles in bubbling liquid, corresponding to the first liquid flow paths, and movable separation films for essentially separating the first liquid flow paths and the corresponding second liquid flow paths from each other at all times, comprising the steps of:

firstly, forming organic films becoming the movable separation films, and secondly, providing permanent distortion for the organic films formed in said first step.

2. A method for manufacturing a liquid jet head according to claim 1, wherein recessed portions are formed on portions of the movable films facing the heat generating elements.

3. A method for manufacturing a liquid jet head according to claim 1, wherein stress beyond a yielding point is provided for the movable separation films in said second step.

4. A method for manufacturing a liquid jet head according to any one of claims 1 to 3, wherein the movable separation films contain polyparaxylene.

5. A liquid jet head comprising at least first liquid flow paths communicating with discharge ports for discharging discharge liquid, second liquid flow paths having bubble generating areas for creating bubbles in bubbling liquid, corresponding to said first liquid flow paths, and movable separation films for essentially separating said first liquid flow paths and said corresponding second liquid flow paths from each other at all times, wherein said movable separation films are organic films formed by deposition using a chemical phase reaction or by deposition using a plasma polymerization reaction, and said organic films are provided with permanent distortion.

6. A liquid jet head according to claim 5, wherein recessed portions are formed on portions of said movable films facing said bubble generating areas.

7. A liquid jet head according to claim 5, wherein stress beyond a yielding point is provided for said movable separation films.

8. A liquid jet head according to any one of claims 5 to 7, wherein said movable separation films contain polyparaxylene.

9. A head cartridge comprising:

a liquid jet head according to any one of claims 5 to 7; and an ink tank holding liquid to be discharged by said head.

10. A liquid jet recording apparatus comprising:

a liquid jet head according to any one of claims 5 to 7;

an ink tank holding liquid to be discharged by said head; and a mounting unit for mounting said liquid jet head.

11. A liquid jet recording apparatus according to claim 10, further comprising:

means for carrying a recording medium for recording made thereon by said liquid jet head.

12. A liquid jet head provided with an elemental substrate having a plurality of first liquid flow paths communicated with discharge ports for discharging discharge liquid, and heat generating elements for creating bubbles in bubbling liquid; second liquid flow paths corresponding to said first liquid flow paths; and movable separation organic films for essentially separating said first liquid flow paths and said corresponding second liquid flow paths from each other at all times, wherein one or more of said movable separation organic films on specific portions corresponding to said second liquid flow paths are provided with distortion so as to temporarily project into said first liquid flow paths.

13. A liquid jet head according to claim 12, wherein said distortion is provided for specific films from among said movable separation organic films, said specific films corresponding to specific first liquid flow paths having adjusted discharge characteristics.

14. A liquid jet head according to claim 12, wherein said distortion is provided to said movable separation organic films, corresponding to all of the first liquid flow paths to be used for formation of dot images using the discharge liquid, and said distortion is permanent distortion beyond a yielding point.

* * * * *

UNITED STATES PATENT AND TRADEMARK OFFICE

CERTIFICATE OF CORRECTION

PATENT NO. : 6,334,670 B1
DATED : January 1, 2002
INVENTOR(S) : Aya Yoshihira et al.

It is certified that error appears in the above-identified patent and that said Letters Patent is hereby corrected as shown below:

Title page,
Item [57], ABSTRACT,
Line 9, “the time,” should read -- times, --.

Column 1,
Line 42, “discharges” should read -- discharge --; and
Line 59, “other” should -- other examples of --.

Column 2,
Line 5, “charges” should read -- charge -- ; and
Line 6, “condition” should read -- bubbles --.

Column 3,
Lines 16 and 18, “the time” should read -- times --;
Line 23, “achiever” should read -- achieve --; and
Line 64, “the” should read -- this --.

Column 4,
Line 18, “direction” should read -- direction of --; and
Line 63, “12b,” should read -- 12b --.

Column 5,
Line 24, “veiw” should read -- view --;
Lines 32 and 38, “second” should read -- third --;
Line 42, “a third” should read -- the third --;
Line 44, “is” should read -- is a --; and
Line 53, “third” should read -- fourth --.

Column 6,
Line 46, “1a” should be in boldface.

Column 8,
Line 55, “hen ad” should read -- head --.

Column 10,
Line 31, “irregularly,” should read -- irregular, --;
Line 63, “in a thickness of as” should read -- as thin as --; and
Line 64, “extremely thin as” should be deleted.

UNITED STATES PATENT AND TRADEMARK OFFICE

CERTIFICATE OF CORRECTION

PATENT NO. : 6,334,670 B1
DATED : January 1, 2002
INVENTOR(S) : Aya Yoshihira et al.

It is certified that error appears in the above-identified patent and that said Letters Patent is hereby corrected as shown below:

Column 11,
Line 58, “only the” should read -- the only --; and
Line 65, “closely” (2d occurrence) should read -- contact --.

Column 12,
Line 33, “form” should read -- from --.

Column 13,
Line 4, “form” should read -- from --;
Line 52, “atom. Therefore,” should read -- atom, --;
Line 61, “discharge” should read -- discharged --.

Column 15,
Line 25, “word,” should read -- words --; and
Line 67, “provided” should read -- provide --.

Column 16,
Line 47, “cause” should read -- causes --.

Column 17,
Line 46, “relative” should read -- relatively --; and
Line 62, “sectional” should read -- sectional view --.

Column 22,
Line 41, “layers” should read -- layer --.

Column 23,
Line 43, “besides,” should read -- Besides, --.

Column 25,
Line 32, “provided” should read -- provide --; and
Line 44, “having” should read -- has --.

Column 26,
Line 52, “word,” should read -- words, --.

Column 28,
Line 8, “705. Then, with” should read -- 705, with --; and
Line 49, “development of the” should be deleted.

UNITED STATES PATENT AND TRADEMARK OFFICE

CERTIFICATE OF CORRECTION

PATENT NO. : 6,334,670 B1
DATED : January 1, 2002
INVENTOR(S) : Aya Yoshihira et al.

It is certified that error appears in the above-identified patent and that said Letters Patent is hereby corrected as shown below:

Column 29,
Line 5, “effectively functioning” should read -- effective functioning of --;
Line 56, “715b” should read -- 715B --; and
Line 60, “development of the” should be deleted.

Column 31,
Line 22, “form” should read -- from --;
Line 31, “displaced” should read -- displaced more --; and
Line 45, “sown” should read -- shown --.

Column 32,
Line 36, “which” should read -- with --.

Column 33,
Line 43, “cases).” should read -- cases. --;
Line 46, “180º” should read -- 180ºC --; and
Line 50, “is” should read -- are --;
Line 54, “found” should read -- been found --; and
Line 63, “order,” should be deleted.

Column 34,
Line 8, “(or” should read -- or --;
Line 9, “at along” should read -- at a long --;
Line 24, “more” should be deleted;
Line 28, “an” should read -- as an --;
Line 39, “interval” should read -- intervals --;
Line 40, “hundredth” should read -- hundredths --; and
Line 42, “fear” should read -- concern --.

Column 35,
Line 5, “tenth” should read -- tenths --;
Line 28, “fear” should read -- concern --;
Line 48, “minuets” should read -- minutes --; and
Line 50, “The attention” should read -- Attention --.

Column 36,
Line 12, “each” should read -- in each --.

UNITED STATES PATENT AND TRADEMARK OFFICE

CERTIFICATE OF CORRECTION

PATENT NO. : 6,334,670 B1 
DATED : January 1, 2002
INVENTOR(S) : Aya Yoshihira et al.

It is certified that error appears in the above-identified patent and that said Letters Patent is hereby corrected as shown below:

Column 37,
Line 19, “sown” should read -- shown --;
Table 1, “slighter” should read -- slightly --; and
Line 65, “for it” should be deleted.

Column 39,
Line 11, “preformed” should read -- performed --;
Line 24, “enhancement” should read -- “enhancement --; and
Line 36, “braking” should read -- breaking --.

Column 40,
Line 65, “communicated” should read -- communicating --.

Column 42,
Line 6, “films,” should read -- films --.

Signed and Sealed this

Thirtieth Day of July, 2002

*Attest:*

*Attesting Officer*

JAMES E. ROGAN
*Director of the United States Patent and Trademark Office*